US006884134B2

(12) United States Patent
McCarthy

(10) Patent No.: US 6,884,134 B2
(45) Date of Patent: Apr. 26, 2005

(54) HIGH DEFLECTION HYDROFOILS AND SWIM FINS

(76) Inventor: Peter T. McCarthy, 26810 Pine Cliff Pl., Valeucia, CA (US) 91381

( * ) Notice: Subject to any disclaimer, the term of this patent is extended or adjusted under 35 U.S.C. 154(b) by 0 days.

(21) Appl. No.: 10/623,187

(22) Filed: Jul. 18, 2003

(65) Prior Publication Data

US 2004/0127117 A1 Jul. 1, 2004

Related U.S. Application Data

(60) Provisional application No. 60/397,577, filed on Jul. 19, 2002, and provisional application No. 60/433,544, filed on Dec. 13, 2002.

(51) Int. Cl.[7] ..... A63B 31/08
(52) U.S. Cl. ..... 441/64
(58) Field of Search ..... 441/61, 64; 440/15

(56) References Cited

U.S. PATENT DOCUMENTS

| | | | |
|---|---|---|---|
| 5,384 | A | 12/1847 | Tilghman |
| 144,538 | A | 11/1873 | Harsen |
| 169,396 | A | 11/1875 | Ahlstrom |
| 783,012 | A | 2/1905 | Biedermann et al. |
| 871,059 | A | 11/1907 | Douse |
| 983,967 | A | 2/1911 | Woods |
| 998,146 | A | 7/1911 | Alfier et al. |
| 1,011,767 | A | 12/1911 | Farum |
| 1,061,264 | A | 5/1913 | Bys |
| 1,063,805 | A | 6/1913 | Krause |
| 1,324,722 | A | 12/1919 | Bergin |

(Continued)

FOREIGN PATENT DOCUMENTS

| | | |
|---|---|---|
| DE | 1075 997 | 2/1960 |
| EP | 1 082 975 A | 3/2001 |

(Continued)

OTHER PUBLICATIONS

Rossler, Robert N., entitled, " Moving Forward—Getting your best kick in the water can come from a combination of design, efficiency and hydrodynamics in fins". Alert Diver, Nov.–Dec. 1997, pp. 26–28.

(Continued)

*Primary Examiner*—Andrew D. Wright
(74) *Attorney, Agent, or Firm*—Knobbe Martens Olson & Bear LLP

(57) ABSTRACT

Designs and methods are disclosed for permitting permit scooped shaped swim fin blades (184) to flex around a transverse axis to a significantly reduced angle of attack while reducing or preventing the scooped blade portion (254) from collapsing or buckling under the longitudinal compression forces (222) exerted on the scooped portion during a large scale blade deflection (212) by strategically alleviating or controlling such compression forces (222). Method are also disclosed for increasing flow capacity, effective scoop length, scoop depth over a greater length of the blade, reducing blade resistance to large scale deflections, reducing bending resistance within scooped blade portions (254) that are experiencing high levels of blade deflection. Methods are also provided for reducing lost motion and increasing propulsion during the inversion phase of a reciprocating kicking stroke cycle while also increasing the formation of a scooped blade region (254) during the inversion phase of the stroke cycle.

40 Claims, 19 Drawing Sheets

U.S. PATENT DOCUMENTS 1,607,857 A 5/1926 Zukal
1,684,714 A 9/1928 Perry
1,710,673 A 4/1929 Bonney
2,123,096 A 7/1938 Charpentier
2,210,642 A 8/1940 Thompson
2,241,305 A 5/1941 Hill, Jr.
2,321,009 A 6/1943 Churchill
2,343,468 A 3/1944 Messinger
2,423,571 A 7/1947 Wilen
2,576,981 A 12/1951 Vogt
2,588,363 A 3/1952 Corlieu
2,846,165 A 8/1958 Axelson
2,850,487 A 9/1958 D'Alello
2,865,033 A 12/1958 Jayet
2,889,563 A 6/1959 Lamb et al.
2,903,719 A 9/1959 Wozencraft
2,950,487 A 8/1960 Woods
3,019,458 A 2/1962 De Barbieri et al.
3,055,025 A 9/1962 Ferraro et al.
3,082,442 A 3/1963 Cousteau et al.
3,084,355 A 4/1963 Ciccotelli
3,086,492 A 4/1963 Holley
3,109,495 A 11/1963 Lang
3,112,503 A 12/1963 Girden
3,171,142 A 3/1965 Auzols
3,239,857 A 3/1966 Gwynne
3,256,540 A 6/1966 Novelli
3,369,775 A 2/1968 Rethorst
3,411,165 A 11/1968 Murdoch
3,411,738 A 11/1968 Sargent
3,422,470 A 1/1969 Mares
3,453,981 A 7/1969 Gause
3,480,234 A 11/1969 Comish, III
3,491,997 A 1/1970 Winters
3,596,854 A 8/1971 Haney, Jr.
3,665,535 A 5/1972 Picken
3,773,011 A 11/1973 Gronier
3,776,363 A 12/1973 Kuethe
3,810,269 A 5/1974 Tabata
3,904,151 A 9/1975 Rethorst
3,913,158 A * 10/1975 Vilarrubis ..... 441/64
3,922,741 A 12/1975 Semeia
3,934,290 A 1/1976 Le Vasseur
3,952,351 A 4/1976 Gisbert
4,007,506 A 2/1977 Rasmussen
4,025,977 A 5/1977 Cronin
4,083,071 A 4/1978 Forjot
4,108,403 A 8/1978 Finch
4,193,371 A 3/1980 Baulard-Caugan
4,197,869 A 4/1980 Moncrieff-Yeates
4,209,866 A 7/1980 Loeffler
4,293,110 A 10/1981 Middleton et al.
4,323,209 A 4/1982 Thompson
4,342,558 A 8/1982 Wilson
4,382,569 A 5/1983 Boppe et al.
4,444,367 A 4/1984 Spillman
D278,165 S 3/1985 Evans
4,521,220 A 6/1985 Schoofs
4,541,810 A 9/1985 Wenzel
4,657,515 A 4/1987 Ciccotelli
4,689,029 A 8/1987 Ciccotelli
4,705,240 A 11/1987 Dixon
4,722,499 A 2/1988 Klug
4,738,645 A 4/1988 Garofalo
4,752,259 A 6/1988 Tackett et al.
4,773,885 A 9/1988 Ciccotelli
4,775,343 A 10/1988 Lamont et al.
4,776,535 A 10/1988 Paterson et al.
4,776,542 A 10/1988 Van Dam
4,781,637 A 11/1988 Caires
4,795,385 A 1/1989 Matsuoka
4,820,218 A 4/1989 Van de Pol
D302,999 S 8/1989 McCredie
4,857,024 A 8/1989 Evans
4,869,696 A 9/1989 Ciccotelli
4,895,537 A 1/1990 Ciccotelli
4,929,206 A 5/1990 Evans
4,934,971 A 6/1990 Picken
4,940,437 A 7/1990 Piatt
4,944,703 A 7/1990 Mosier
4,949,919 A 8/1990 Wajnikonis
4,954,111 A 9/1990 Cressi
4,954,112 A 9/1990 Negrini et al.
4,975,022 A 12/1990 Perry
5,058,837 A 10/1991 Wheeler
5,074,234 A 12/1991 Stearns, IV
D327,933 S 7/1992 Evans
D327,934 S 7/1992 Evans
D327,935 S 7/1992 Evans
D328,118 S 7/1992 Evans
5,150,859 A 9/1992 Ransick
5,163,859 A 11/1992 Beltrani et al.
D340,272 S 10/1993 Evans
5,304,081 A 4/1994 Takizawa
5,324,219 A 6/1994 Beltrani et al.
5,356,094 A 10/1994 Sylvain
5,356,323 A 10/1994 Evans
5,358,439 A 10/1994 Paolo
5,366,177 A 11/1994 DeCoux
D353,181 S 12/1994 Evans
5,374,210 A 12/1994 Sardella
5,387,145 A 2/1995 Wagner
5,417,599 A 5/1995 Evans
5,429,536 A 7/1995 Evans
5,435,764 A 7/1995 Testa et al.
5,443,593 A 8/1995 Garofalo
5,522,748 A 6/1996 Cressi
5,527,197 A 6/1996 Evans
5,533,918 A 7/1996 Sanders
5,595,518 A 1/1997 Ours
5,597,336 A 1/1997 Evans
5,634,613 A 6/1997 McCarthy
D393,684 S 4/1998 Lin
5,746,631 A 5/1998 McCarthy
D396,897 S 8/1998 Evans
5,810,629 A 9/1998 Parr
D404,456 S 1/1999 Evans
6,050,868 A 4/2000 McCarthy
6,053,788 A 4/2000 Garofalo
6,095,879 A 8/2000 McCarthy
6,126,503 A 10/2000 Viale et al.
6,146,224 A 11/2000 McCarthy
6,290,561 B1 9/2001 Garofalo et al.
6,364,728 B1 4/2002 Viale et al.
6,371,821 B1 4/2002 McCarthy
6,413,133 B1 7/2002 McCarthy
6,482,059 B1 11/2002 McCarthy
6,497,597 B1 12/2002 McCarthy
6,585,548 B1 7/2003 McCarthy
6,607,411 B1 8/2003 McCarthy
6,712,656 B1 3/2004 McCarthy
6,719,385 B1 4/2004 Adams et al.
2002/0025744 A1 2/2002 McCarthy
2004/0152376 A1 8/2004 McCarthy

FOREIGN PATENT DOCUMENTS

FR 1.245.395 9/1960
FR 1245395 9/1960
FR 2 543 841 4/1983
GB 17033 of 1890
GB 234305 5/1925

| | | |
|---|---|---|
| GB | 1284765 | 8/1972 |
| IT | 625377 | 9/1961 |
| WO | WO 01 85267 A | 11/2001 |

OTHER PUBLICATIONS

Triantafyllou, Michael S. and Triantafyllou George S., entitled, "An Efficient Swimming Machine". Scientific American, Mar. 1995, pp. 64–70.
"3302 of 1880" (Picture From Book–Found in US PTO).
"Test Dive" Article in Jan./Feb. 1996 issue of *Sport Diver Magazine*.
"Oceanic V–Drive Fins" in May/Jun. 1996 Issue of *Sport Diver Magazine*.
Walton and Katz "Application of Leading–Edge Vortex Manipulations to Reduce Wing Rock Amplitudes" *Journal of Aircraft* vol. 30, No. 4, pp. 555–559.
Traub and Nurick "Effects of Wing–Tip Vortex Flaps" *Journal of Aircraft* vol. 30, No. 4, pp. 557–559.
Grantz and Marchman III" Trailing Edge Flap Influence on Leading Edge Vortex Flap Aerodynamics", *Journal of Aircraft* vol. 20, No. 2, pp. 165–169.
Rao "An Exploratory Study of Area–Efficient Vortex Flap Concepts" *Journal of Aircraft*, vol. 20, No. 12, pp. 1062–1067.
Lamar and Campbell "Vortex Flaps–Advanced Control Devices for Supercruise Fighters" Jan. 1984, Aerospace America.
"BZ" bodysurfing fin (Picture), 1st production in 1990.
"Blade Pro" bodysurfing fin (Picture), 1st production 1991.
"Wave Rebel" bodysurfing fin (Picture), 1st production 1994.
Art. 1400 Pinna "Professional" Fin (1989).
U.S. Appl. No. 10/712,085; Inventor McCarthy; filed Nov. 13, 2003.
U.S. Appl. No. 10/762,640; Inventor McCarthy; filed Jan. 22, 2004.
U.S. Appl. No. 09/852,155; Inventor McCarthy; filed May 9, 2001.
U.S. Appl. No. 10/877,969; Inventor McCarthy; filed Jun. 25, 2004.

* cited by examiner

Fib 12a
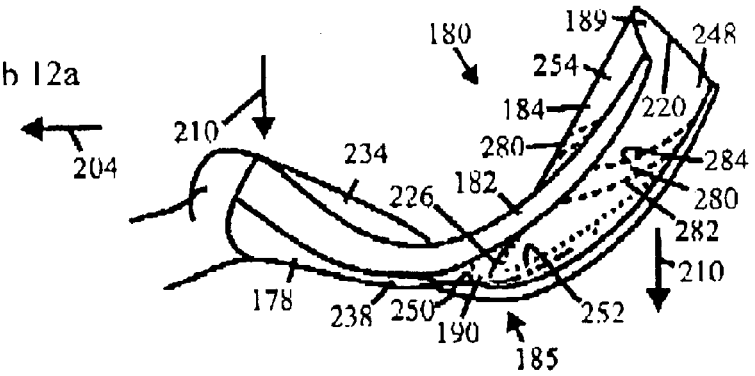
Fig 12b
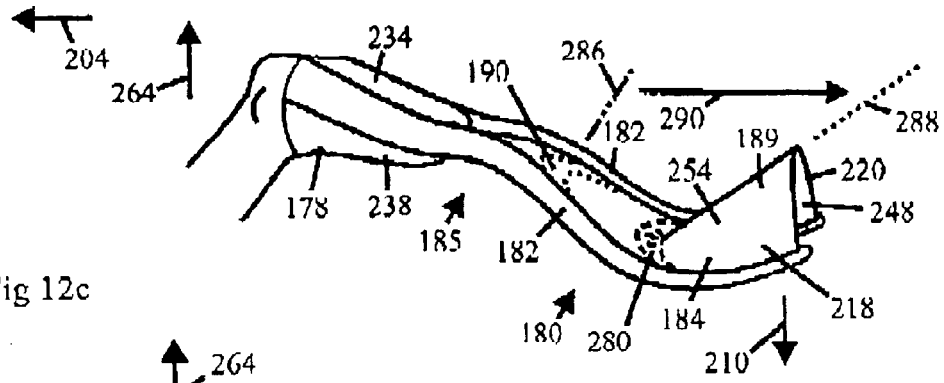
Fig 12c
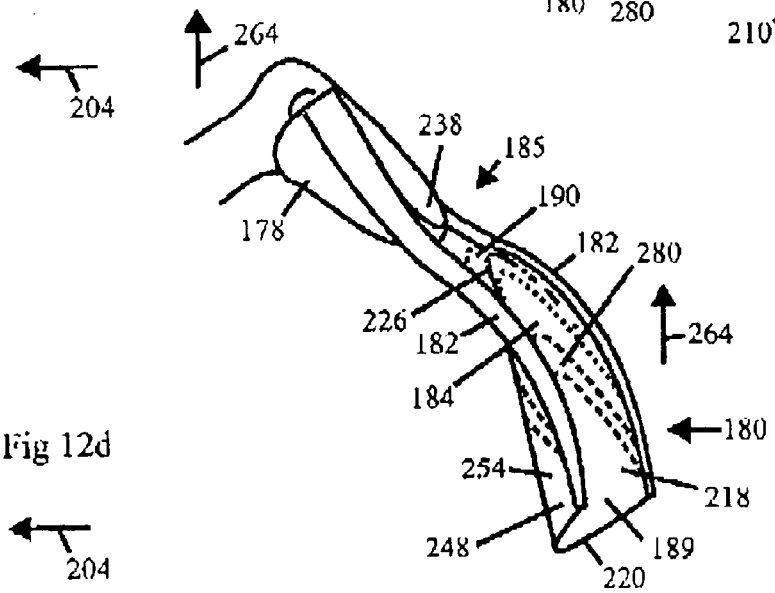
Fig 12d
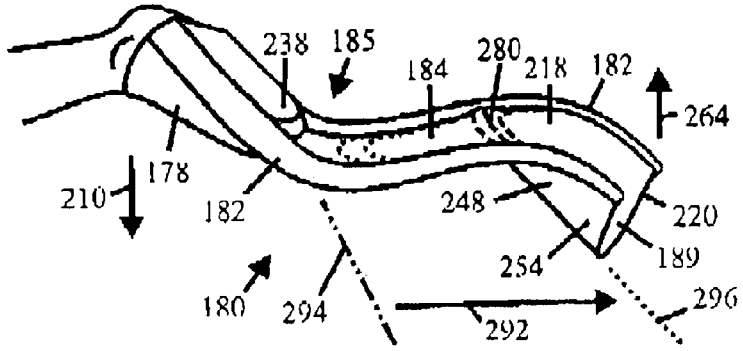

Fib 45
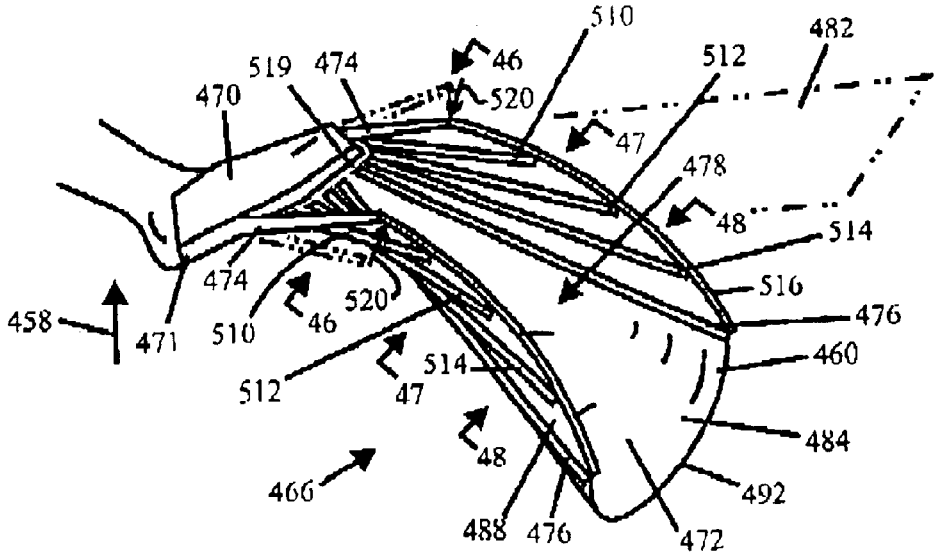
Fig 46
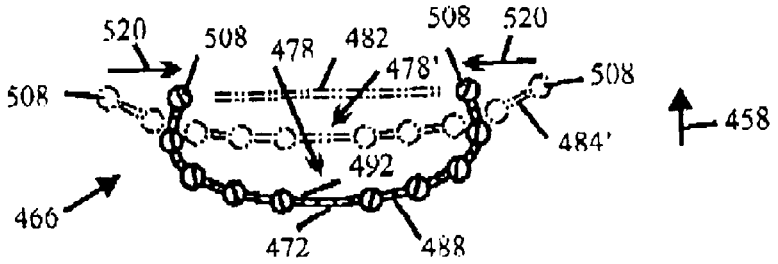
Fig 47
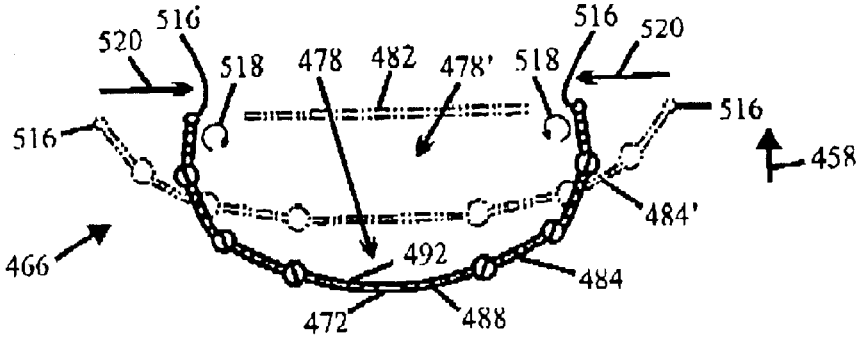
Fig 48
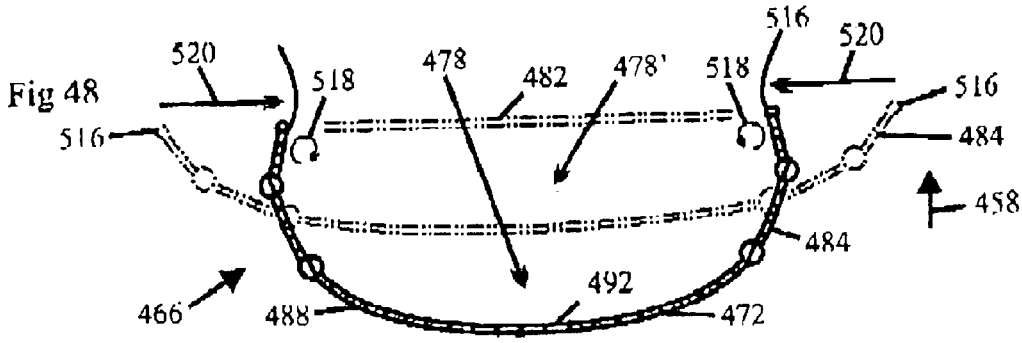

HIGH DEFLECTION HYDROFOILS AND SWIM FINS

RELATED APPLICATIONS

This application claims the benefit under 35 U.S.C. § 119(e) of U.S. Provisional Patent Application No. 60/397,577, filed Jul. 19, 2002, titled HIGH DEFLECTION HYDROFOILS AND SWIM FINS; and of U.S. Provisional Patent Application No. 60/433,544, filed Dec. 13, 2002, titled HIGH DEFLECTION HYDROFOILS AND SWIM FINS. The entire disclosure of each of the above-mentioned provisional patent applications is hereby incorporated by reference herein and made a part of this specification.

BACKGROUND

1. Field of Invention

This invention relates to swimming aids, specifically to such devices which attach to the feet of a swimmer and create propulsion from a kicking motion as well as to propulsion foils used to generate propulsion.

2. Description of Prior Art

Prior art swim fin blades using flexible blades that flex to form a scoop shape during use are vulnerable to longitudinal compression forces if the entire blade system bends around a transverse axis to a reduced angle of attack. When the blade bends around a transverse axis to a reduced angle of attack, the central portion of the longitudinal scoop is forced to flex around a bending radius that is smaller than the bending radius occurring at the outer edges of the longitudinal scoop. The transverse bending of the outer scoop edges forces the central portions of the longitudinal scoop to contract in a longitudinal manner toward the foot pocket. Because prior art blade designs do not recognize this problem or provide any suitable solutions, the blade's resistance to contraction prevents the blade from forming the scoop shape during use and the scoop advantage is lost. Longitudinal compression forces created by the deflection of the blade around a transverse axis cause the scoop shape to collapse. As the degree of deflection increases around a transverse axis, the blade's resistance to forming a scoop is also increased. As a result, only a small portion of the blade's surface area near the tip of the fin is able to form a scoop and the back pressure within the blade also causes the depth of the collapsed scoop to be very small or often negligible.

BRIEF DESCRIPTION OF THE DRAWINGS

FIGS. 12*a* to 12*d* show various orientations of the swim fin shown in FIGS. 9 to 11 during various portions of a reciprocating kick cycle.

FIG. 45 shows a perspective view of the swim fin shown in FIG. 43 during a kicking stroke.

FIG. 46 shows a cross sectional view taken along the line 46—46 in FIG. 45.

FIG. 47 shows a cross sectional view taken along the line 47—47 in FIG. 45.

FIG. 48 shows a cross sectional view taken along the line 48—48 in FIG. 45.

DESCRIPTION AND OPERATION-FIG. 1

Figure 1:
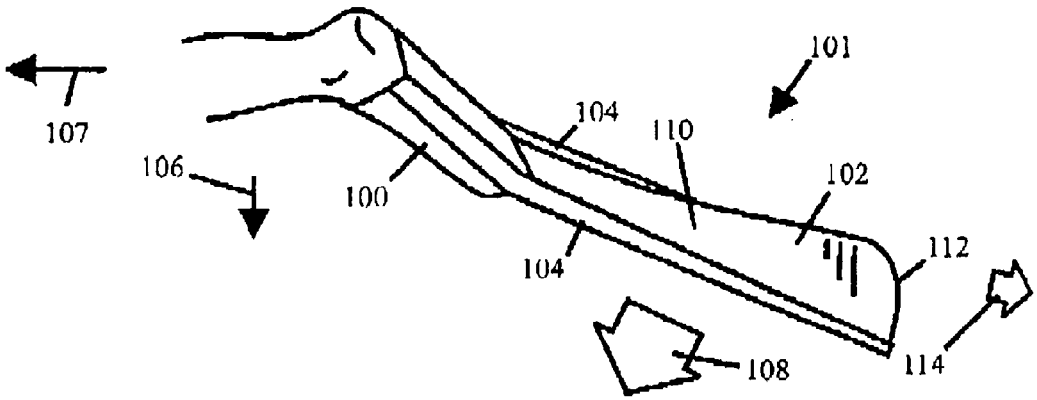
Fig 1 PRIOR ART
FIG. 1 shows a prior art swim fin that does not deflect around a transverse axis.

FIG. 1 shows a prior art swim fin that does not deflect around a transverse axis. The swim fin has a foot pocket 100 and a blade region 101. Blade region 101 has a blade 102, and two stiffening members 104. The swimmer is kicking the swim fin in a kick direction 106 with the intention of moving in a travel direction 107. In this example, stiffening members 104 are very rigid and do not flex significantly around a transverse axis during use. Blade 102 is sufficiently flexible to bow between stiffening members 104 to form a scoop shape during use. Most of the water along blade 102 is moved in a flow direction 108, which is shown by a large arrow. Flow direction 108 is perpendicular to the lengthwise alignment of blade 102 and stiffening members 104. Flow direction 108 is seen to be aimed in a downward direction that is angled in the wrong direction for propelling in travel direction 107. Blade 102 is seen to have a lee surface 110 and a forward edge 112 that is bowed to form a scoop shape. Only a small amount of water moves in a flow direction 114, which is shown by a small arrow located behind forward edge 112. Because the scoop is oriented at a very high angle of attack relative to kick direction 106, turbulence and stall conditions form along lee surface 110 and much of the water within the scoop spills sideways around the side edges the scoop and very little water flows in flow direction 114. As a result, very little propulsion is produced during kick direction 106, which in this case is a down stroke.

Figure 2:
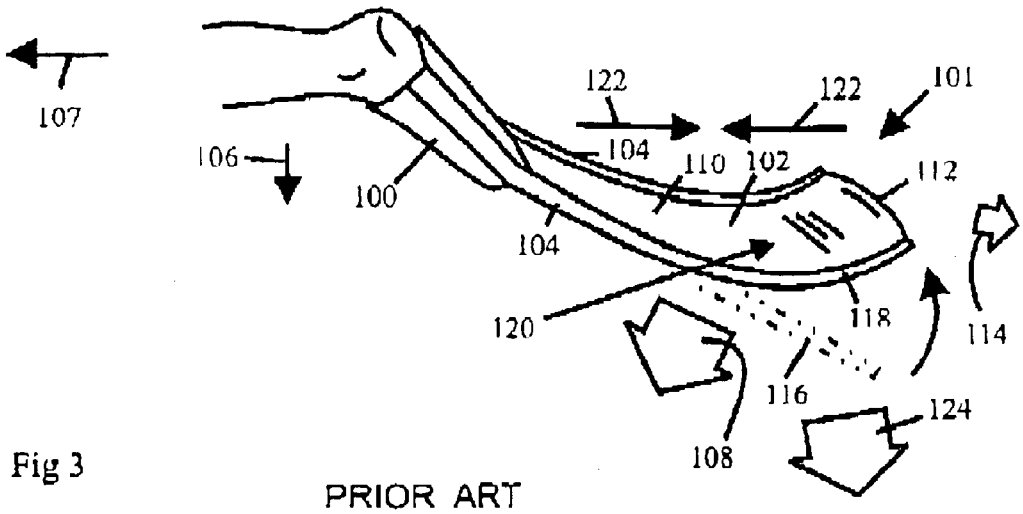
Fig 2 PRIOR ART
FIG. 2 shows the same prior art swim fin shown in FIG. 1 which is arranged to deflect around a transverse axis.

FIG. 2 shows the same prior art swim fin shown in FIG. 1 which is arranged to deflect around a transverse axis. In FIG. 2, blade 102 and stiffening members 104 are seen to have deflected around a transverse axis from a neutral position 116 to a deflected position 118. It this situation, stiffening members 104 are made more flexible to permit flexing around a transverse axis to a reduced angle of attack. As stiffening members 104 flex around a transverse axis, the scoop shaped shown in FIG. 1 collapses at a collapsing zone 120. This is because the transverse bending of stiffening members 104 and blade 102 causes the scoop shape to be subjected to a compression force 122, which is shown by converging arrows. Because blade 102 is not arranged to be able to contract in a longitudinal direction, back pressure is created along blade 102 and the scoop shape collapses between foot pocket 100 and collapsing zone 120. Only a small portion of blade 102 between collapsing zone 120 and forward edge 112 is able to start forming a scoop shape. While the scoop shape shown in FIG. 1 is relatively deep and occupies a major portion of the length of blade 102, the scoop shape shown in FIG. 2 is very shallow and occupies a very small portion of the length of blade 102. While the reduced angle of attack of blade 102 near forward edge 112 in FIG. 2 is intended to direct an increased amount of water in flow direction 114, the collapse of the scoop shape in FIG. 2 due to compression force 122 causes less water to be channeled by the scoop shape and the amount of water that flows in flow direction 114 remains significantly small. The deflection of blade 102 near forward edge 112 causes water near this region to move in a flow direction 124. Water near along blade 102 near foot pocket 100 is directed in flow direction 108. As a result, propulsion in travel direction 107 is poor and inefficient.

Figure 3:
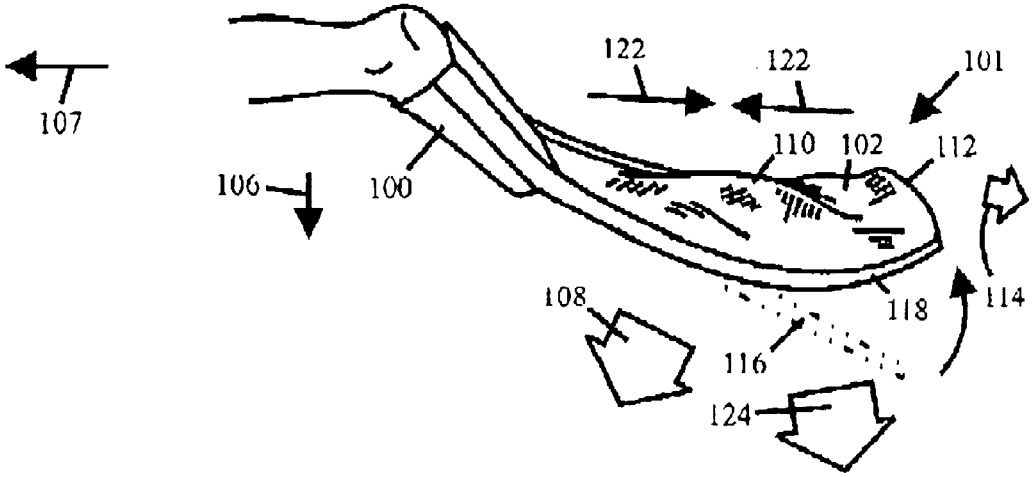
Fig 3 PRIOR ART
FIG. 3 shows the same prior art swim fin shown in FIG. 2 with a highly resilient blade portion that collapses during use.

FIG. 3 shows the same prior art swim fin shown in FIG. 2 except that blade 102 is made with a highly flexible material. In FIG. 3, the flexibility of blade 102 is increased so that back pressure created by compression force 122 does not cause blade 102 to become flat. Because blade 102 must succumb to compression force 122 before it can form a scoop shape, blade 102 must contract in a longitudinal direction. The problem is that if the flexibility of blade 102 is made sufficiently flexible to permit blade 102 to succumb to compression force 122, a major portion of blade 102 will collapse in a random formation of wrinkles and folds. This forms an awkward and inefficient shape that does not channel water efficiently. As a result, the amount of water moved in flow direction 114 remains small and most of the water is moved in flow directions 108 and 124. Again, propulsion is poor and inefficient.

Figure 4A:
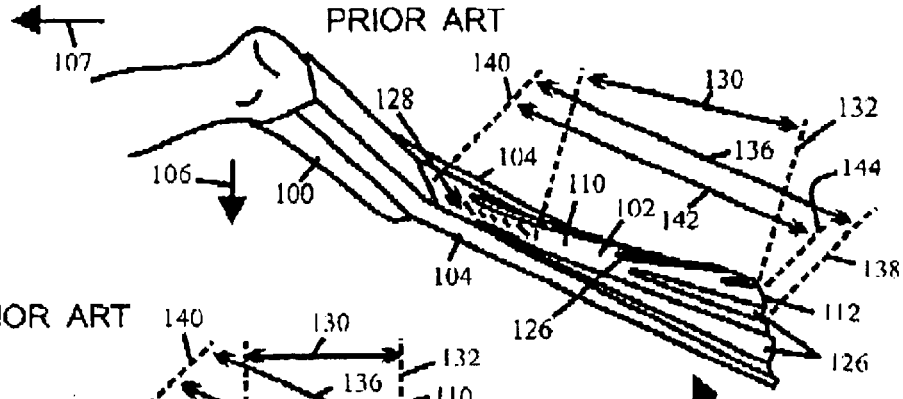
FIGS. 4*a* to 4*d* show a prior art swim fin having various degrees of flexibility around a transverse axis.
Figure 4B:
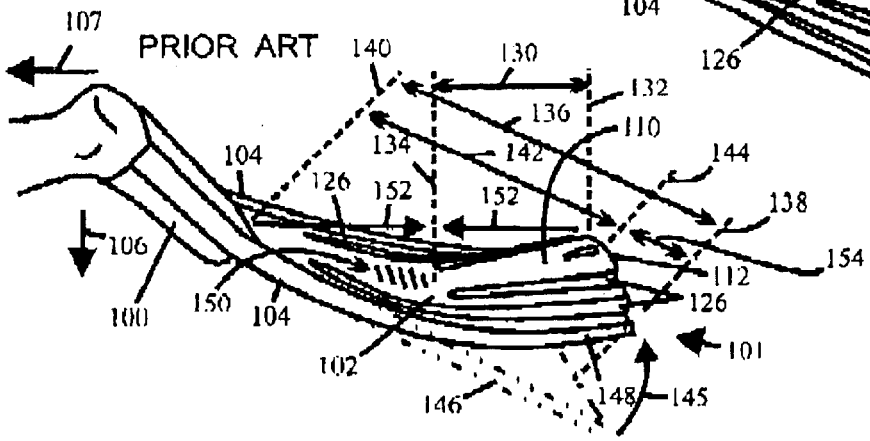

FIGS. 4*a* to 4*b* shows a prior art swim fin having various degrees of flexibility around a transverse axis. The swim fin shown if FIGS. 4*a* to 4*b* is the basic prior art swim fin shown in FIG. 1 except that a series of longitudinal flexible inserts 126 are molded into the blade. Inserts 126 are made with a flexible material and have at least one expandable fold formed around a lengthwise axis. Inserts 126 permit blade 102 to bow to form a scoop shape while blade 102 is made with a relatively stiffer material. A flattening zone 128 is seen to exist along blade 102 near foot pocket 100 since blade 102 is relatively stiff and must bend around a relatively large bending radius around a transverse axis in order for blade 102 to flex upward to form a scoop shape above the plane formed by stiffening members 104. A series of transverse lines show flattening zone 128. The portion of blade 102 between flattening zone 128 and forward edge 102 is seen to form a scoop having a longitudinal scoop length 130, which is located between a flexed forward edge position and a beginning of scoop position 134. Scoop length 130 is aligned with the inclined orientation of the scooped portion of blade 102. Blade 102 is seen to have an unflexed blade length 136, which is between an unflexed forward edge position 138 and a root blade position 140 located adjacent the connection between blade 102 and foot pocket 100. A flexed blade length 142 is between a flexed forward edge reference line 144 and root blade position 140. Flexed blade length 142 is seen to be shorter than unflexed blade length 136 because blade 102 is flexing around an arched path as it forms a scoop relative to the plane of stiffening members 104. This is also increased since blade 102 must flex around a transverse axis relative to a large bending radius due to the formation of flattening zone 128 on blade 102, which creates a decrease in the overall longitudinal length of blade 102.

In FIG. 4*a*, scoop length 130 is seen to be less than both unflexed blade length 136 and flexed blade length 142. As described in FIGS. 1 to 3, the angle of blade 102 in FIG. 4*a* causes most of the water to be pushed in the same direction as kick direction 106 and very little water is moved in the opposite direction to travel direction 107 and therefore propulsions is poor and inefficient.

FIG. 4*b* shows the same prior art swim fin shown in FIG. 4*b*, except that stiffening members 104 are seen to have experienced a deflection 145 around a transverse axis during use. This is increased bending to stiffening members 104 can occur by increasing the flexibility of stiffening members 104 and, or by increasing the strength of the kicking stroke and therefore increasing the load on blade 102 and stiffening members 104. Blade 102 and stiffening members 104 are seen to have moved from a neutral position 146 to a deflected position 148. Blade 102 is seen to have a collapsing zone 150 which is displayed by a series of lines that show that the contour of blade 102 in this region is not forming a scoop shape as the design intended. Instead of forming a scoop shape, blade 102 collapses at collapsing zone 150.

Because the formation of a scooped shape within blade 102 would require blade 102 to be angled above the curved plane of stiffening members 104, the upper most portion of such a scooped shape would be forced to bend around a smaller bending radius than the bending radius experienced by stiffening members 104. The greater the depth of such a scooped shape, the greater the degree of deflection above the plane of stiffening members 104 and the smaller the bending radius that blade 102 would have to bend around at the greatest deflected portion of blade 102 that would form such a scooped shape. The elevated positioning of a scooped shape within blade 102 would cause blade 102 to bend around a smaller bending radius than stiffening members 104 similar to concentric circular paths have a smaller radius of curvature for concentric circles located closer to the axis of curvature while the concentric circles located farther from the axis of curvature have a larger radius of curvature. The reduced bending radius imposed upon blade 102 by a scoop shape while stiffening members 104 experience bending around a transverse axis, causes a compression force 152 to be applied to blade 102. Because blade 102 is not able to contract longitudinally, blade 102 collapses at collapsing zone 150 and only a small portion of blade 102 is seen to form a scoop shape. Prior art swim fins have suffer from having resistance to longitudinal contraction and are not able to maintain a large scoop shape when the scooped shape is deflected around a transverse axis. The prior art does not explain that such a problem is known and does not provide any suitable solution.

Deflected blade length 142 is seen to be shorter than unflexed blade length 136 by a significant distance illustrated by a longitudinal length reduction 154. The collapse of blade 102 at collapsing zone 150 causes length of scoop 130 to be significantly smaller than shown in FIG. 4*a* due to the transverse bending of stiffening members 104. Length of scoop 130 is seen to be significantly smaller than flexed blade length 142 and unflexed blade length 136 to show that the portion of blade 102 that is able to form a scoop represents only a small portion of the overall length of blade 102. This greatly decreases the channeling capability of the scoop shape. The portions of blade 102 located between beginning of scoop position 134 and foot pocket 100 are not able to form a scoop shape. Furthermore, the portions of blade 102 adjacent collapsing zone 150 can actually deflect in the same direction as kick direction 106 and buckle under the exertion of compression force 152 to create the converse of a scooped shape and causes low pressure surface 110 (a lee surface) to form a concave shape rather than a concave shape as blade 102. This is a structural failure in the scoop shape this is not recognized, addressed or solved by the prior art. Again, most of the water is pushed down in the direction of kick direction 106 and very little water is moved in the opposite direction of travel direction 107 in order to assist with propulsion. Propulsion is poor and inefficient. Stall conditions and turbulence form along low pressure surface 110 to create drag, induced drag and side spill around the outer side edges of blade 102. In addition, the degree of deflection and angle of attack of blade 102 and stiffening members 104 are not arranged to push a significantly large amount of water in the opposite direction of travel direction 107.

Figure 4C:
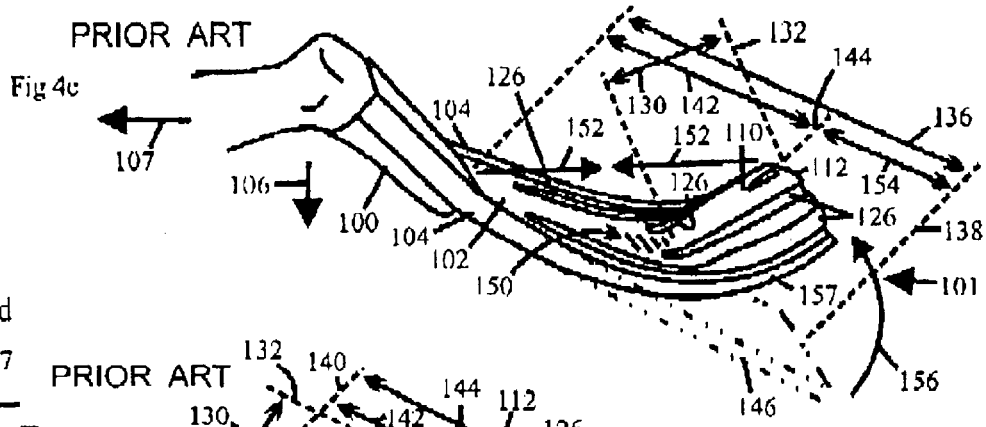

FIG. 4*c* shows the same prior art swim fin shown in FIG. 4*b* except the swim fin in FIG. 4*c* is seen to experience an increased deflection 156 around a transverse axis during use to deflected position 157. Again, this can achieved by increasing the flexibility of stiffening members 104 and, or increasing the strength of the kicking stroke exerted in kick direction 106. Flexed blade length 142 during increased deflection 156 in FIG. 4*c* is seen to be significantly smaller than occurring in FIG. 4*b* during deflection 145. In FIG. 4*c*, it can be seen that as blade 102 and stiffening members 104 experience increased deflection 156, forward edge 112 is pushed closer to foot pocket 100 in a longitudinal direction. Flexed blade length 142 is seen to be smaller than unflexed blade length 136 and the amount of longitudinal blade reduction 154 is seen to have increased significantly compared to FIG. 4*b*. In FIG. 4*c*, the increased amount of longitudinal blade reduction 154 causes compression force 152 to increase. Because this problem is neither recognized or resolved by the prior art, blade 102 collapses further under increased deflection 156 and collapsing zone 150 is seen to have moved farther away from foot pocket 100 and closer to forward edge 112. This causes the portion of blade 102 between collapsing zone 150 and foot pocket 100 to not be able to form a scoop shape. This also causes length of scoop 130 to be significantly smaller which significantly reduces the amount of water that can be channeled by the scoop. When comparing length of scoop 130 to unflexed blade length 136, it can be seen that the collapsing of blade 102 prevents a major portion of blade 102 from forming a scoop shape during deflection 156. Length of scoop 130 during increased deflection 156 in FIG. 4*c* is significantly smaller that shown in FIG. 4*b* during deflection 145.

Figure 4D:
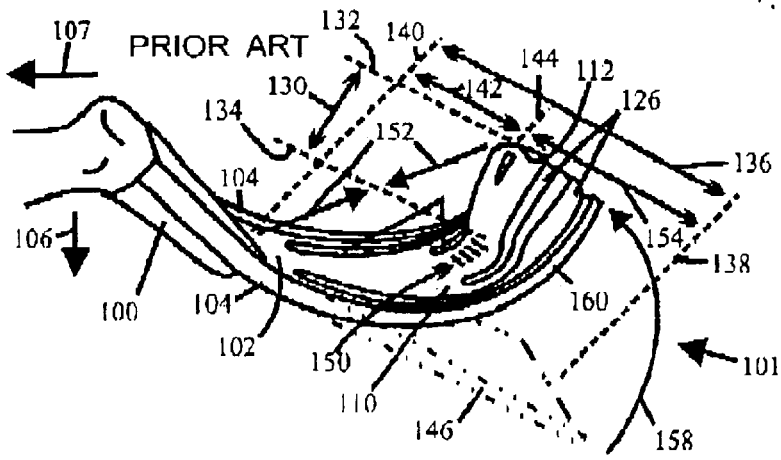

FIG. 4*d* shows the same prior art swim fin shown in FIG. 4*c* except the swim fin in FIG. 4*d* is seen to experience a greater deflection 158 around a transverse axis during use to a deflected position 160. Greater deflection 158 causes flexed blade length 142 be even closer to foot pocket 100 and further increases compression force 152. This causes blade 102 to collapse further and collapsing zone 150 is seen to move closer to forward edge 112. Depth of scoop 130 is extremely small in comparison to unflexed blade length 136 and therefore, the reduced size of the scoop shape is has reduced flow capacity and channeling capability. Thus, the scoop design experiences increased structural failure and collapse as the degree of deflection is increased. If the deflection is great enough to permit blade 102 to be angled in a manner that can deflect water in the opposite direction of travel direction 107, then compression force 152 causes blade 102 to collapse so that it cannot efficiently form a scoop shape.

Furthermore, if blade 102 is made with a relatively rigid material, then blade 102 will resist bending around a small bending radius required at collapsing zone 150. This can cause collapsing zone 150 to be distributed over a larger longitudinal region of blade 102 so that length of scoop 130 is much smaller than shown in FIG. 4*d*, or even disappears completely so that no significant amount of scoop is formed within blade 102. In addition, or alternatively, bending resistance within blade 102 at collapsing zone 150 and, or stress forces within blade 102 that oppose compression force 152 can prevent blade 102 from deflecting to greater deflection 158 and such internal stress forces within blade 102 can force blade 102 and stiffening members 104 to not exceed deflection 156 in FIG. 4*c*, or even deflection 145 in FIG. 4*b*. Thus, even if stiffening members 104 are made more flexible and, or the strength of the kicking force in kick stroke direction 106 is increased, internal stress forces within blade 102 that resist compression as well as bending around a small bending radius can prevent blade 102 can inhibit or even prevent blade 102 from achieving efficient blade deflection angles during use. Furthermore, the concentration of compression force 152 at collapsing zone 150 tends to cause a reverse scoop shape that creates a convex bulge where a convex channel was intended. This reduces channeling capability, propulsion and efficiency. Furthermore, observation of FIGS. 4*a* to 4*d* shows that the first half of blade 102 is either oriented in a manner that pushes water downward in kick direction 106, which will not create efficient propulsion in the direction of travel direction 107. In addition, the angled orientation of the first half of blade 102 can even push water at an angle that is in the same direction as travel direction 107, thereby creating a propulsive force that can push the swimmer in the opposite direction as travel direction 107 to further reduce efficiency of the swim fin.

Figure 5:
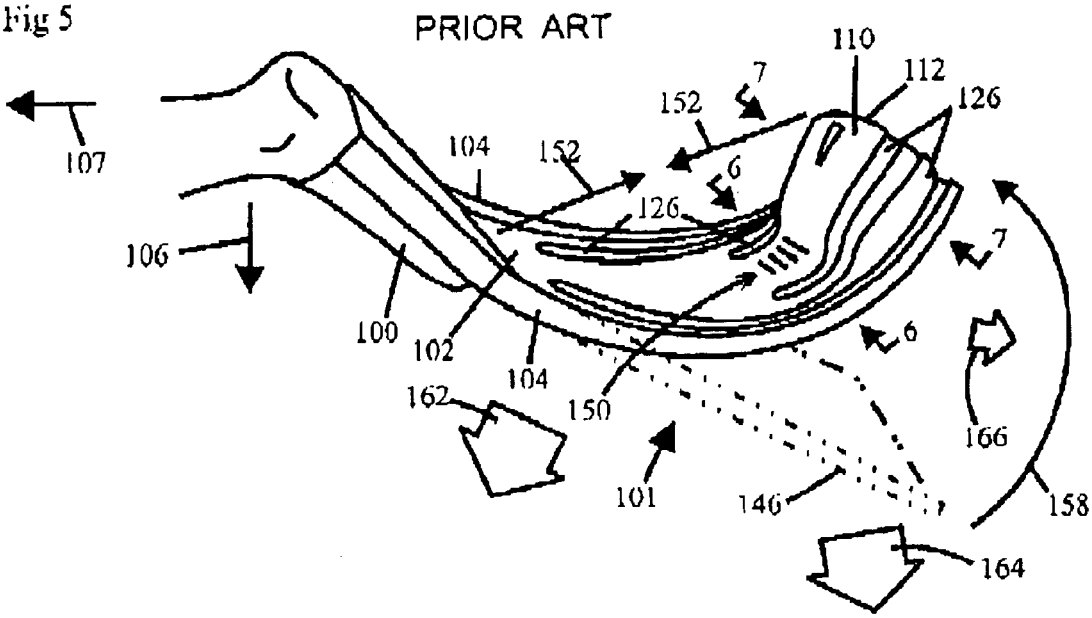
Fig 5 PRIOR ART
FIG. 5 shows the same prior art swim fin shown in FIG. 4*d*.

FIG. 5 shows the same prior art swim fin shown in FIG. 4*d*. A backward inclined flow 162 is shown by a large arrow below blade region 101 to show that the alignment of blade region 101 is inclined in a manner that pushes water in the wrong direction required for propulsion in travel direction 107. A downward flow 162 shows that much of the water around blade region 101 is pushed downward in kick direction 106 and does not assist with propelling the swimmer in direction 107. A downward propulsive flow 164 is shown by a small arrow that indicates that some of the water near forward edge 112 of blade 102 is directed in a downward direction that is inclined to provide a component force that can assist toward propelling in travel direction 107. Downward propulsive flow 166 is relatively small in comparison to flow 162 and flow 164. A propulsive flow 168 is shown by a small arrow behind forward edge 112. Only a small amount of water is moved in the direction of propulsive flow 168 and propulsion is inefficient. Again, compression force 152 causes blade 102 to buckle and collapse at collapsing zone 150 to prevent a major portion of blade 102 from forming a scoop shape during deflection 158.

Figure 6:
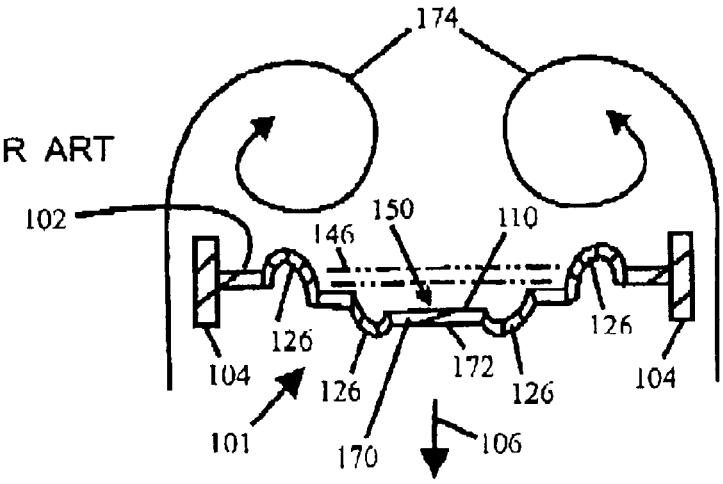
Fig 6 PRIOR ART
FIG. 6 shows a cross section view taken along the line 6—6 in FIG. 5.

FIG. 6 shows a cross section view taken along the line 6—6 in FIG. 5. The cross section view of FIG. 6 shows that blade 102 has moved from neutral position 146 to a flexed position 170 as blade 102 collapses at collapsing zone 150. Blade 102 is seen to have a high pressure surface 172 relative to kick direction 106. Flexed position 170 causes high pressure surface 172 of blade 102 to experience a convex curvature between stiffening members 104. This convex curvature reduces the channeling capability of blade region 101 and encourages water to flow in an outward sideways direction along high pressure surface 172. The intended scoop shape is not formed and instead blade 102 buckles in the opposite direction as intended to reduce efficiency. The high angle of attack as well as the lack of a scoop shape cause strong induced drag vortices 174 to form above low pressure surface 110. Vortices 174 can reduce efficiency from transitional flow, flow separation drag, and induced drag while also reducing lifting forces by reducing smooth flow conditions and creating stall conditions along low pressure surface 110.

Figure 7:
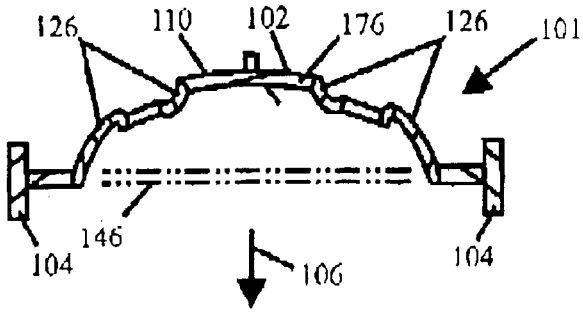
Fig 7 PRIOR ART
FIG. 7 shows a cross section view taken along the line 7—7 in FIG. 5.

FIG. 7 shows a cross section view taken along the line 7—7 in FIG. 5. Blade 102 is seen to have flexed from neutral position 146 to a bowed position 176 to form a scooped shape; however, this portion of blade 102 only represents a small portion of the overall surface area of blade 102 as seen in FIG. 5. Looking back at FIG. 5, it can be seen that a major portion of blade 102 does not form a scoop shape and instead buckles under compression force 152 and experiences structural collapse for reduced efficiency.

Figure 8:
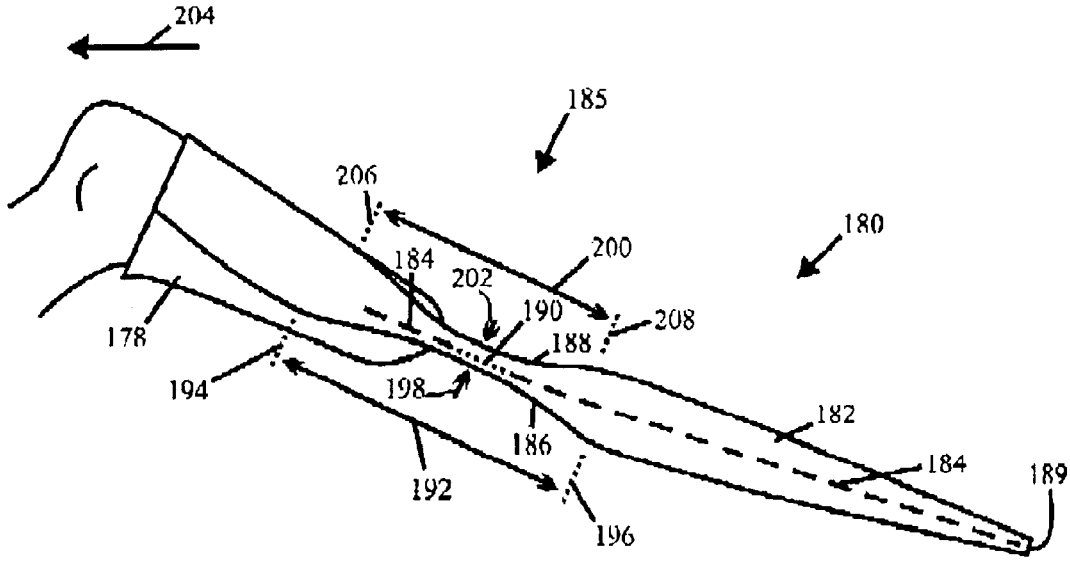
FIG. 8 shows a side view of a swim fin.

FIG. 8 shows a side view of a preferred embodiment swim fin of the present invention while at rest. The swim fin has a foot pocket 178 and a blade region 180. Blade region 180 includes at least one stiffening member 182. A blade 184 is shown by a dotted line since this embodiment places stiffening member 182 at the outer side edge of blade region 180 and therefore blade 184 is behind stiffening member 182. In alternate embodiments, stiffening member 182 can be located at any portion of blade region 180. A pivoting blade region 185 is seen to be located between blade region 180 and foot pocket 178. In this embodiment, pivoting blade region 185 includes an upper surface notch 186 and a lower surface notch 188 formed within stiffening member 182. Notches 186 and 188 are used as a method to provide a region of increased flexibility within blade region 180 adjacent to foot pocket 178 and as a method to permit blade region 180 to pivot around a transverse axis to a reduced angle of attack during use. Notches 186 and 188 form a reduction in thickness along stiffening member 182 adjacent foot pocket 178. Any method or structure for creating a region of increased flexibility within blade region 180 adjacent to foot pocket 100 may be used. Any method or structure that can be used to permit blade region 178 to pivot around a transverse axis to a reduced angle of attack may be used as well. This includes using no concentrated reduction in thickness within stiffening member 182 and providing a low degree of taper or no taper along stiffening member 182 between foot pocket 178 and a free end 189 of blade region 180.

Adjacent to notches 186 and 188 is a flexible blade region 190 disposed within blade 182. In this embodiment, flexible blade region 190 is located near the central portion of notches 186 and 188; however, flexible blade region 190 may be located in a manner that is off-center, forward, behind, near, or far away from notches 186 and 188. Preferably, flexible blade region 190 is located relatively close to foot pocket 178. Upper surface notch 186 is seen to have a notch length 192 between a originating end 194 and a forward end 196. In this embodiment, ends 194 and 196 are both convexly curved while notch 186 is concavely curved. Convex curvature at ends 194 and 196 can improve the distribution of stress forces within stiffening member 182 to reduce the chances of material fatigue and reduction of elastomeric properties of stiffening member 182 during use. This can increase the long term performance and reliability of stiffening member 182. The larger such radius of curvature, the greater the distribution of stress forces over a larger amount of material. Also, the use of smoothly curved transitions at ends 194 and 196 can reduce the chances for abrasion to skin or diving equipment and can also reduced chances of the fin catching on or being cut by a passing object. In alternate embodiments, ends 194 and 196 may have any desired shape including sharp angles, convex curvature, and faceted shapes. Preferably, notch length 192 is sufficiently long enough to prevent the build up of excessive strain forces on the material of stiffening member 182 during use. Notch 186 is seen to have a notch depth 198 that is significantly smaller than notch length 192. This is done to distribute strain forces within stiffening member 182 over a sufficiently large enough area to prevent the material of stiffening member 182 from reaching a yielding point that can cause such material to fatigue, weaken, crack, tear or lose elastomeric memory. Preferably, the ratio of notch length 192 to notch depth 198 is a ratio of approximately 4 to 1 or greater to improve distribution of stress forces. Such a ratio may be approximately 3 to 1 when notch 186 is arched without any significantly long straight segments while at rest. Continuous curvature permits larger radius of curvature to be used for notch 186 so that strain forces are distributed more evenly. Larger ratios of notch length 192 to notch depth 198 may include ratios of 5 to 1, 6 to 1, 7 to 1, 8 to 1, 9 to 1, 10 to 1, or greater than 10 to 1. Preferably, the material of stiffening member 182 is a thermoplastic material having some elastomeric memory. Materials such as thermoplastics, EVA, polypropylene, thermoplastic rubber, composite materials, Pebax, polyurethanes, natural rubber, thermoplastic elastomers, or other suitable materials may be used. Preferably, high memory materials are used which have a high modulus of elasticity are used. The larger radius of curvature of notch 186 and the larger ratios of notch length 196 to notch depth 198 within blade region 180 permit high performance results to occur with less expensive materials for major improvements in production costs. The greater distribution of stress forces allow inexpensive materials such as EVA to be used for notch 186 and pivoting blade region 185 without the need for a separate load bearing structure or stopping device being needed to take load and strain off notch 186. These methods for improving in strain distribution also greatly decrease the chances for structural failure and loss of performance due to material fatigue. This is a major advantage for improved performance and reliability as well as huge reductions in production costs due to savings of material cost of several hundred percent by reducing the strain requirements of the material.

Notch 188 is seen to have a notch length 200 and a notch depth 202. It is preferred that the ratio of notch length 200 and notch depth 202 are sufficient to increase the distribution of strain forces in an amount that can reduce the chances of material yielding, fatigue or breakage over time. For this reason, the design of notch 188 should employ the same methods described above for notch 186. In this embodiment, notch length 200 of notch 188 is seen to be smaller than notch length 192 of notch 186. In addition, notch depth 202 of notch 188 is seen to be smaller than notch depth 198 of notch 186. This permits pivoting blade region 185 to experience different amounts of deflection on opposing kicking stroke directions. When the kick stroke direction is such that notch 186 is moving downward, the greater size of notch 186 will allow blade region 180 to experience a large degree of deflection. When the kick direction is such that notch 188 is moving upward, the reduced size of notch 188 will cause blade region 180 to experience a smaller amount of deflection. This allows blade region 180 to achieve varied levels of deflection which compensates for the angled orientation of a swimmers foot and ankle during down strokes and up stokes so that propulsion and efficiency is maximized. In alternate embodiments, notches 186 and 188 may be symmetrical, equal in size, off-set from each other, off center from each other, off axis from each other, or any variation in size or shape from each other. In alternate embodiments, notch 186 can be made smaller, shallower, shorter, more curved, less curved, thicker or thinner (transversely) than notch 186.

In the current embodiment, notch 186 is closer to the plane of blade 182 than notch 188. This permits pivoting blade region 185 to experience different degrees of deflection during different kick stroke directions. This again is to compensate for the angle of the swimmers foot relative to an intended direction of travel 204. In alternate embodiments, the proximity of each notch to the plane of blade 182 may be reversed, made symmetrical or may be of any distance or combinations of distances.

Notch length 200 extends between an originating notch end 206 and an outer notch end 208. Notch ends 206, 208, 194 or 196 may exist along any portion of stiffening member 182. In addition, notch ends 208 and, or 196 may have such a large radius of curvature that the exact end of notch 186 or 188 is not perceivable, but instead is a general region.

Figure 9:
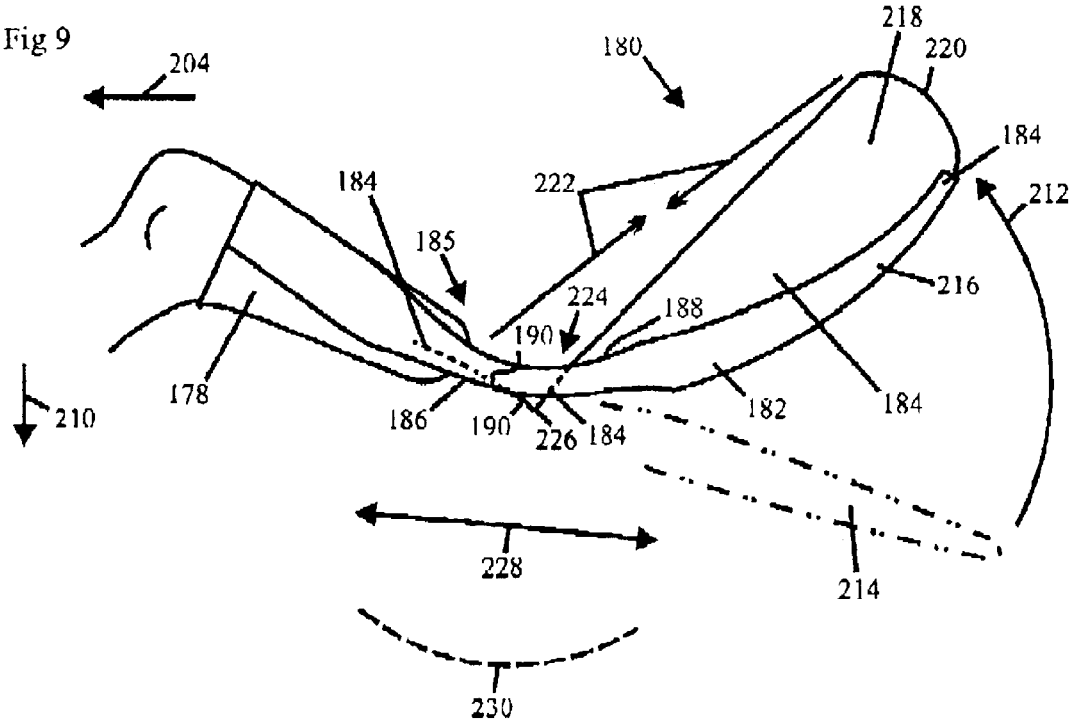
FIG. 9 shows a side view of the swim fin of FIG. 8 during use.

FIG. 9 shows a side view of the swim fin of FIG. 8 during use. In FIG. 9, the swim fin is being kicked in a kick direction 210 in an effort to create propulsion in the direction of intended travel direction 204. Blade region 180 is seen to experience a predetermined deflection 212 from a neutral position 214 to a deflected position 216. Blade 184 is seen to have a lower surface 218 (which is a low pressure surface during kick direction 210) and a forward edge 220. Predetermined deflection 212 causes a compression force 222 to be exerted on blade 184. Because the methods of the present invention uses a flexible portion 190 near foot pocket 178 while the portions of blade 184 between flexible portion 190 and forward edge 220 are more rigid than flexible portion 190, flexible portion 190 permits blade 184 to buckle on purpose under the exertion of compression force 222 at a collapsing zone 224 strategically created by the increased flexibility provided by flexible portion 190. The increased flexibility within blade 184 at portion 190 permits flexible portion 190 to deflect downward in the direction of kick direction 210 and below the plane of blade 184 that exists a rest. The downward deflection of flexible portion 190 allows compression force 222 to be exerted on flexible portion 190 rather than on blade 184. Thus, providing a significantly deformable flexible portion 190 within blade 184 near foot pocket 178 is an efficient method for alleviating longitudinal compression forces within blade region 180 during predetermined deflection 212 so that blade 184 is able to form a significantly large scoop shape having a significantly large longitudinal dimension between foot pocket 178 and forward edge 220. In this embodiment, the downward deflection of flexible portion 190 is significantly high; however, in alternate embodiments any degree of downward deflection can occur as well as no downward deflection at all. Flexible portion 190 is seen to be able to bend around a blade bending radius 226. In this embodiment, bending radius 226 is significantly small; however bending radius 226 may be of any size. Preferably, bending radius 226 is sufficiently small to increase the amount of blade 184 that is able to form a scoop shape.

The portion of blade 184 located between radius 226 and forward edge 220 is able to form a large scoop shape. The back side of the scoop shape is seen to be significantly straight. This is because the portion of blade 184 between radius 226 and forward edge 220 is significantly less flexible than flexible portion 190. This prevents blade 184 from collapsing during use and focuses the majority of compression force 222 on flexible portion 190 so that blade region 180 collapses or buckles at flexible portion 190. Preferably, blade 184 is thicker and, or stiffer than flexible portion 190. Any method for creating a difference in stiffness between blade 184 and flexible portion 190 may be used. This includes having flexible portion 190 be a region of reduced material or reduced material thickness within blade 184 and made with the same material as that used for blade 184. Also, flexible portion 190 may also be a region having no material that forms an opening in blade 184. Flexible portion 190 may also be made with a different material than blade 184 and such a different material could be connected to blade 184 in any suitable manner. Flexible portion 190 could be made with a relatively soft thermoplastic material and blade 184 could be made with a relatively stiffer thermoplastic material and the relatively soft thermoplastic material could be connected to the relatively stiffer thermoplastic material with a chemical bond, a mechanical bond, a thermo-chemical bond, thermal-chemical adhesion, or any suitable bond. Preferably, such a flexible thermoplastic material could be connected to the stiffer thermoplastic material with a thermo-chemical bond created during a phase of an injection molding process. In other embodiments, blade 184 could be made of a significantly flexible material and could include one or more longitudinal stiffening members connected to blade 184, which extend from forward edge 220 and terminate (or experience a reduction in thickness) adjacent radius 226 and such stiffening members would be arranged to prevent blade 184 from collapsing between radius 226 and forward edge 220 while the absence of such stiffening members adjacent radius 226 permits the highly flexible material of blade 184 to collapse or buckle adjacent to radius 26 to create a similar effect. Any method that can focus compression force 222 near foot pocket 178 so that a major portion of blade 184 is able to form a scoop shape during predetermined deflection 212 may be used.

In FIG. 9, the material within stiffening member 182 adjacent notch 186 is forced to stretch or elongate in a longitudinal elongation direction 228. Longitudinal elongation direction 228 is shown by a double ended arrow that illustrates the direction that the material along the surface of notch 186 must elongate during predetermined deflection 212. A flexed stiffening member center line 230 is a dotted line below elongation direction 228. Flexed stiffening member center line 230 shows the curvature along the center of stiffening member 182 at pivoting blade region 185. Flexed stiffening member center line 230 shows the average degree of bending occurring within stiffening member 182 at pivoting blade region 185. This shows that longitudinal elongation direction 228 is much straighter and longitudinally oriented than flexed stiffening member center line 230. This is because the shape of notch 186 is arranged to have a concave shape at rest and bend to a significantly straighter alignment during predetermined deflection 212. This is done to permit the elongation within the material adjacent the surface of notch 186 to elongate along a substantially straight path (or at least a less concavely curved path) so elongation direction 228 is directed at an increased angle to the direction of predetermined deflection 212. By directing elongation of the material adjacent to notch 186 along a path that is less convexly curved than the flexed stiffening member center line 230, the snap back energy stored in the elongated material can act as a moment force to apply increased leverage at the end of a kicking stroke so that blade region 180 is able to snap back from deflected position 216 to neutral position 214 with increased speed and efficiency. When this is combined with notch 186 having a relatively large ratio of notch length to notch depth that is at least 3 to 1, at least 4 to 1, or greater than 5 to 1, snap back energy is increased while excess strain to the material is avoided. This provides greater propulsion efficiency and increased structural reliability. Preferably, notch 186 is concavely curved at rest and is convexly curved during use. When lower durometer materials are used within stiffening member 182, notch 186 can be concavely curved at rest and less concavely curved during a large deflection. This is because lower durometer materials will require a relatively taller vertical dimension for stiffening member 182 and notch 186 can have a smaller notch depth for a given notch length. Since higher durometer materials will require a relatively smaller vertical dimension for stiffening member 182, notch 186 can transform from a concave shape at rest to a less concavely curved shape, a substantially straight shape, a slightly convex curved shape or a significantly large convex shape during a large deflection of blade region 180. It is preferred that the shape of notch 186 is less convexly curved than flexed stiffening member center line 230 during a large scale deflection such as predetermined deflection 212 to increase snap back energy at the end of a kicking stroke. Such an increase in snap back energy and speed can greatly reduce the occurrence of lost motion during the inversion phase of a reciprocating kicking stroke cycle. This can greatly increase the propulsion speed and efficiency of the swim fin. When this is combined with a large scoop shape made possible by a strategic collapsing of blade region 180 at flexible blade region 190, both channeling capabilities, blade deflection capabilities, and snap back properties are increased significantly for major improvements in propulsion speed and efficiency. Because pivoting blade region 185 is located significantly close to foot pocket 178, predetermined deflection 212 occurs along a major portion of the length of blade region 180. Flexible portion 190 enables blade region 180 to fold in a controlled manner near foot pocket 178 under the exertion of compression force 222 so that a major portion of blade 184 is able to form a large scoop shape for channeling large volumes of water. The elongation of the material along notch 186 is arranged to stretch and store energy that may be returned in a significantly strong snapping motion that returns blade region 180 from deflected position 216 toward neutral position 214 at the end of a kicking stroke so that lost motion is significantly reduced. The increased longitudinal alignment of longitudinal elongation direction 228 in comparison to flexed stiffening member center line 230, provides increased snap back efficiency and reliability. The large ration of notch length to notch depth also provides savings in production costs since this configuration significantly reduces stress and strain within the material used for stiffening member 182 in an amount sufficient to permit relatively inexpensive materials to be used within stiffening member 182 since the stress load is distributed over an increased area to prevent or reduce stress forces from exceeding the yielding point or weakening point of the selected material. Material composition selection is increased dramatically.

When the stroke direction is reversed, notch 188 is arranged to function in a similar manner to notch 186 illustrated in FIG. 9. In alternate embodiments, notches 186 and 188 may be "half-notches" or tapered regions of stiffening member 182 which only taper and do not curve back up to form a full notch.

Figure 10:
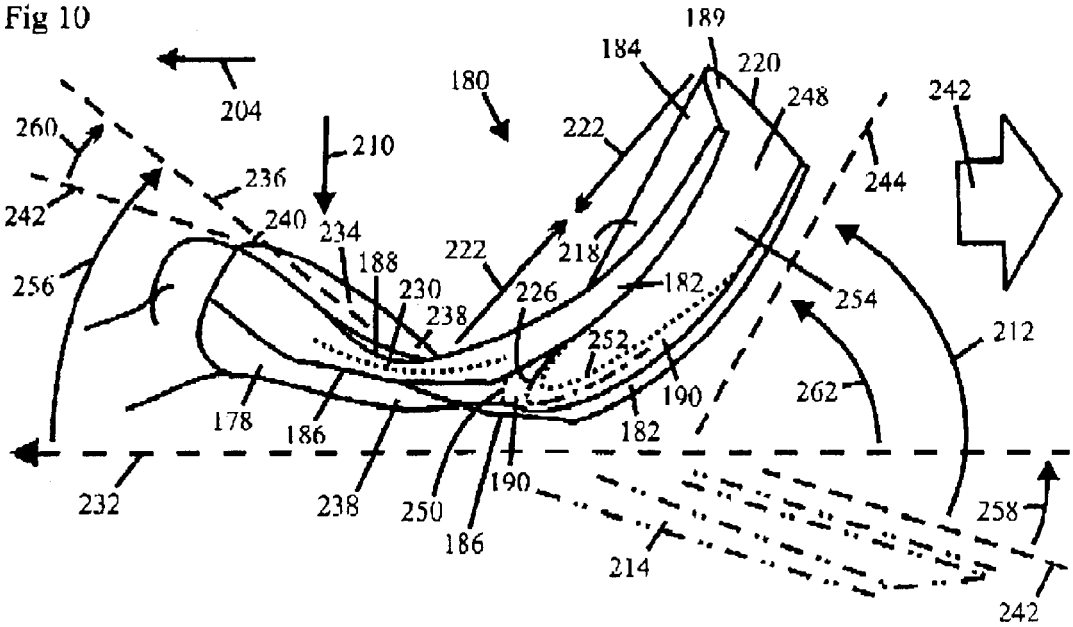
FIG. 10 shows a side perspective view of the swim fin of FIG. 9 during use.

FIG. 10 shows a perspective side view of the swim fin of FIG. 9 during use. In FIG. 10, a direction of travel reference line 232 is located below the swim fin and is parallel to direction of travel 204. Foot pocket 178 has a sole 234 and a foot pocket alignment reference line 236 is parallel to the alignment of sole 234 between a toe portion 238 and a heel portion 240 of sole 234. A neutral blade position reference line 242 is parallel to the alignment of neutral position 214. Neutral blade position reference line 242 shows the angle of blade region 180 at rest and is displayed next to both neutral position 214 and reference line 236 for comparison purposes. Blade region 180 is experiencing predetermined deflection 212 to deflected position 216. A scoop alignment reference line 244 is displayed by a dotted line that is parallel to the back of the scooped portion of blade 184 to show the alignment of the back portion of the scoop shape during predetermined deflection 212. Scoop alignment 244 is seen to be angled to permit a significant amount of water to be pushed in propulsion flow direction 246, which is displayed by a large arrow that is oppositely directed to direction of travel 204. Blade 184 is seen to have an upper surface 248, which is a high pressure surface during stroke direction 210. In this embodiment, flexible portion 190 is seen to be arched or U-shaped; however flexible portion 190 may be formed in any shape whatsoever. The arched configuration of flexible portion 190 in this embodiment is arranged to cause blade bending radius 226 to bend around an arched path. This creates a tapered scoop shape within blade 184 adjacent to flexible portion 190. Flexible portion 190 has an originating end 250 and a forward end 252. In this embodiment, both ends 250 and 252 are concavely curved toward free end 189; however, in alternate embodiments, end 250 and, or end 252 may be straight, less curved, more curved, convexly curved, or any other shape. Similarly, in alternate embodiments, radius 226 may be straight, convex curved, concave curved, or may have any other shape. The arched shape shown in FIG. 10 is an example of an efficient shape that permits the contour of a deep long scoop shape to intersect the plane of blade 184 existing between stiffening members 182.

Flexible portion 190 is seen to bulge downward below the plane of blade 184 adjacent to radius 226. This permits blade region 180 to move downward under the stress of compression force 222 so that a majority of blade 184 may form a large scoop while forward edge 220 moves closer to toe portion 238 of foot pocket 178 during predetermined deflection 212. In addition, the increased flexibility of flexible portion 190 permits blade bending radius 226 to bend around a significantly small radius with reduced bending resistance so that blade region 180 can strategically buckle or fold in one small zone located close to toe portion 238. Because bending resistance around radius 226 is significantly low within flexible portion 190, and because the portion of blade 184 between flexible portion 190 and forward edge 220 is significantly less flexible than flexible portion 190, a scooped blade region 254 is able to form between flexible portion 190 and forward edge 220. Preferably, blade 184 is sufficiently rigid within scooped blade region 254 to prevent scooped blade region 254 from collapsing under the exertion of compression force 222 during predetermined deflection 212. In addition, it is preferred that flexible portion 190 is sufficiently flexible to reduce the exertion of compression force 222 on scooped blade portion 254 to prevent scooped blade portion 254 from collapsing or buckling during predetermined deflection 212.

In FIG. 10, a foot alignment angle 256 exists between foot pocket alignment reference line 236 and direction of travel reference line 232. Angle 256 is due to the angled alignment of the foot relative to the lower leg of the swimmer as well as the angle of the swimmer's lower leg relative to line 232. When the ankle is fully extended, there remains a significant angle between line 236 and the swimmer's lower leg.

A neutral travel direction blade angle 258 exists between neutral blade position reference line 242 and direction of travel reference line 232. In this embodiment, neutral travel direction blade angle 258 is less than foot alignment angle 256. In other embodiments, neutral travel direction blade angle 258 can be made larger, smaller or can also be zero. Neutral travel direction blade angle 258 is significantly determined by a neutral blade angle 260 existing between foot pocket alignment reference line 236 and neutral blade position reference line 242. Neutral blade angle 260 is preferably between 15 and 35 degrees. Particularly good results occur when angle 260 is between 20 and 30 degrees so that travel direction blade angle 258 relative to direction of travel reference line 232 is zero or close to zero. In alternate embodiments, blade angle 260 may be larger, smaller or even zero.

A predetermined blade alignment 262 exists between scoop alignment reference line 244 and travel direction reference line 232. Predetermined blade alignment 262 is preferably between 20 degrees and 60 degrees. Preferably, predetermined blade alignment 262 is arranged to be approximately 40 to 50 degrees FIG. 10 shows that predetermined deflection 212 is the combination of neutral travel direction blade angle 258 and predetermined blade alignment 262. If neutral travel direction blade angle 258 is made smaller by increasing the size of neutral blade angle 260, then the positive difference between predetermined deflection 212 and predetermined blade alignment 262 will be reduced or even eliminated. Preferably, predetermined blade alignment 262 is arranged to be between 20 and 80 degrees relative to direction of travel reference line 232. Excellent results can be achieved when predetermined blade alignment 262 is arranged to be between 40 and 70 degrees. The larger the angle of predetermined blade alignment 262 relative to direction of travel reference line 232, the lower the angle of attack of blade alignment 262 relative to kick direction 210. As a result, the preferred angles of blade alignment 262 can be easily converted into angles of attack by subtracting 90 degrees from the angle of alignment 262. Thus, it is preferred that the angle of attack of scoop alignment reference line 244 is between 70 and 10 degrees, with excellent results being achieved between 60 and 20 degrees.

For a given neutral travel direction blade angle 258, angle of attack 262 and predetermined deflection 212 can be achieved by adjusting the flexibility of pivoting blade region 185. This can be achieved by changing the stiffness, flexibility, modulus of elasticity, material compound, number of materials or combination of materials used to make stiffening members 182. This can also be achieved by adjusting the volume of material within stiffening members 182. The vertical height, transverse width, number of stiffening members 182, and cross sectional shape of stiffening members 182 adjacent pivoting blade region 185 may be adjusted to increase or decrease flexibility. The length to depth ratio of notches 186 and 188 may be adjusted to increase or decrease flexibility. In the embodiment shown in FIG. 10, it is preferred\that pivoting blade region 185 experiences a significant increase in bending resistance if blade region 180 is forced to deflected beyond predetermined deflection 212. Such an increase in bending resistance may be created by matching the elongation capabilities of the material within notch 186 with the elongation requirements created by the radius of curvature of pivoting blade region 185 during deflection 212. In addition, the notch length of notches 186 and 188 maybe adjusted to create a predetermined bending radius within pivoting blade region 185 in comparison to the vertical dimension of stiffening members 182 to force a tension surface portion of notch 186 to experience a predetermined amount of elongation that allows blade region 180 to pivot to predetermined deflection 212 during a light to moderately strong kicking stroke and experience a significant increase in resistance to further elongation beyond such a predetermined amount of elongation during a hard kicking stroke which attempts to deflect blade region 180 beyond such a predetermined deflection 212. In addition, the material within stiffening members 182 may be adjusted to permit a predetermined amount of compression to occur within a compression surface portion of notch 188 during deflection 212, and when such a predetermined amount of compression is attempted to be exceeded by a further increase in load such as during a hard kicking stroke, the material can be arranged to experience an exponential increase in resistance to further compression beyond such a predetermined compression range which in turn creates an exponential increase in bending resistance within stiffening member 182 by creating a proportionally large increase in the elongation of a tension surface portion of notch 186 during a hard kicking stroke that attempts to deflect blade region 180 beyond predetermined deflection 212. Elongation ranges and compression ranges can be combined with structural dimensions and a predetermined bending radius to create increased energy storage for increased snap back return at the end of a stroke, as well as to create large scale blade deflections under low load and to permit such large scale blade deflections to be significantly limited during increases in load.

In order to increase energy storage within pivoting blade region 185, it is preferred that a load bearing tension surface portion of pivoting blade region 185 experiences a predetermined elongation range of at least 2% during deflection 212. Preferably, such a predetermined elastic elongation range is significantly higher to promote more energy storage and return. Preferably, such a predetermined elongation range should be between 10% and 20% or greater during a hard kicking stroke. It is preferred, but not necessary, that the material within a compression surface portion of notch 188 during predetermined deflection 212 is arranged to experience an compression range of at least 1% during deflection 212. Compression ranges between 5 and 10 percent or more can produce excellent levels of non-linear stress to strain curves within the material of notch 188, which can produce significantly large exponential increases in bending resistance within pivoting blade region 185. Preferably, the load bearing material of pivoting blade region 185 is made with a highly elastic material capable of storing energy during deflection 212 and providing an efficient and energy returning snap back from deflected position 216 toward neutral position 214 at the end of a kicking stroke. In alternate embodiments, such load bearing material can be formed within the material of blade 184 rather than in stiffening members 182.

Figure 11:
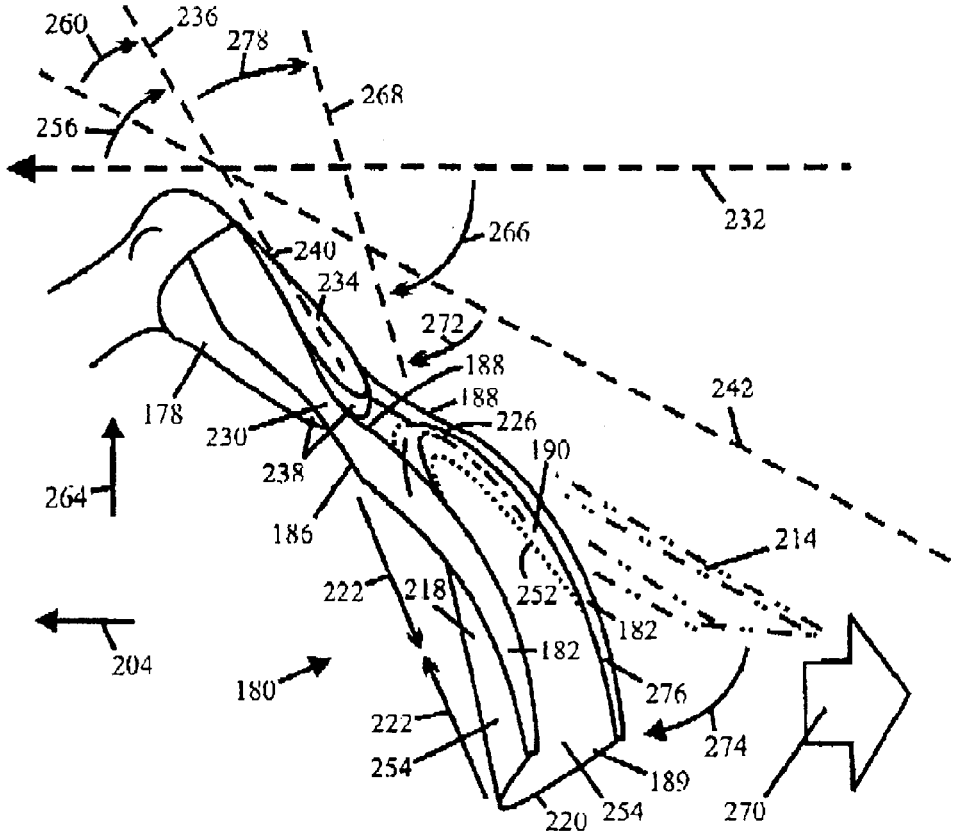
FIG. 11 shows a side perspective view of the swim fin of FIG. 10 during an up stroke.

FIG. 11 shows a perspective side view of the swim fin of FIG. 10 during an up stroke which has a kick direction 264. In FIG. 11, foot pocket alignment reference line 236 is seen to be at an increased vertical orientation than shown in FIG. 10. In FIG. 11, this is caused by the swimmer rotating the ankle from an extended orientation shown in FIG. 10 during a down stroke having a kick direction 210, to a pivoted orientation in FIG. 11 in which the swimmer's foot approaches or reaches a perpendicular alignment to the swimmer's lower leg. This rotation of the swimmer's foot causes foot alignment angle 256 to reach a significantly steep angle between foot pocket alignment angle 236 and travel direction reference line 232. A predetermined scoop alignment 266 is seen to exist between travel direction reference line 232 and a scoop alignment reference line 268, which is parallel to the back portion of scooped blade portion 254. Predetermined scoop alignment 266 is seen to be sufficiently inclined relative to direction of travel 204 to permit a significantly large amount of water to be pushed in propulsion flow direction 270.

A scoop deflection angle 272 is seen between neutral blade position reference line 242 and scoop alignment reference line 268. Scoop deflection angle is largely determined by a predetermined deflection angle 274 between neutral blade position 214 and a deflected position 276. Predetermined deflection angle 274 is preferably much smaller than predetermined deflection angle 212 shown in FIG. 10; however, in alternate embodiments, predetermined deflection angle 274 can be slightly less than, similar to, equal to, or greater than deflection 212. This is because of the downward rotation of the swimmer's ankle that is shown in FIG. 11 during kick direction 264. Predetermined deflection angle 274 may be reduced by reducing the notch length and, or notch depth of notch 188. This will reduce the area over which elongation can occur within the material adjacent notch 188 during stroke direction 264. This concentrates stress forces within a smaller area and can cause increased resistance to bending away from neutral blade position 214 so that predetermined deflection angle 274 is significantly reduced. Also, if the flexibility of stiffening members 182 between pivoting blade region 185 and free end 189 is reduced, then predetermined deflection angle 274 will be reduced. This can be achieved by increasing the stiffness of the outer portions of stiffening members 182 in any suitable manner. This can include reducing the degree of taper, increasing cross sectional size, vertical dimension, transverse dimension, cross sectional volume, increasing material hardness, reducing the modulus of elasticity, adding additional stiffening members, adding stiffer materials to the outer portions of stiffening members 182 between pivoting blade region 185 and free end 189. Scoop deflection angle 266 may also be adjusted by increasing neutral blade angle 260 between foot pocket alignment reference line 236 and neutral blade position reference line 242. By increasing angle 260 between sole 234 and neutral blade position 214 during production or molding of the swim fin, predetermined scoop alignment 266 can be increased so that it is less than 90 degrees during kick direction 264. This will also reduce a scoop alignment angle 278 existing between scoop alignment reference line 268 and foot pocket alignment reference line 236. Scoop alignment angle 278 is preferably small since the rotation of the swimmer's ankle can cause foot pocket alignment angle 256 to approach or reach 90 degrees during a significant portion of an up stroke in kick direction 264.

Preferably, predetermined scoop alignment 266 is arranged to be between 30 and 90 degrees relative to direction of travel reference line 232. Excellent results can be achieved with predetermined scoop alignment 266 arranged to be between 45 and 80 degrees. Because the swimmer's leg and ankle may rotate to various angles during various portions of the kicking stroke, it is preferred that the swim fin is arranged to permit predetermined scoop alignment 266 to be at desired angles during at least one portion of a kicking stroke, and preferably during a significantly large phase of a kicking stroke. Preferably, predetermined scoop alignment 266 is sufficient to push a significantly large amount of water in propulsion flow direction 246. The larger the angle of predetermined scoop alignment 266 relative to direction of travel reference line 232, the lower the angle of attack of scoop alignment reference line 268 relative to kick direction 264. As a result, the preferred angles of predetermined scoop alignment 266 can be easily converted into actual angles of attack by subtracting 90 degrees from the angle of alignment 266. Thus, it is preferred that the angle of attack of scoop alignment reference line 268 is between 70 and 10 degrees, with excellent results being achieved between 60 and 20 degrees. Reduced angles of attack can be used to reduce flow separation and turbulence along lower surface 218 for reduced drag while also allowing scooped blade portion 254 to push an increased amount of water in propulsion flow direction 270. It is preferred that once scooped blade portion 254 achieves a predetermined reduced angle of attack capable of increasing performance, a suitable method is used for reducing or stopping further deflection of scooped blade portion 254 and, or stiffening members 182 and, or pivoting blade portion 185. It is also preferred that this occurs on both the up stroke and the down stroke portions of a reciprocating kicking stroke cycle. Any suitable stopping device or method may be used. This can include the use of extensible deflection limiting elements, converging stops or blocks, thermoplastic ties, permanent or removable chords, blade inserts, battens, ribs, springs, leaf springs, expandable elements, expandable members, expandable ribs, converging notches, elongation limits within load bearing material, compression limits within load bearing material, or any other suitable stopping device or method.

When comparing the prior art swim fin in FIG. 4*d* to the improved swim fin in FIGS. 8 to 11, it can be seen that methods of the present invention greatly increase the size of a scooped blade shape, provide a strategic flex zone within blade 184 to compensate for compression force 222 so that scooped blade portion 254 does not collapse under compression force 222, and significantly improve the channeling capability and water flow capacity of a scooped blade shape.

FIGS. 12*a* to 12*d* show various orientations of the swim fin shown in FIGS. 9 to 11 during various portions of a reciprocating kick cycle. In FIG. 12*a*, stiffening members 182 do not have any notches at pivoting blade region 185 of blade region 180. Instead, the portions of stiffening members 182 are arranged to be flexible adjacent toe portion 238 of foot pocket 178 to permit blade region 180 to pivot around a transverse axis to a lengthwise reduced angle of attack during use. Stiffening members 182 may employ any suitable method for permitting pivoting blade region 185 to pivot around a transverse axis near toe portion 238. This may include using a more flexible material within stiffening members 182 adjacent pivoting blade region 185. This may also include providing the outer portions of stiffening members 182 near free end 189 with increased stiffness, which may be accomplished in any suitable manner, including but not limited to using additional stiffening members or ribs in the outer half of blade region 180 near free end 189, using reduced amounts of taper within stiffening members 182, using increased cross sectional dimension within the outer half or outer portions of stiffening members 182, using stiffer materials within the outer portions of stiffening members 182, as well as any other suitable method which permits blade region 180 to pivot around a transverse axis near foot pocket 178. Foot pocket 178 and sole 234 may also be made sufficiently flexible to permit foot pocket 178 and sole 234 to flex around a transverse axis during use so that pivoting blade region 185 begins behind toe portion 234 and along foot pocket 178.

The embodiment in FIGS. 12*a* to 12*d* shows that in addition to blade region 180 having a flexible blade region 190, there is also an additional flexible region 280 having an origination portion 282 and an outer portion 284. Additional flexible region 280 may be constructed in any suitable manner. Additional flexible region 280 may be formed using any of the alternate methods described above for forming flexible blade region 190. In this embodiment, additional flexible region 280 is arranged to be less flexible than flexible blade region 190 so that additional flexible region 280 has minimal deformation or no deformation when the swim fin is kicked as shown in FIG. 12*a*. In alternate embodiments, additional flexible region 280 may have the same or greater flexibility than flexible blade region 190. In the embodiment shown, it is preferred that additional flexible region 280 is sufficiently less flexible than flexible blade region 190 to permit scooped blade portion 254 to have increased depth and length by focusing most or all of the longitudinal compression forces on blade region 180 to be focused on flexible portion 190 during high levels of deflection.

FIG. 12*b* shows that the swim fin is arranged to form an S-shaped wave along the length of blade region 180 during an inversion portion of a reciprocating kick stroke cycle as the down stroke displayed by kick direction 210 in FIG. 12*a* is reversed in FIG. 12*b* to an up stroke displayed by kick direction 264. The S-shaped wave form along blade region 180 in FIG. 12*b* shows that free end 189 is still moving downward in kick direction 210 while foot pocket 178 and the first half of blade region 180 is moving upward in kick direction 264. It is preferred that stiffening members 182 and blade 184 are sufficiently flexible to permit blade region 180 to form an S-shaped wave during an inversion portion of a reciprocating kicking stroke cycle. During the formation of the S-shaped wave, the first half of blade region 180 near foot pocket 178 is moving in the opposite direction of the outer half of blade region that is closer to free end 189 and therefore, the first half lower surface 218 is a high pressure surface or an attacking surface. This causes the scoop shape along the first half of blade region 182 to disappear or even begin to invert. Meanwhile, the outer portion of upper surface 248 near forward edge 220 is moving downward and is therefore a high pressure surface or attacking surface. Because additional flexible region 280 is more flexible than the portions of blade 184 existing between additional flexible region 280 and forward edge 220, blade 184 is able to strategically fold or buckle adjacent additional flexible region 280 so that scooped blade portion 254 is able to form adjacent free end 189 during the undulation of the S-shaped wave. Scooped blade portion is seen to move from an original scoop position 286 to a forward scoop position 288 to show the occurrence of a scoop forward movement 290. Additional flexible region 280 permits longitudinal compression forces to be relieved and focused so that scooped blade portion 254 is able to exist during an inversion portion of a stroke at a forward portion of blade 184 adjacent free end 189 so that channeling capabilities of blade 184 are increased. In addition, scoop forward movement 290 pushes water in the opposite direction of travel direction 204 for increased propulsion. The transition from original scoop position 286 to forward scoop position 288 during scoop forward movement 290 can occur in a fast snapping motion or in a more gradual and smooth transition. The portion of blade 184 between flexible portion 190 and additional flexible region 280 may be provided with increased flexibility to permit a smooth rolling transition, or may be provided with less flexibility to create a faster or more abrupt transition and forward movement.

Furthermore, the presence of additional flexible region 280 permits blade region 180 to form the S-shaped wave during the inversion portion of a stroke. This is because the relatively stiffer material within blade 184 that is arranged to not collapse during the stroke phase shown in FIG. 12*a* can reduce, dampen, or even prevent the S-shaped wave from efficiently forming during the inversion portion of the stroke. In alternate embodiments, additional flexible region 280 can be reduced or omitted entirely and blade 184 can be arranged to be sufficiently stiff to not collapse during the stroke phase shown in FIG. 12*a* and also be sufficiently flexible to permit the formation of an S-shaped wave during the inversion portion of a stroke. This can include providing blade 184 with a gradual change or transition in flexibility between flexible portion 190 and the portion of blade 184 that is forward of flexible portion 190. Such a transition may be created by a longitudinal change in the material of blade 184 or the thickness of blade 184 forward of flexible region 190. The arched shaped of flexible region 190 provides flexible side regions that extend in a substantially longitudinal direction to help provide a smooth transition between strokes and help to permit and S-shaped wave to form during the stroke inversion. In alternate embodiments, any number of longitudinal, angled, transverse, straight, or curved flexible zones may be added within blade 184 to further encourage the formation of an S-shaped wave. The method of encouraging the formation of an S-shaped wave can increase efficiency by permitting blade region 180 to efficiently generate propulsion during the inversion phase of a stoke so that lost motion is reduced or even eliminated as blade region 180 repositions for an opposing stroke direction. In the embodiment shown in FIGS. 12*a* to 12*d*, flexible blade region 280 is seen to have an arched shape and a substantially transverse alignment as well as a partially lengthwise alignment; however, any shape, contour, or form may be used to permit the S-shaped wave to form and, or to permit scooped shape 254 to exist adjacent the forward portion of blade region 180.

FIG. 12*c* shows that the forward portion of blade region 180 near free end 189 has inverted and is not moving in kick direction 264 together with foot pocket 178. Scooped blade portion 254 now extends across a major portion of the overall length of blade region 180. Again, in this example, additional flexible region 280 is made sufficiently less flexible than flexible portion 190 to significantly reduce or prevent scooped blade portion 254 from collapsing under the longitudinal compression forces exerted on blade region 180 during a high level of deflection.

In alternate embodiments, flexible portion 190 and, or additional flexible region 280 may be made more flexible on one stroke than on the opposing stroke. This can be achieved by creating a reduction in thickness existing on one surface of blade 184 only. The surface having the reduction in thickness will be more flexible when forming a convex curved bend and the surface having no reduction in thickness (no groove, trench, or cutout) will have more resistance to bending around a convex curve due to increased resistance to elongation. This can also be achieved by laminating two materials of different flexibility or extensibility, since the surface having a more flexible or extensible material will have less resistance to bending around a convex curve. This can be used to permit a particular flex zone to operate on one stroke direction and less, or not at all on the opposing stroke. This method of alternating any type of flexible region within the blade of a swim fin can be used to create different shapes or deflections during opposing strokes in order to compensate for the differences in the angled alignment of the swimmer's foot and the rotation of the swimmer's ankle during opposing strokes. This can also allow the S-shaped wave to form only during one inversion phase between kick directions and not during the opposing inversion phase. This can also permit different sizes, depths, alignments and angles of attack of a scoop shape to be formed during opposing strokes. By varying the depth of scoop and angle of attack of the scoop, the effective angle of attack of blade region 180 may be varied on each stroke to optimize efficiency and propulsion, as well as to adjust for different preferences in kicking styles, techniques and diving applications.

In FIG. 12*d*, the kick direction 264 shown in FIG. 12*c* has been reversed to kick direction 210 to create an S-shaped wave during this inversion portion of the kick cycle. In FIG. 12*d*, the forward portion of blade region 180 near free end 189 is still moving in kick direction 262. Scooped blade portion 254 has experienced a scoop forward movement 292 from an original scoop position 294 to a forward scoop position 296. This is occurring in a similar manner as shown in FIG. 12*b*; however the S-shaped wave is inverted.

Figure 13:
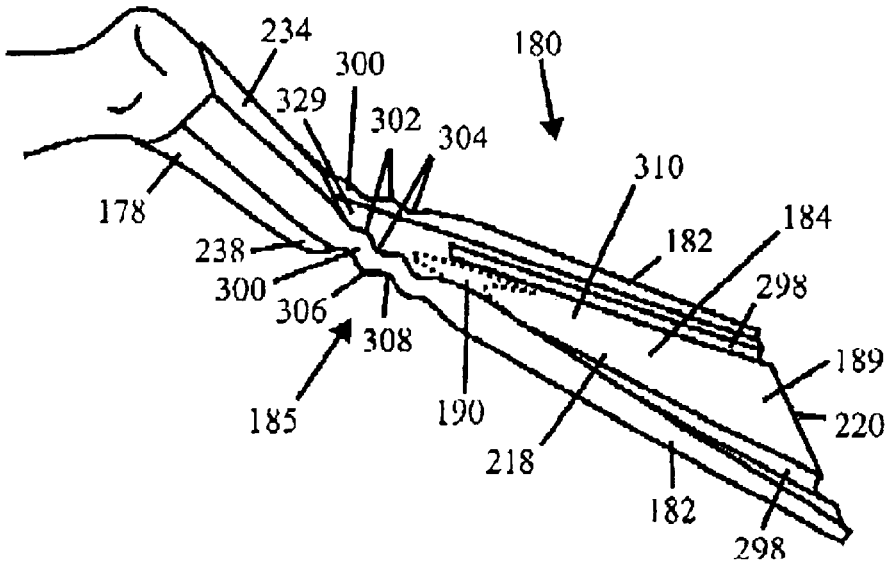
FIG. 13 shows an alternate embodiment of a swim fin.

FIG. 13 shows an alternate embodiment of the present invention swim fin while at rest. Two flexible members 298 are disposed in blade 184 adjacent to stiffening members 182. Flexible members 298 provide blade 184 with increased flexibility to improve the ability of blade 184 to form a scoop shape between stiffening members 182. In this embodiment, flexible members 298 include a fold of material to permit flexible member 298 to expand under load. Flexible member 298 has a concave curvature adjacent to lower surface 218. The concave curvature relative to lower surface 218 is to enhance propulsion during the up stroke where lower surface 218 is the attacking surface. In alternate embodiments, any orientation of curvature and or any number of folds may be used in any direction. The size, location, alignment and number of flexible members 298 may also varied in any manner. Flexible portion 298 may be a region of reduced blade material, region of reduced material thickness, or regions of softer material disposed within blade 184. Preferably, flexible portion 298 is made with a flexible thermoplastic material and blade 184 is a relatively stiffer thermoplastic material and flexible portion 298 is a connected to blade 184 with a thermal-chemical bond created during a phase of an injection molding process. In alternate embodiments, additional flexible members may be added between, adjacent to or connected to the flexible members 298 shown as well as near or along the center longitudinal axis of blade region 180. Increasing the number of flexible members 298 and, or increasing the size of the folds for increased expandable range of at least one of flexible members 298 can permit the depth of a scooped blade shape to be increased during use. Preferably, the folds within flexible members 298 have sufficient resiliency to permit a scooped blade shape to snap back to a neutral position at the end of a kicking stroke.

In FIG. 13, flexible portion 190 is seen to have an arch shape; however, any shape may be used for flexible portion 190. Portion 190 may be a region of reduced material, reduced blade thickness, or a region of softer material disposed within blade 184 with a thermal chemical bond. Pivoting blade portion 185 is seen to have a resilient region 300 that is wave-shaped. The wave shape of resilient region 300 along stiffening members 182 is arranged to provide increased flexibility to stiffening members 182 for encouraging blade region 180 to pivot around a transverse axis to a reduced angle of attack during use. The wave shape of resilient region 300 is preferred to have sufficient curvature to cause the material within resilient region 300 to stretch and, or compress sufficiently during use to store energy during a deflection and efficiently return such stored energy in a snapping motion at the end of a kicking stroke. The curvature of resilient region 300 can allow the elongation and, or compression within the material of resilient region 300 to stretch and, or compress at increased angles to the alignment of stiffening members 182 so that the snap back energy stored within such stretched and, or compressed material is exerted at an angle to the alignment of stiffening members 182 for increased torque and leverage. Preferably, resilient region 300 is made with a material having a high modulus of elasticity and high memory. Preferred materials include thermoplastic elastomers, thermoplastic rubbers, polypropylenes and polypropylene blends, copolymer polypropylenes, polyurethanes, Pebax, Hytrel, rubber or any other high memory material. EVA thermoplastic may also be used as well as composite materials. In alternate embodiments, resilient region 300 may have any shape, any number of curves, or any configuration or form. Alternate embodiments can also place resilient region 300 within the blade 184 adjacent foot pocket 178 without resilient region 300 having to exist within stiffening members 182, or without stiffening members 182 being present adjacent pivoting blade region 185 or without stiffening members 182 being present at all along blade region 180.

Flexible region 300 is seen to a lower surface peak 302 and a lower surface trough 304 relative to lower surface 218 of blade region 180. Flexible region 300 also has an upper surface peak 306 and an upper surface trough 308 relative to the upper surface of blade region 180. In this embodiment, each lower surface trough 304 is aligned with an upper surface peak 306 and each lower surface peak 302 is aligned with an upper surface trough 308. In alternate embodiments, the peaks and troughs of resilient region 300 can be varied in any manner and may have any degree of alignment or misalignment from each other. Preferably, the curvature and alignment of the peaks and troughs of resilient region 300 are arranged to increase snap back leverage on blade region 180 and also to enable pivoting blade region 185 to stop pivoting beyond a predetermined deflection by causing the material within resilient region 300 to reach a predetermined elastic limit as a predetermined maximum deflection is reached. The curvature of resilient region 300 also allows the deflection of blade region 180 to apply increased leverage against the material of resilient region 300 so that higher elongation rates and, or compression rates are achieved for a predetermined amount of deflection. This can increase the ability for blade region 180 to stop pivoting beyond a predetermined deflection angle as an elastic limit is approached or reach and can increase the amount of stored energy within such material so that snap back energy is increased at the end of a stroke. The sinuous structure of resilient region 300 can provide increased spring properties similar to coiled spring. Just as a coiled spring can provide distinct spring characteristics from a flat spring, the sinuous form of resilient region 300 can provide unique spring properties for enhanced performance characteristics. Resilient region 300 may also be made to have sinuous shape that varies in transverse thickness, may have a sinuous shape in a lengthwise direction as well as a transverse thickness, or may have a 3-dimensional shape that resembles a coiled spring. Resilient region 300 may be a region of reduced cross sectional shape, a region of increased flexibility, a region of reduced vertical dimension, a region of reduced transverse dimension, as well as a region that is made with a more flexible material or a combination of materials.

In alternate embodiments, any number of peaks and troughs can be used along resilient region 300. Also, different numbers of peaks and troughs can exist on each side of resilient portion 300. For example, less peaks and, or trough could exist adjacent to lower surface 218 than existing adjacent to the upper surface (not shown) of blade region 180. This can be used to create different elastic limits during each stroke so that there is increased deflection on the down stroke and reduced deflection on the up stroke in order to compensate for ankle roll and foot alignment relative to the intended direction of travel. Resilient region 300 preferably exists within the first quarter blade length of blade region 180 between toe portion 238 and forward edge 220; however, resilient region 300 may exist along the first half of blade region 180 between toe portion 238 and a longitudinal midpoint 310, which is located midway between toe portion 238 and forward edge 220. Resilient region 300 may have any desired longitudinal dimension and may be oriented at any angle or in any direction.

Figure 14:
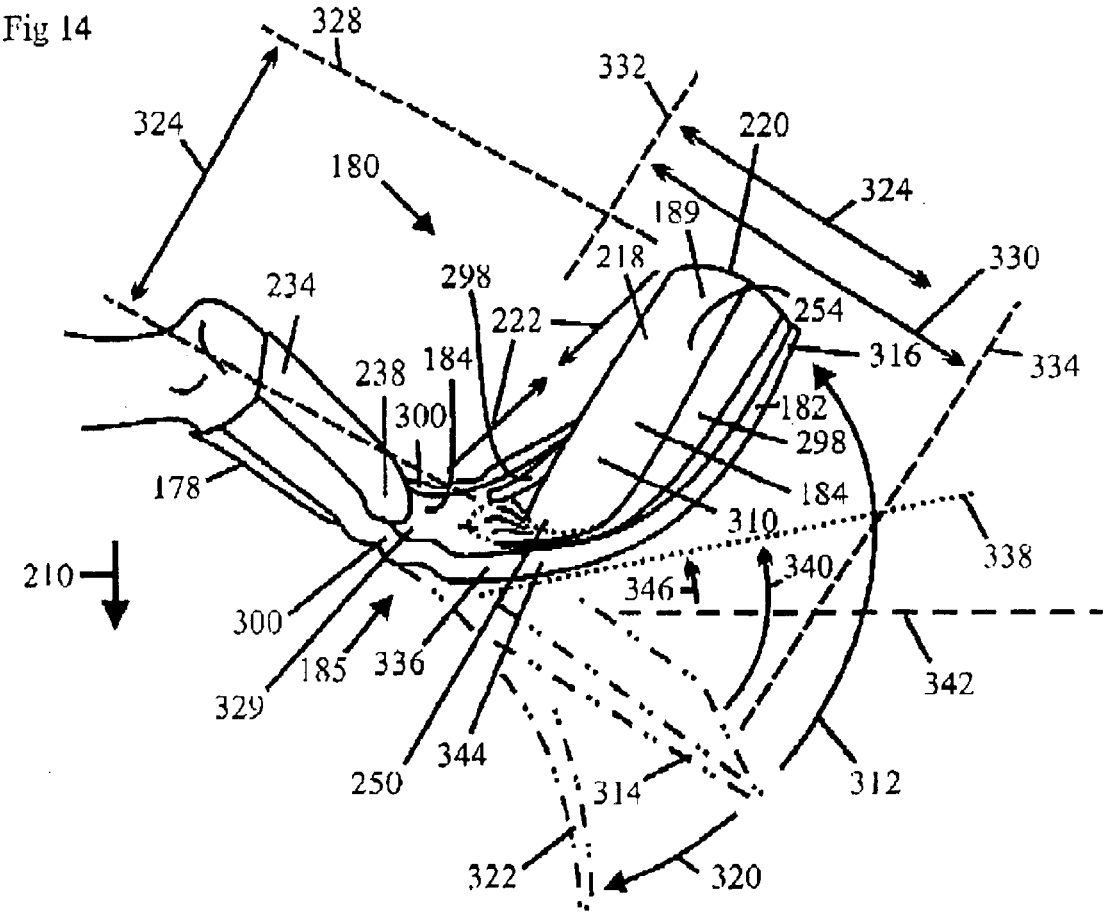
FIG. 14 shows the swim fin of FIG. 13 during use.

FIG. 14 shows the swim fin of FIG. 13 during use. In the embodiment in FIG. 14, flexible portion 190 is seen to be located within the first half of blade region 180 between toe portion 238 and longitudinal midpoint 310. It is preferred that flexible portion 190 is located with the first half portion of blade region 180 so that origination end 250 of scooped blade portion 254 is located within the first half of blade region 180. Stiffening members 182 are seen to arch between resilient region 300 and free end 189 during a deflection 312 in which blade region 180 moves from a neutral position 314 to a deflected position 316. When kick direction 210 is reversed, a reversed deflection 320 occurs to a reversed deflected position 324. Preferably, reversed deflection 320 is less than deflection 312 to compensate for differences in ankle pivoting and foot alignment during opposing stroke directions.

Scooped blade portion 254 has a deflected lengthwise scoop dimension 324 that exists between an originating reference line 326 that is aligned with originating end 250 of scooped blade portion 253 and a free end reference line 328 that is aligned with free end 189. Blade region 180 has a root portion 329 adjacent to toe portion 238. An unflexed blade dimension 330 exists between a root reference line 332 that is aligned with root portion 329 and a neutral free end reference line 334. For comparative purposes, deflected lengthwise scoop dimension 324 is also seen next to unflexed blade dimension 330 to show that deflected lengthwise scoop dimension 324 occupies a major portion of the total blade length of blade region 180 during deflection 312. This is a major improvement over the prior art in which high amount of blade deflection causes a scooped shape to collapse under a longitudinal compression force such as compression force 222. Because the methods of the present invention permit blade region 180 to strategically fold adjacent to flexible portion 190 while the portions of blade 184 between flexible portion 190 and forward edge 220 has sufficient structural strength to resist collapsing under compression force 222, the size of scooped blade portion 254 is significantly improved over the prior art for increased channeling capacity and efficiency. Because large flow capacity with an increased scooped blade portion 254 is able to exist during a large scale deflection such as deflection 312 without collapsing under compression force 222, much more water is pushed in the opposite direction to travel direction 204 for increased propulsion and efficiency. Because the angle of attack is significantly reduced, flow separation and turbulence is reduced adjacent lower surface 218 during kick direction 210 to create a reduction in kicking effort and an increase in lifting force from improved smooth flow conditions and reduced stall conditions.

It is preferred that deflected lengthwise scoop dimension 324 is at least 50% of unflexed blade dimension 330 (the longitudinal dimension of blade region 180) during a large scale deflection such as deflection 312. Preferably, deflected lengthwise scoop dimension 324 is between 60% and 100% of blade dimension 330. Higher percentages are preferred to increase the ability for blade region 180 to channel increased volumes of water for increased propulsion and efficiency. Excellent results can be achieved when deflected lengthwise scoop dimension 324 is at least 60%, at least 70%, at least 80% and at least 90% of blade dimension 330. It is also preferred that deflection 312 is sufficient to permit a significantly large amount of water to be pushed in the opposite direction of travel direction 204. Preferably, deflection 312 is sufficient to permit a greater amount of water to be pushed substantially in the opposite direction of travel direction 204 than the amount of water that is pushed substantially in the direction of kick direction 210 while deflected lengthwise scoop dimension 324 is at least 50% of blade dimension 330.

It is preferred that deflection 312 is sufficient to push a significantly increased amount of water in the opposite direction of travel direction 204 for increased propulsion while deflected lengthwise scoop dimension 324 is at least 60% of blade dimension 330. It is preferred that deflection 312 is similar to deflection 212 in FIGS. 9 and 10.

In FIG. 14, blade region 180 has a one quarter blade position 336 that is one quarter of the distance between root portion 329 and forward edge 220. A one quarter position tangent line 338 is tangent to blade region 180 at one quarter blade position 336. A one quarter position deflection 340 exists between neutral position 314 and one quarter position tangent line 338. It is preferred that deflection 340 at one quarter blade position 336 is at least 10 degrees during a relatively light kicking stroke such as used to create a relatively slow to moderate swimming speed in direction 204. Preferably, blade region 180 adjacent one quarter blade position 336 is made sufficiently flexible to permit the root portion of blade region 180 adjacent toe region 238 to flex around a transverse axis to a significantly reduced angle of attack during use. Excellent results may also occur when one quarter position deflection 340 is at least 15 degrees, at least 20 degrees, at least 30 degrees, at least 40 degrees, at least 50 degrees, or at least 60 degrees during use.

In alternate embodiments, the characteristics preferred for one quarter blade position 336 may occur closer to longitudinal midpoint 310 or at a one third blade position 344 that is one third of the distance between root portion 329 and forward edge 220.

A direction of travel reference line 342 is parallel to direction of travel 204. A direction of travel deflection 346 exists between direction of travel reference line 343 and one quarter position tangent line 238. Deflection 346 is preferably at least 5 degrees during a relatively light to moderate kick used to achieve a relatively slow to moderate swimming speed such as 1 mph to 2 mph. Excellent results can occur with deflection 346 being at least 10 degrees, at least 15 degrees, at least 20 degrees and at least 30 degrees.

In FIG. 14, flexible members 298 are seen to have expanded under the exertion of water pressure created during kick direction 210 to increase the depth of scooped blade portion 254. It is preferred that flexible members 298 are made sufficiently expandable to greatly increased the depth of scooped blade portion 254 as flexible portion 190 permits deflected lengthwise scoop dimension 324 to be at least 50% of blade dimension 330 during a large scale deflection.

In the embodiment in FIG. 14, flexible portion 190 is seen to be adjacent one quarter blade position 336. In alternate embodiments, flexible portion 190 may occur at any position along blade region 180. In the embodiment shown, flexible portion 190 is also located forward of pivoting blade region 185. In alternate embodiments, flexible portion 190 may be located forward, behind, or within pivoting blade region 185. In the embodiment shown in FIG. 14, placing flexible portion 190 forward of pivoting blade region 185 can be used to create two longitudinally spaced apart pivoting regions, one at flexible portion 190 and another at pivoting blade region 185. This can be used to apply a compound leverage force to pivoting blade region 185 for increased elastic elongation and, or compression within the material of pivoting blade region 185 to create increased snap back energy and, or to permit an elastic limit of the material to be approached or reached for reducing or stopping further pivoting of pivoting blade region 185 beyond a predetermined maximum reduced angle of attack. Once scooped blade portion 254 is formed and stabilized so that it does not collapse under an increase in deflection beyond deflection 312, compression force 222 is further increased and applied in a concentrated manner to pivoting blade region 185, thereby forcing pivoting blade region 185 to bend around a reduced bending radius which in turn can create a large increased in elongation and, or compression ranges within the elastic material of pivoting blade region 185 for increased snap back energy and, or for creating a rapid increase in bending resistance to further deflection as elastic limits are approached or reached at an increased rate for improved deflection limiting characteristics. In alternate embodiments, similar leverage effects can also be achieved as flexible portion 190 is moved closer to root portion 329. This will further reduce the bending radius applied to pivoting blade portion 185 for increased storage of snap back energy as well as creating an exponential increase in bending resistance within pivoting blade portion 185 for increased deflection limiting characteristics at, near or beyond a predetermined maximum reduced angle of attack. As bending resistance increases at pivoting blade region 185, stiffening members 182 can be arranged to have sufficient flexibility along their lengths to permit stiffening members 182 to have a predetermined amount of continued bending around an arched path after pivoting portion 185 stops pivoting. Such an arched curvature of bending for stiffening members 182 can increase stored energy for snap back return and also increase the formation of an S-shaped wave during the inversion portion of the kicking stroke cycle. Because flexible portion 190 is arranged to fold while blade 184 along scooped blade portion 254 is sufficiently rigid enough to not collapse under compression force 222, stiffening members 182 can continue to bend around a reduced radius while scooped blade portion 254 does not collapse and remains structurally stable and effective. It is preferred that flexible portion 190 is sufficiently flexible to permit flexible portion 190 to bend around an increasingly smaller radius as the deflection of blade region 180 is increased (as the angle of attack of blade region 180 is reduced).

Figure 15:
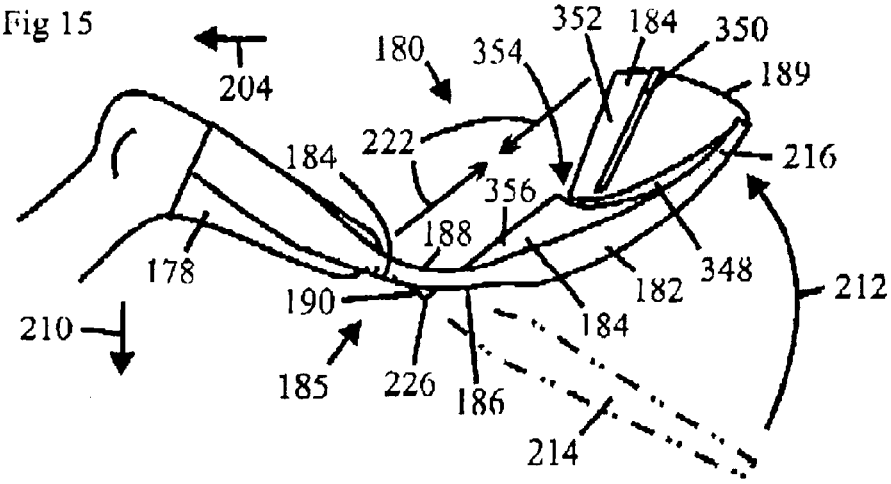
FIG. 15 shows an alternate embodiment swim fin.

FIG. 15 shows an alternate embodiment of the swim fin shown in FIGS. 9 and 10. In FIG. 15, a forward flexible portion 348 is disposed within blade 184 between flexible portion 190 and forward edge 220. Forward flexible portion 348 is a region of increased flexibility within blade 184. Portion 348 may made in any manner. Portion 348 may be a void, a region of reduced material, a region of reduced material thickness, a region of reduced blade thickness, a region of more flexible material, a region of softer material, a region of folded material, a region having pre-formed folds while at rest, a region made of a flexible material molded to blade 184 with a mechanical and, or chemical bond, as well as a flexible material connected to blade 184 with thermal-chemical adhesion created during a phase of an injection molding process.

In the embodiment of FIG. 15, at least one stiffening member 350 is connected to blade 184 in an area between forward flexible portion 348 and forward edge 220. Stiffening member 350 is used to add structural strength to blade 184 in this area so that this portion of blade 184 is able to form an outer scooped blade portion 352 that will not collapse under compression force 222. Stiffening member 350 allows the stiffness and, or thickness of blade 184 to be reduced since stiffening member 350 provides structural support for outer scooped blade portion 352 within blade 184. This can allow blade 184 to be made with increased flexibility so that scooped blade portion 352 bows to form a scoop shape with greater ease and reduced bending resistance. It is preferred that stiffening member 350 has a significantly longitudinal alignment; however, any number of stiffening members having any shape, contour, form or alignment may be used.

Blade 184 is seen to strategically buckle, bend or fold at a bending zone 354 that is created by forward flexible portion 348 under the exertion of water pressure created during kick direction 210 and under compression force 222. Bending zone 234 divides blade 184 into a multi-faceted scoop shape that includes an inward scoop portion 356 located between forward flexible portion 348 and flexible portion 190. In this embodiment, it can be seen that outer scoop portion 353 is oriented at a more reduced angle of attack than inward scoop portion 356. It is preferred that flexible portion 190 is more flexible than flexible portion 348 so a significant portion of compression force 220 is exerted at flexible portion 190 so that a significant portion of compression force is exerted upon flexible portion 190 so that inward scoop portion 356 is able to form. It is preferred that forward flexible portion 348 is arranged to transfer a significant portion of compression force 222 back to forward portion 190 so that inward scoop portion 356 is able to form a significantly scooped shape. In alternate embodiments, additional stiffening members such as stiffening member 350 may be disposed within inward scoop portion 356 as well.

Figure 16:
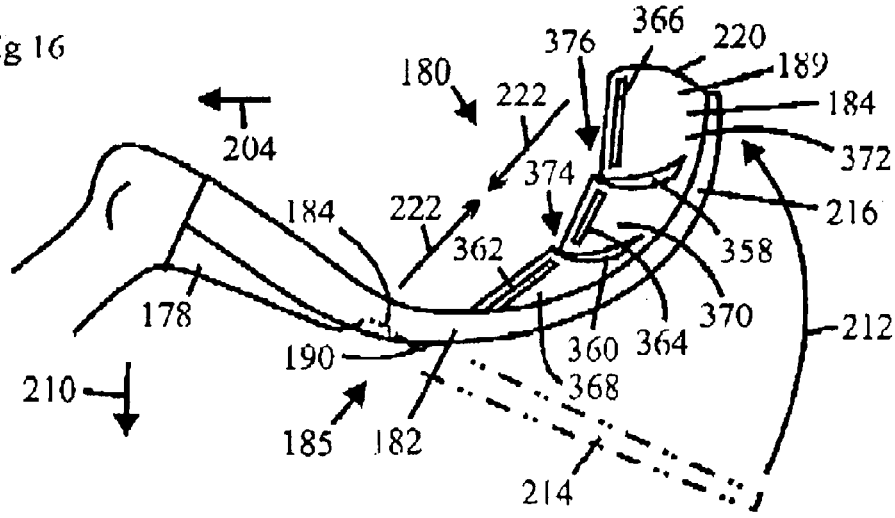
FIG. 16 shows an alternate embodiment swim fin.

FIG. 16 shows an alternate embodiment swim fin shown in FIG. 15. In FIG. 16, stiffening member 182 is seen to pivot around a transverse axis to a reduced angle of attack during use, and a major portion of such pivoting occurs adjacent foot pocket 178. In this embodiment, stiffening member 182 has gradual taper in cross sectional shape from foot pocket 178 to free end 189. The degree of taper is limited to permit a significant portion of bending to occur adjacent foot pocket 178. Any method for permitting blade region 180 to pivot around a transverse axis to a reduced angle of attack adjacent foot pocket 178 may be used. An outer flexible portion 358 and a middle flexible portion 360 are seen to be disposed within blade 184 in an area between flexible portion 190 and forward edge 220. An initial stiffening member 362, a middle stiffening member 364 and an outer stiffening member 366 are connected to blade 184 to provide increased structural reinforcement to blade 184 so that blade 184 bends at the strategic locations of flexible portion 190, middle flexible portion 230 and outer flexible portion 358. Again, any number of such stiffening members having any shape, contour, alignment or form may be used.

A multi-faceted scoop shape is formed within blade region 180 which includes an initial scoop portion 368, a middle scoop portion 370 and an outer scoop portion 372. In this embodiment, scoop portions 368, 370, and 372 are arranged to have different angles of attack which become increasingly reduced toward free end 189. In this embodiment, middle flexible portion 360 and outer flexible portion 358 terminate in a transverse direction at a location adjacent stiffening member 182. In alternate embodiments, portions 360 and 358 may terminate at any location, may connect to stiffening member 182 or may be connected to a longitudinal flexible member or any other type of flexible portion. Preferably portions 360 and 358 have sufficient transverse dimension to permit compression force 222 to be sufficiently reduced within blade 184 to permit blade 184 to form a scooped portions 368, 370 and 372 during a large scale deflection such as in deflection 212.

In the embodiment in FIG. 16, a middle bending zone 374 is formed adjacent middle flexible portion 360 and an outer bending zone 376 is formed adjacent outer flexible portion 358. Outer bending zone 374 forms a bend in which outer scoop portion 372 under cuts below the plane of middle scoop portion 370, and middle bending zone forms a bend in which middle scoop portion 370 under cuts below the plane of initial scoop portion 368. This is because each scoop portion is rotating under the exertion of compression force 222 around a focal point that is located in the middle region or forward region of each scoop portion.

Figure 17:
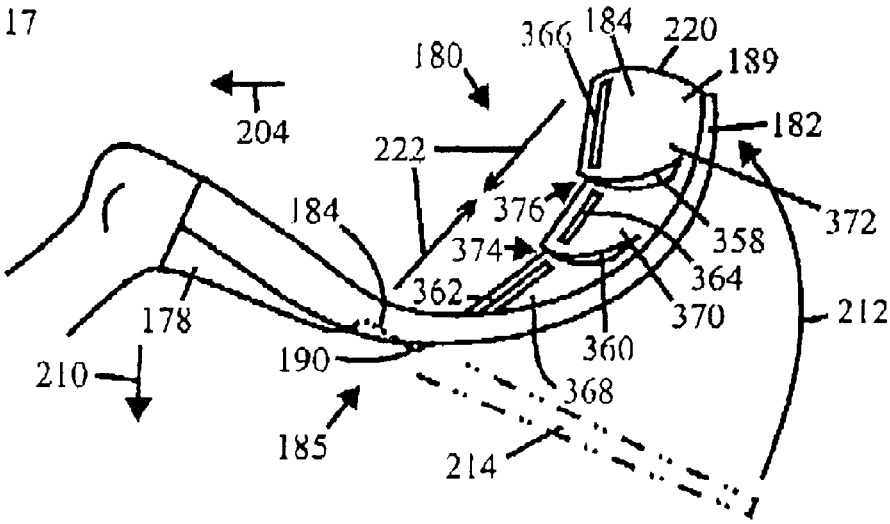
FIG. 17 shows an alternate embodiment swim fin.

FIG. 17 shows an alternate embodiment of the swim fin shown in FIG. 16. In this embodiment in FIG. 17, the flexibility of flexible regions 358 and 360 are increased to permit scooped portions 370 and 372 to flex further under water pressure and beyond the requirements of compression force 222 so that outer scoop portion 372 overhangs middle scoop portion 370, and middle scoop portion 370 overhangs initial scoop portion 368.

In the embodiment shown in FIGS. 16 and 17, scooped portion 372 is oriented at a more reduced angle of attack (greater degree of deflection) than scooped portion 370, and scooped portion 370 is oriented at a more reduced angle of attack than scooped portion 368. In alternate embodiments, this can be reversed so that the alignment of scooped portion 368 is oriented at the most reduced angle of attack (greatest degree of deflection), the alignment of scooped portion 370 is oriented at less of a reduced angle of attack (lower angle of deflection) than scooped portion 368, and the alignment of scooped portion 372 is oriented at less of a reduced angle of attack (lower angle of deflection) than scooped portion 370. In such an alternate embodiment, the depth of the multi-faceted scoop shape formed by portions 368, 370 and 372 would be increased and the flow capacity would also be increased. This can be created by providing significantly increased flexibility and, or increased flexible surface area and, or increased expandability provided by loose folds within flexible portion 190 and middle flexible portion 360.

Figure 18:
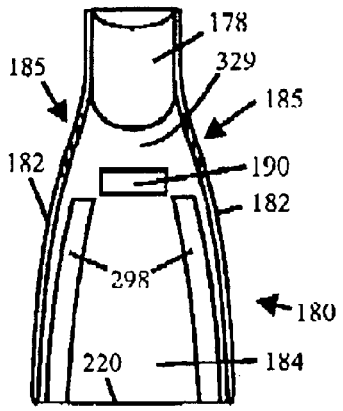
FIGS. 18 to 26 show alternate embodiment swim fins.

FIGS. 18 to 26 show alternate embodiment swim fins. FIG. 18 shows an alternate embodiment swim fin that is similar to the embodiment shown in FIGS. 13 and 14; however, the embodiment in FIG. 18 provides flexible portion 190 with a substantially rectangular shape. Flexible portion in FIG. 18 may be a void, a vent, a region of reduced material thickness, a region of reduced material as well as a region being made with a softer material molded to blade 184. Although in this embodiment flexible portion 190 is not connected to flexible members 298, in alternate embodiments flexible portion 190 may be connected to flexible members 298 and may also be made with the same material during the same step of injection molding. Pivoting blade region 185 is made viewable from this view by the presence of diagonal lines which show the longitudinal size and positioning of pivoting blade region 185, which is a region of increased flexibility within blade region 180 or a region of pivoting around a transverse axis. For ease of production, the softer material of foot pocket 178 may be used to make flexible portions 298 and, or flexible portion 190 during the same phase of an injection molding process and connected to the swim fin with a thermal-chemical bond. A three material fin may be constructed by making flexible member 298 and, or flexible portion 190 with a different flexible thermoplastic material than that used to make the softer portion of foot pocket 178.

Figure 19:
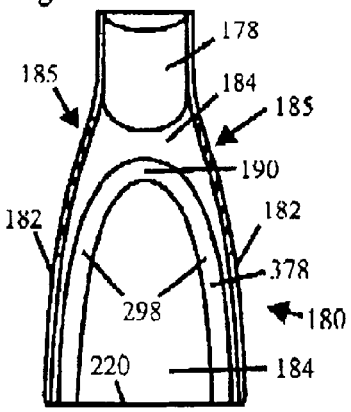

In the alternate embodiment in FIG. 19, pivoting blade region 185 is distributed over the first half of blade region 180. Flexible portion 190 is curved in this embodiment and forms a smooth connection with flexible members 298 to form an arched flexible zone. As stated previously, it is important that the portion of blade 184 that is located between arched flexible zone 378 and forward edge 220 be made sufficiently rigid in a longitudinal direction to prevent this portion of blade 184 from collapsing in a longitudinal direction under the compression forces exerted on blade region 180 as blade region 180 flexes to a high angle of deflection around a transverse axis during use. Prior art swim fins that have attempted to use an arch shaped flexible region failed to permit the first half of the blade to pivot significantly around a transverse axis and, or made the blade portion too flexible between the arched portion and the forward edge so that this blade portion collapses in a longitudinal manner to prevent the formation of a longitudinally large scoop shape. In alternate embodiments, arched flexible zone 378 can be connected to the soft portion of foot pocket 178.

Figure 20:
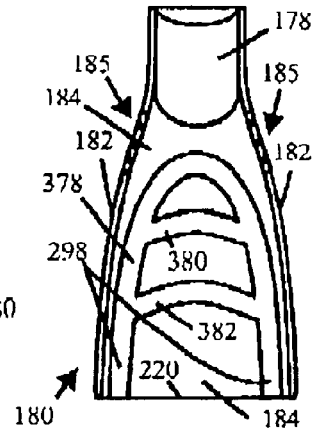

FIG. 20 shows an alternate embodiment of the swim fin shown in FIG. 19. In FIG. 20, pivoting blade region 185 is located within the first one quarter portion of blade region 180. A middle flexible portion 380 and an outer flexible portion 382 are disposed in blade 184 between arched flexible zone 378 and forward edge 220. In this embodiment, flexible portions 380 and 382 have a substantially transverse alignment, have a concave forward curvature, and are connected to arched flexible zone 378. In alternate embodiments, flexible portions 380 and 382 may have any alignment, angled alignments, longitudinal alignments, any degree or manner of curvature, and any level of connectedness or lack of connectedness to arched flexible zone 378.

Figure 21:
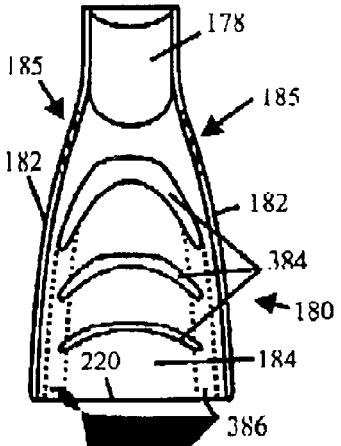

FIG. 21 shows another alternate embodiment in which three curved flexible regions 384 are disposed within blade 184. Two longitudinal flexible zones 386 are disposed in blade 184 adjacent to stiffening members 182. Longitudinal flexible zones 386 can be a region of reduced blade thickness rather than be a separate material. Flexile regions 384 may be vents, voids, regions of reduced material, regions of reduced blade thickness, or regions of softer material disposed within blade 184.

Figure 22:
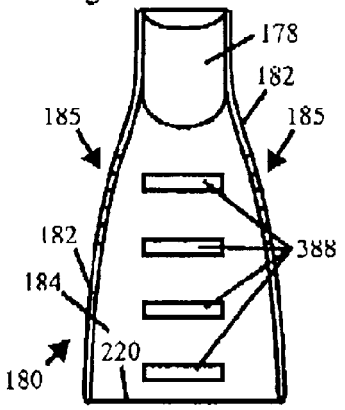

In FIG. 22, pivoting blade region 185 is located approximately within the second quarter blade region between the one quarter blade position and the midpoint of the blade length. A series of transverse flexible regions are disposed within blade 184. Transverse flexible regions may be vents, voids, regions of reduced material, regions of reduced blade thickness, or regions of softer material disposed within blade 184.

Figure 23:
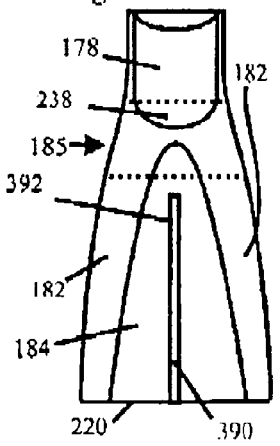

In the alternate embodiment in FIG. 23, stiffening members 182 are wide and relatively flat. Pivoting blade region 185 is outlined by transverse dotted lines to show that the entire region between the dotted lines is a region of increased flexibility within blade region 180 that is arranged to permit blade region 180 to pivot around a transverse axis to a significantly reduced angle of attack during use. Pivoting blade region 185 is seen to begin behind toe portion 238 of foot pocket 178 and extends forward over approximately the first quarter of the length of blade region 180. Blade 184 is made with a significantly flexible material that is more flexible than stiffening members 182 so that blade 184 may bow between stiffening members 182 under the exertion of water pressure to form a scoop shape during use. A blade stiffening member 390 is connected to blade 184 and extends from forward edge 220 and terminates at a base 392 that is located at a predetermined position adjacent pivoting blade region 185. It is preferred that blade stiffening member 390 is made sufficiently stiff to prevent blade stiffening member 390 and blade 184 from collapsing under the longitudinal compression forces created as blade 184 forms a scoop shape during use and as blade region 180 pivots around a transverse axis to a significantly reduced angle of attack during use. Preferably, blade region 180 is arranged to have sufficient flexible material between base 392 of blade stiffening member 390 and foot pocket 178 to form a flexible bending zone 394 which is arranged to bend around a sufficiently small bending radius to permit the longitudinal compression forces on the scoop to be concentrated on flexible bending zone 394 so that blade stiffening member 390 is able to pivot to a greater deflection angle than that experienced by stiffening members 182 in order to permit blade 184 to form a significantly long scoop shape over a significantly large portion of the overall length of blade region 180.

Figure 24:
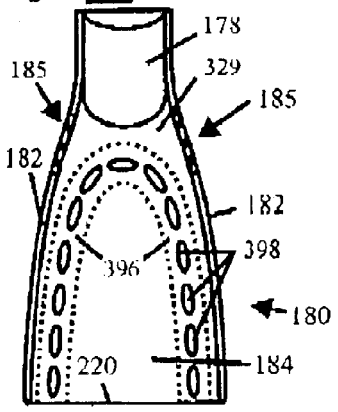

The embodiment in FIG. 24 shows a region of increased flexibility 396 which is located in the region between the dotted lines. Region of increased flexibility 396 is more flexible than the rest of blade 184 because of the presence of voids 398. The absence of material at the locations of voids 398 reduces the bending resistance of blade 184. The longitudinal alignment of voids 398 adjacent stiffening members 182 permits region of increased flexibility 396 adjacent to stiffening members 182 to act like a longitudinal flexible members that reduce bending resistance within blade 184 along region 396 to permit blade 184 to bow with increased ease between stiffening members 182 so that a scooped shape may form between stiffening members 182 during use. The transverse alignment of voids 398 adjacent root portion 329 of blade 184 permits blade 184 to flex around a relatively small transverse bending radius along the transverse portion of region 396. Because the methods of the present invention include providing blade 184 with sufficient longitudinal rigidity to prevent the portions of blade 184 located between region 396 and forward edge 220 from collapsing or buckling in a longitudinal direction, the longitudinal compression forces on blade 184 are concentrated along the transverse portion of region 396. Thus, region 396 is arranged to focus the longitudinal compression forces within a small region of blade 184 located close to root portion 329 so that a majority of the blade length of blade region 180 may maintain a significantly long lengthwise dimension while a scoop shape experiences large scale blade deflections around a transverse axis. In alternate embodiments, region 396 may also be a region of reduced blade thickness within blade 184 or may be a region of more flexible material that is connected to blade 184 with a chemical bond and voids 398 may be disposed in such a region. In alternate embodiments, voids 398 may have any shape, size, alignment, contour, spacing, orientation, location, and may occur in any number. Voids of differing size and shape can be used to create regions of flexibility that can increase the ability for blade 184 to form a scoop shape during use. Voids 398 also provide increased venting through the blade which can further reduce kicking resistance. The location of voids 398 adjacent to the outer side edges of blade 184 (near stiffening members 182 in this embodiment) can improve smooth flow conditions along the low pressure surface of blade 184 during at least one kicking stroke direction for improved lift, reduced drag and reduced kicking resistance. Pivoting blade region 185 is seen to be located adjacent to root portion 329 of blade region 180; however, pivoting blade region 185 may have any location or dimension. It is preferred that pivoting blade region 185 is located within the first half of blade region 180. Excellent results can be achieved with pivoting blade region being located within the first quarter blade length of blade region 180.

Figure 25:
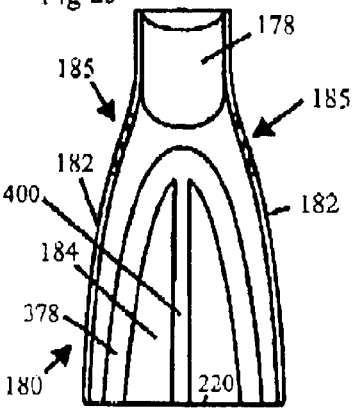

The embodiment in FIG. 25 is similar to the embodiment of FIG. 19; however, pivoting blade region is shown to be more focused near root portion 329 and a longitudinal flexible member 400 is connected to arched flexible zone 378. Longitudinal flexible member 400 is arranged to permit the more rigid blade 184 between member 400 and arched flexible zone 378 to flex around a longitudinal axis to form a scoop shape with reduced bending resistance. Any number of longitudinal flexible members may be used. Member 400 may be a region of reduced material, a region of reduced blade thickness, or a region of relatively soft material connected to blade 184 with a chemical bond. Member 400 can also be used to provide increased flexibility within blade 184 so that when the kicking stroke is inverted, blade 184 is able to form an S-shaped wave with increased efficiency and reduced bending resistance. Member 400 can provide a longitudinal path for the S-shaped wave to roll forward during the inversion portion of a kicking stroke cycle.

Figure 26:
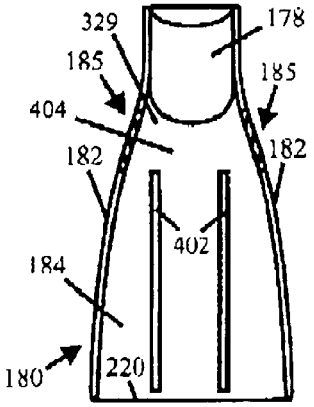

The embodiment in FIG. 26 uses two elongated stiffening members 402 connected to blade 184. In this embodiment, stiffening members 402 are sufficiently rigid to prevent them from collapsing under longitudinal compression forces during use and blade 184 is made significantly flexible. A root portion flexible region 404 is located between elongated stiffening members 402 and foot pocket 178 adjacent to root portion 329. Root portion flexible region 404 is a region of blade 184 that is not supported by stiffening members 402 and is therefore able to flex around a transverse axis and take on a sufficiently small enough bending radius to permit the portion of blade 184 that is supported by stiffening members 402 to form a significantly long scoop blade shape as blade region 180 experiences a large scale deflection around a transverse axis adjacent pivoting blade region 185. In alternate embodiments, stiffening members 402 may have any shape, form, cross section, thickness, width, curvature, orientation, alignment, structure, may be made with any suitable material, and may be connected to blade 184 in any manner including mechanical bonds, chemical bonds, as well as permanent, adjustable, variable, movable or removable attachment methods.

Figure 27:
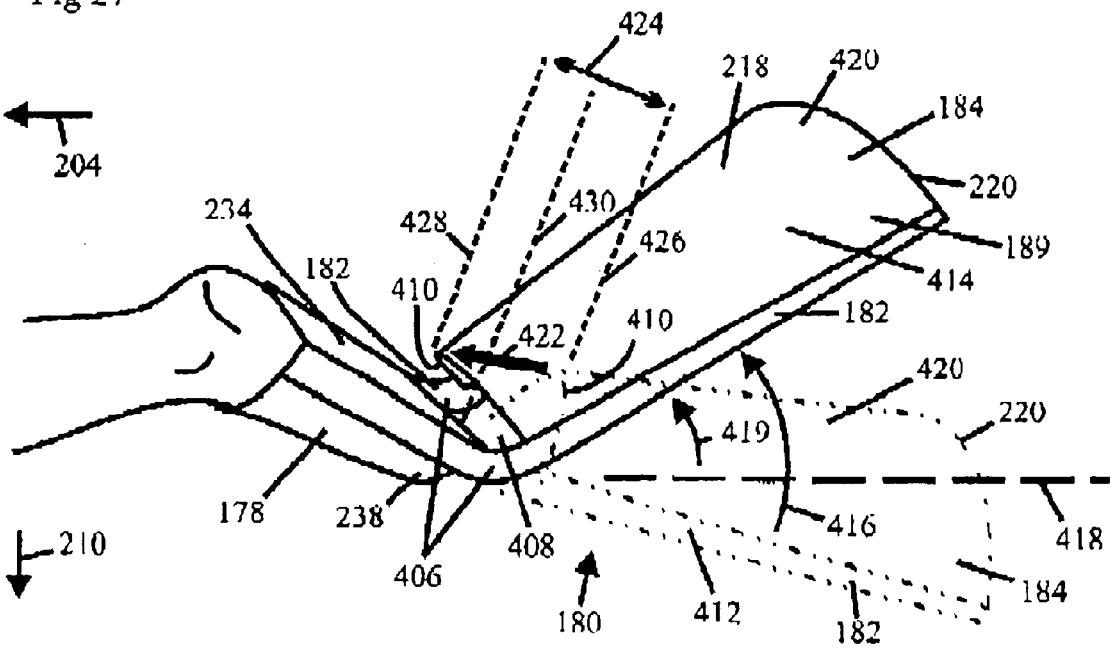
FIG. 27 shows an alternate embodiment swim fin during a down stroke.

FIG. 27 shows an alternate embodiment swim fin which is being kicked in kick direction 210 during a down stroke. In this embodiment, pivoting blade region 185 includes a pivoting rib portion 406 along stiffening members 182 near toe portion 238 of foot pocket 178. A wide gap 408 provides increased flexibility to blade region 180 adjacent pivoting blade region 185. Gap 408 is also used as a method for providing blade 184 with the ability to move toward foot pocket 178 under longitudinal compression forces created within scooped blade portions during large scale deflections. Gap 408 is located between a blade root portion 410 and toe portion 238. In FIG. 27, blade region 180 has pivoted from a neutral position 412 to a deflected position 414 and has experienced a deflection 416. A direction of travel reference line 418 is parallel with direction of travel 204 and a travel direction deflection 419 exists between direction of travel reference line 418 and deflected position 414. It is preferred that blade 184 is sufficiently flexible in a transverse direction to bow between stiffening members 182 to form a scooped blade region 420 under the exertion of water pressure created during a kicking stroke. It is also preferred that blade 184 is sufficiently rigid in a longitudinal direction to not collapse or buckle excessively under the exertion of longitudinal compression forces applied to scooped blade region 420 as blade region 180 experiences deflection 416.

In FIG. 27, neutral position 412 is displayed by broken lines and can be used for comparative purposes to show the position of blade 184 and scooped blade region 420 as blade 184 bows under water pressure prior to the completion of deflection 416. In neutral position 412, blade root portion 410 (broken lines) is seen to be located a significantly large distance in front of toe portion 238 of foot pocket 178. As blade region 180 experiences deflection 416 from neutral position 412 to deflected position 414, blade root portion 410 is seen to experience a root portion movement 422 that causes blade root portion 410 to move a significantly large distance toward foot pocket 178. Root portion movement 422 is seen to occur over a root movement distance 424 that exists between a neutral root position reference line 426 that is aligned with root portion 410 existing at neutral position 412 and a deflected root position reference line 428 that is aligned with root portion 410 existing at deflected position 414. A toe position reference line 430 shows the position of toe portion 238 relative to root movement distance 424. Toe position reference line 430 shows that root movement distance 424 is significantly large and has caused root portion 410 to move passed toe portion 238 and is located behind toe portion 238. It is preferred that wide gap 408 have a sufficiently large longitudinal dimension to prevent root portion 410 from colliding with foot pocket 178 as blade region 180 experiences a large scale deflection such as deflection 416. If the longitudinal dimension of gap 408 is made too small, then root portion 410 can collide with foot pocket 178 before a predetermined large scale deflection such as deflection 416 could occur and such a collision would halt further pivoting and, or would cause blade 184 to buckle or collapse under increased compression forces. In alternate embodiments, gap 408 can be made with a predetermined longitudinal dimension that allows root portion 410 to move a predetermined distance toward foot pocket 178 without colliding with foot pocket 178 as blade region 180 experiences a predetermined large scale deflection around a transverse axis, and such a predetermined longitudinal dimension of gap 408 is arranged to cause root portion 410 to collide with foot pocket 178 if an increase in load begins to cause such a predetermined large scale deflection to be exceeded so that further pivoting is stopped by the collision of root portion 410 with foot pocket 178. In this situation, blade 184 can be reinforced in a manner effective to prevent blade 184 from collapsing or buckling under longitudinal compression forces applied to scooped blade region 420. It is preferred that elastic limits of the rib material under the tensile and compression forces exerted on pivoting rib portion 406 take on a major portion of the load, a majority of the load or even all of the load as a method for limiting deflection beyond a predetermined deflection limit since this allows increased energy to be stored within the elastic material of pivoting rib portion 406 for increased snap back energy and reduced levels of lost motion.

Looking at deflected position 414, the outer portion of stiffening members 182 located between pivoting rib portion 406 and forward edge 220 is seen to be relatively straight. While some curved bending can occur, it can be significantly limited by the significantly vertical orientation of the side wall portions of scooped blade region 420. The vertically oriented side portions of scooped blade region 420 can function like I-beams which can reduce or prevent the portions of stiffening members 182 attached to scooped blade region 420 from flexing around a transverse axis and therefore, these portions of stiffening members 182 can remain significantly straight during use. If blade 184 is made sufficiently flexible to permit the outer portions of stiffening members 182 to bend significantly around a transverse axis during use, then scooped blade portion 420 would buckle or collapse under the compression forces applied to scooped blade portion 420 as stiffening members 182 take on an arched shape. If blade 184 is made sufficiently rigid enough to avoid collapsing or buckling in a longitudinal direction during use, then such rigidity can significantly reduce or prevent the outer portions of stiffening members 182 from flexing around a transverse axis during use. The outer portions of stiffening members 182 can be allowed to flex around a transverse axis during use by adding transverse flex zones within blade 184 to allow scooped blade region 420 to form a multi-faceted scooped shape so that longitudinal compression forces are focused strategically and excessive buckling or collapsing is reduced or avoided.

Because the method of using wide scoop 408 to allow blade 184 to move toward foot pocket 178 as blade region experiences deflection 416 without root portion 410 having to collide with foot pocket 178, longitudinal compression forces are reduced or avoided along blade 184, scooped blade portion 420 is allowed to form during deflection 416, and deflection 416 is allowed to occur. In addition, since blade 184 is able to move relative to foot pocket 178, scooped blade portion 420 is able to occupy the entire length of blade region 180.

In this embodiment, it is preferred that travel direction deflection 419 is at least 10 degrees under relatively light loading conditions such as created during a relatively light kicking stroke used to achieve a relatively slow to moderate swimming speed. Preferably, travel direction deflection 419 is between 10 and 70 degrees. Excellent results can occur when the flexibility of pivoting blade region 185 is arranged to permit travel direction deflection 419 to be between 20 and 50 degrees.

Figure 28:
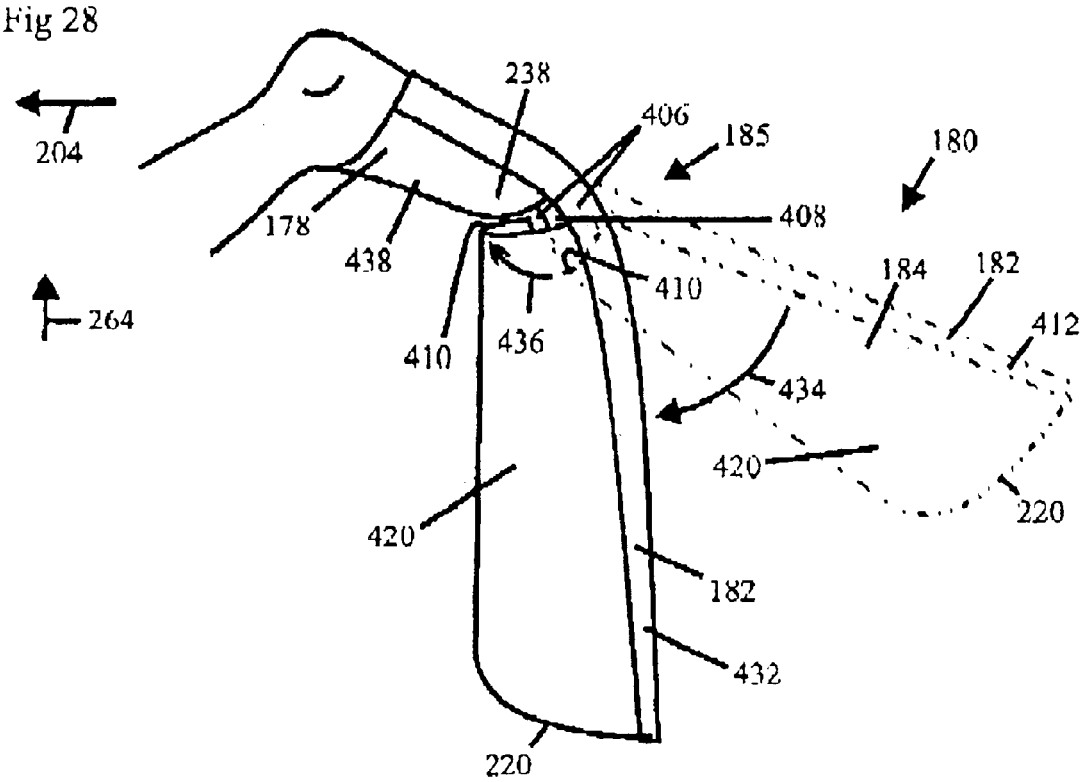
FIG. 28 shows the swim fin of FIG. 27 during an up stroke.

FIG. 28 shows the swim fin of FIG. 27 during an up stroke occurring in kick direction 264. Blade region is seen to have pivoted around a transverse axis from neutral position 412 to a deflected position 432 while experiencing a deflection 434. The shape of scooped blade region 420 is seen to have inverted under water pressure. As blade region 180 experiences deflection 434 from neutral position 412 to deflected position 432, root portion 410 is seen to experience a root portion movement 436 toward foot pocket 178. It is preferred that the longitudinal dimension of gap 408 is sufficiently enough to prevent root portion 410 from colliding with foot pocket 178. Because foot pocket 178 has a relatively soft portion 438, if root portion 410 were permitted to collide with soft portion 438, then root portion 410 would apply pressure to the swimmer's toes and, or instep to cause discomfort, chaffing, blistering, cramping or even injury during a hard kick. This is because a significant portion of the longitudinal compression forces applied to blade 184 by scooped blade portion 420 during deflection 434 would be applied to the soft unprotected tissues of the user's foot, particularly if blade 184 were sufficiently stiff to avoid collapsing or buckling under such longitudinal compression forces. It is preferred that the longitudinal dimension of gap 408 is sufficiently large enough to prevent root portion 410 from causing discomfort to the swimmer's foot during blade deflections.

Figure 29:
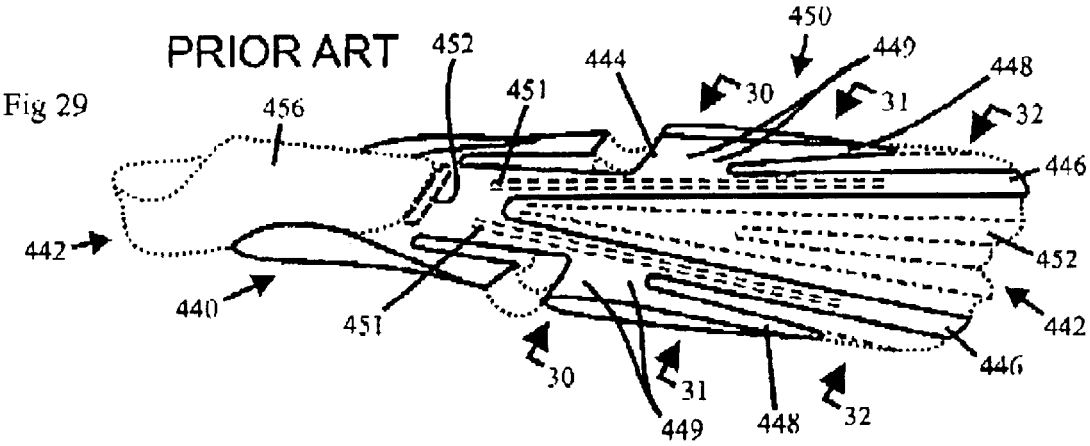
FIG. 29 shows a perspective view of a prior art swim fin.

FIG. 29 shows a perspective view of a prior art swim fin. A structure 440, shown by solid lines, is made with a relatively stiffer thermoplastic material. A structure 442 is shown by small dotted lines to illustrate where the soft thermoplastic rubber of is molded to the stiffer thermoplastic of structure 440. Structure 440 is molded first, and then structure 442 is molded onto structure 440. Structure 442 is illustrated with dotted lines so that the shape and construction of structure 440 can be viewed clearly. Structure 440 provides the stiffening structure for the fin. Forked ribs 444 within structure 440 have a branched configuration having inner branches 446 and outer branches 448 within a blade 450. In this prior art fin, the inner branches 446 are secured to outer branches 448 in a significantly rigid manner with a rigid connection 449 created during molding. Rigid connection 449 prevents inner branches 446 from flexing relative to outer branches 448 and does not enable blade 450 to form a longitudinal scoop shaped or channel shaped contour near forked ribs 444 nor along a major portion of blade 450 under the exertion of water pressure created during use. This prevents a major portion of blade 450 from forming a scoop. This structural problem shows that this problem itself or a solution for this problem is not present, not anticipated and not recognized. While this fin is advertised as attempting to form a channel, the structural problems of forked ribs 444 prevent most of blade 450 from forming a scoop shape and only the very tip of the fin between inner branches 446 are able to form a scoop. An inner membrane 452 located between inner branches 446 is only able to deflect slightly near the tip and no significant scoop shape is formed between inner branches 446 and outer branches 448. This significantly reduces the channeling capabilities of blade 450. Most of blade 450 either remains flat and forked ribs 444 even allows the outer side edges of blade 450 to deflect more than the central portions of the blade. This because the lower surface of inner branches 446 are reinforced with stiffening ribs 451, shown by dotted lines along inner branches 446. A flexible thermoplastic hinge 454 between blade 450 and a shoe 456 is not arranged to allow a major portion of blade 450 to deform significantly to form a substantially long scoop shape during use that is capable of channeling a significant amount of water.

Figure 30:
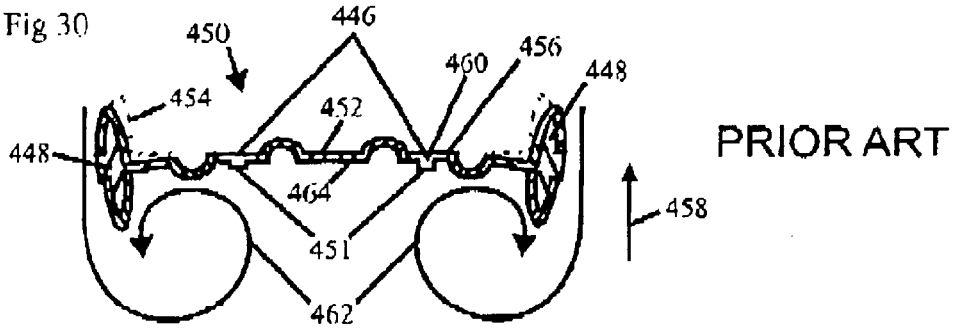
FIG. 30 shows a cross section view taken along the line 30—30 in FIG. 29.

FIG. 30 shows a cross section view taken along the line 30—30 in FIG. 29, which is near the midpoint of the length of blade 450. In FIG. 30, blade 450 is seen to have deformed from a neutral position 454 to a flexed position 456 under the load created during a kick direction 458. Kick direction causes water to strike an attacking surface 460 during this stroke. The outer side edges of blade 450 are seen to have deflected down slightly so that the attacking surface flexes to form a convex shape rather than a concave channel. Branches 448 are seen to flex slightly below inner branches 446 and a concave channel is not efficiently formed along this section of blade 450. Vortices 462 are seen by swirling arrows along a lee surface 464 during this stroke.

Figure 31:
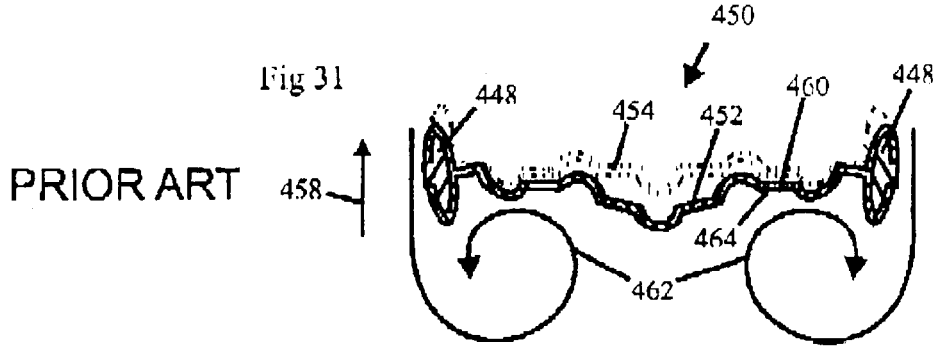
FIG. 31 shows a cross section view taken along the line 31—31 in FIG. 29.

FIG. 31 shows a cross section view taken along the line 31—31 in FIG. 29, which is approximately at the ¾ length position of blade 450. In FIG. 31, most of blade 450 remains significantly flat in deflected position 456 in comparison to neutral position 454.

Figure 32:
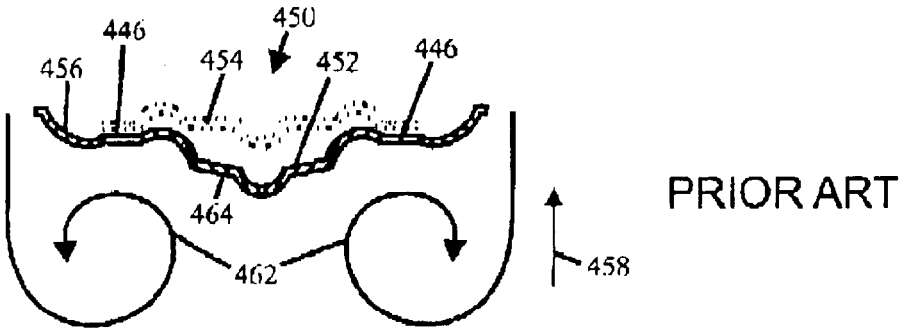
FIG. 32 shows a cross section view taken along the line 32—32 in FIG. 29.

FIG. 32 shows a cross section view taken along the line 32—32 in FIG. 29, which is at the outer tip portion of blade 450. In FIG. 32, it can be seen that at most, only the tip portions of blade 450 are able to form a channel shape.

Figure 33:
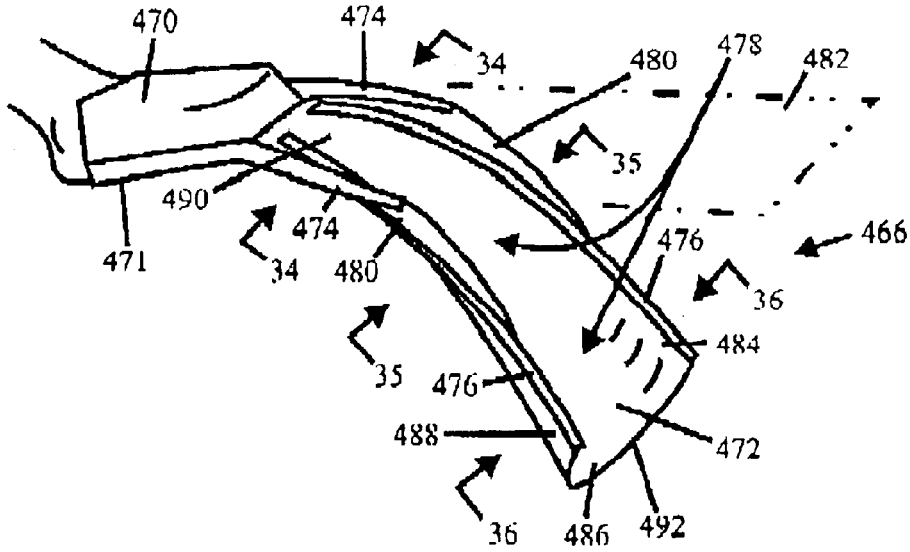
FIG. 33 shows a top view of a swim fin alternate embodiment of the present invention.

FIG. 33 shows a top view of a swim fin alternate embodiment of the present invention. This embodiment is arranged to permit a major portion of a blade 466 to bow during use to form a longitudinal channel 468 over a major length of the blade. Preferably, channel 468 is significantly deep enough to channel significantly more water when channel 468 is present due to blade 466 being in a bowed state than when channel 468 is not present. Blade 466 is connected to a foot attachment member 470. Member 470 has a stiffer portion 472 preferably made with a relatively stiffer thermoplastic material. Blade 466 has a flexible membrane-like portion 472 that is preferably made with a flexible thermoplastic material. Outer stiffening members 474 are connected to foot attachment member 470 and blade 466. Inner stiffening members 476 are connected to portion 472. Preferably, ribs 476 are made with a relatively stiffer thermoplastic material than portion 472. Portion 471, ribs 474 and ribs 476 can be made with the same stiffer thermoplastic material during one injection molding step to form an initial structure and portion 472 can be molded to such structure with a thermal-chemical bond and, or a mechanical bond, during a subsequent injection molding step. Inner stiffening members 476 are seen to extend to the outer side edges of the blade so as to permit the flexible blade to form a significantly wide scoop shaped channel between inner stiffening members 476. Inner stiffening members are pivotally connected in any suitable manner to foot attachment member 470 or to blade 466 in an area in front of member 470. In this example, the base of inner stiffening members 476 are seen to not be rigidly attached to member 470 and instead are separated from member 470 with region of flexible membrane-like portion 472 so that members 476 are able to pivot around a transverse axis to a reduced lengthwise angle of attack during use. Outer stiffening members 474 are shorter than inner stiffening members 476 and outer members 474 have a more rigid connection to member 470 so as to experience less pivotal motion around a transverse axis than inner ribs 476. The degree of flexibility, or rigidity, in outer members 474 is preferably selected to limit the deflection of inner stiffening members 476 and help to form a channel shaped depression 478 across a major length of blade 450 under the exertion of water pressure. Because inner stiffening members 476 are not rigidly connected to outer stiffening members 474, and because inner stiffening members 476 does not have rigidly attached branches or any other transversely stiffening member that could stiffen and flatten blade 466 in a transverse direction, the entire length of blade 466 is able to efficiently form channel shaped depression 478 to greatly increase the channeling capabilities of blade 466. As depression 478 forms during use, flexible panels 480 are seen to have pivoted upward in the opposite direction of water flow to reach a cupped orientation during use causing flexible panels 480 to form flexible side walls to channel 478. Flexible panels 480 can greatly improve the channeling capability and channeling capacity of blade 466. Flexible panels 480 in this embodiment are supported by the twisted orientation of ribs 474 and 476 and effectively support the formation of the concave shape of channel 478. Because inner stiffening members 476 are pivotally connected to blade 466 near foot attachment member 470, a major portion of blade 466 is able to pivot around a transverse axis to a lengthwise reduced angle of attack during use. Preferably, such a deflection around a transverse axis should be sufficient to significantly reduced kicking effort, sufficient to significantly reduce turbulence around the lee surface of blade 466, sufficient to significantly increase the amount of water pushed in the opposite direction of intended swimming, or sufficient to increase the formation of a lifting force directed substantially in the direction of intended swimming.

Both the reduced lengthwise angle of attack of blade 466 and the depression of channel 478 are viewable in FIG. 33 since blade 466 is seen to have deflected from a neutral position 482 to a deflected position 484. Blade 466 is seen to have an attacking surface 486, a lee surface 488, a root portion 490 and a free end 492.

In alternate embodiments, flexible panels 480 can include any type of reinforcement member or members, can be made with both flexible and stiffer materials, can be made with stiffer materials pivotally attached to ribs 474 and 476, can include pre-formed channels, can be bellows-shaped, can be expandable folded membranes, can have branched stiffening members that are pivotally connected to ribs 474 and/or 476 to permit relative movement thereof, can have reinforced outer edges and can be formed in any suitable manner and have any suitable shape. In this embodiment, panels 480 are part of flexible portion 472; however, panels 480 can be made with a separate material. Also, in alternate embodiments, ribs 474 and 476 can be connected to each other in any manner that permits some degree of independent flexibility between ribs 474 and 476 so that channel 478 can form along a major portion of blade 466.

In this embodiment, stiffening members 474 and 476 are seen to not bend significantly during use; however, in alternate embodiments, various levels of flexibility can be used for such members to allow them to arch during use. Preferably, such arching members would be made with high memory materials for maximum snapping motion at the end of a stroke. When less flexible members are used, spring-like tension can be created within panels 480 to snap back such members toward neutral position 482 at the end of a stroke.

Figure 34:
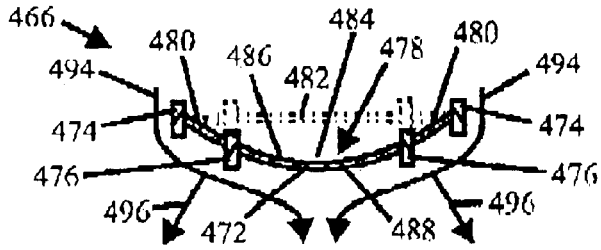
FIG. 34 shows a cross sectional view taken along the line 34—34 in FIG. 33.

FIG. 34 shows a cross sectional view taken along the line 34—34 in FIG. 33, which is near the one quarter length position of blade 466. In FIG. 33, channel 478 can be seen between neutral position 482 and deflected position 484. Lee surface flow 494 is seen by arrows around lee surface 488. The transverse bowing along blade 466 orients panels 480 to cup so that the portions of lee surface 488 along panels 480 are oriented at a transverse reduced angle of attack which can reduced turbulence and separation so that smoother flow occurs around lee surface 488. Smooth curving flow can produce a lifting force 496 along lee surface 488 to significantly increase propulsion and efficiency. Because the width of the scoop is significantly wide in this embodiment, lee surface 488 of blade 466 has an increased convex curvature and attacking surface 486 is able to form an increased concave curvature for greatly increased flow capacity in channel 478.

Figure 35:
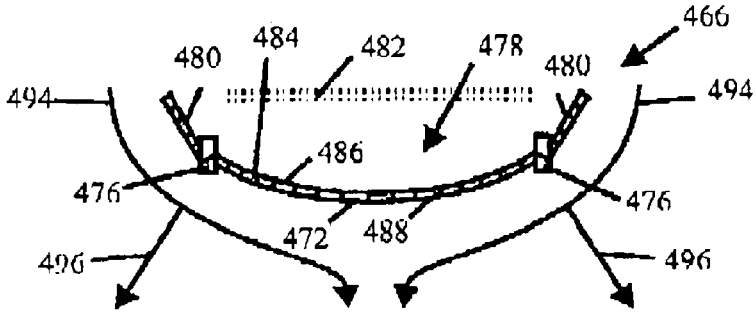
FIG. 35 shows a cross sectional view taken along the line 35—35 in FIG. 33

FIG. 35 shows a cross sectional view taken along the line 35—35 in FIG. 33 near the midpoint of the length of blade 466. In FIG. 35, channel 478 is significantly increased over a larger portion of the blade length and is significantly improved over prior art. Panels 480 are seen to act as walls to channel 478. The outer edges of panels 480 are able to remain aimed against the direction of oncoming flow 494 even though the outer edges are flexible, even though such outer side edges are made with flexible material in this embodiment. This greatly increases water channeling and the methods disclosed allow the flexible outer side edges to remain cupped in the direction of water flow without requiring additional reinforcement at the outer side edges. In alternate embodiments, the outer side edges of panels 480 can use any suitable reinforcement if desired. Such reinforcement can include a region of increased thickness, a bead, rib, rod, strip, chord, strap, tape, thread, cable, fabric, additional material, expandable material, extensible material, elastic material, or any other desired material or member.

Figure 36:
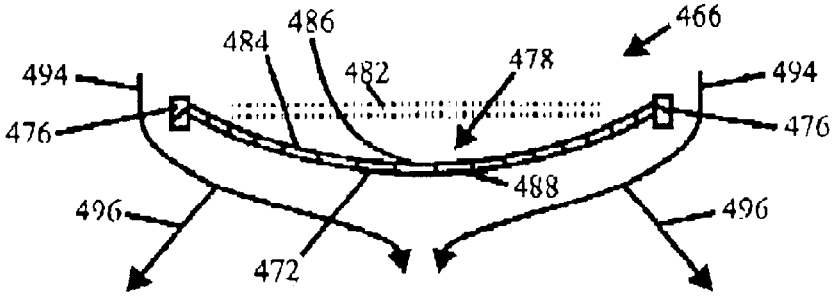
FIG. 36 shows a cross sectional view taken along the line 36—36 in FIG. 33.

FIG. 36 shows a cross sectional view taken along the line 36—36 in FIG. 33. In FIG. 36, channel 478 is significantly wide. Channel 478 covers a significantly large portion of the overall length of blade 466.

Figure 37:
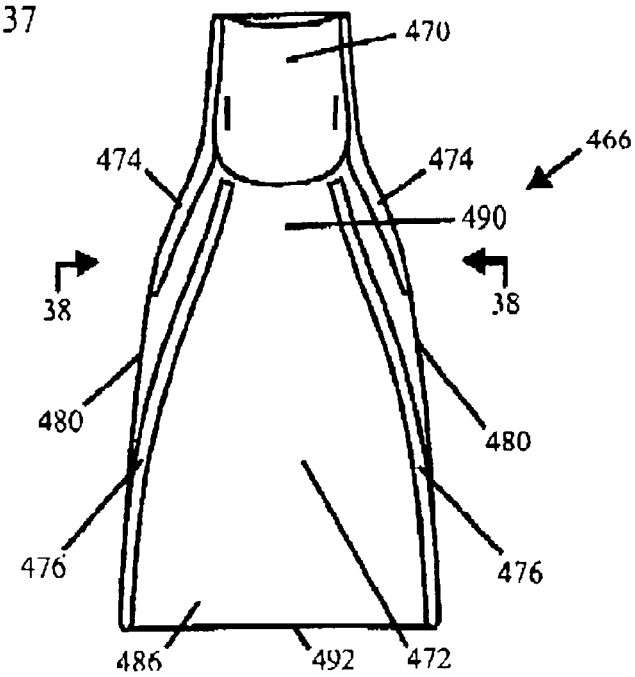
FIG. 37 shows a top view of the swim fin shown in FIGS. 33 to 36.

FIG. 37 shows a top view of the swim fin shown in FIGS. 33 to 36.

Figure 38A:
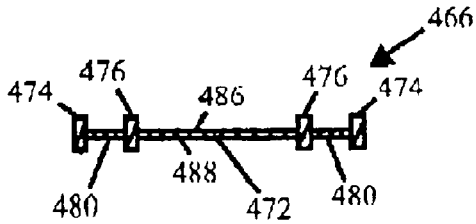
FIGS. 38*a* to 38*d* show alternate embodiment cross section views taken along the line 38—38 in FIG. 37.
Figure 38B:
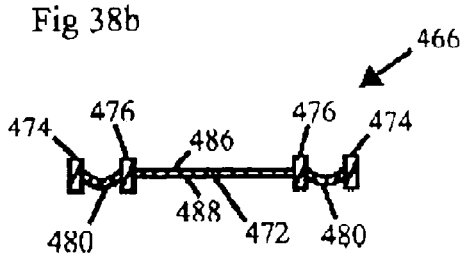
Figure 38C:
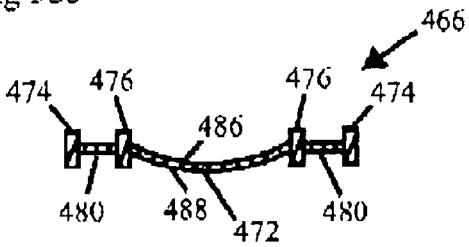
Figure 38D:
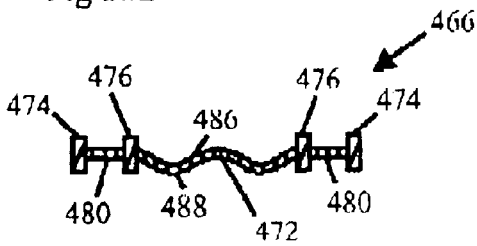

FIGS. 38*a* to 38*b* show alternate embodiment cross section views taken along the line 38—38 in FIG. 37 while the swim fin is at rest. In FIG. 38*a*, portion 472 and panels 480 are significantly flat. In FIG. 38*b*, portion 472 is flat and panels 480 are folded to permit a predetermined amount of extensibility during use to increase the depth of a channel during use. In this embodiment, panels 480 have a pre-formed channel shape that is concave up. In FIG. 38*c*, panels 480 are seen to be flat and portion 472 has a pre-formed channel shaped contour that can expand during use to increase the depth of a bowed channel under water pressure. In FIG. 38*d*, portion 472 has a series of bellows like folds to permit similar deflections on either stroke. Panels 480 and, or portion 472 can have any number of folds, curves, channels, corrugations, convex curves, concave channels, ridges, expandable zones, extensible zones, degrees of curvature, pre-formed shapes and may have any desired contour.

Figure 39:
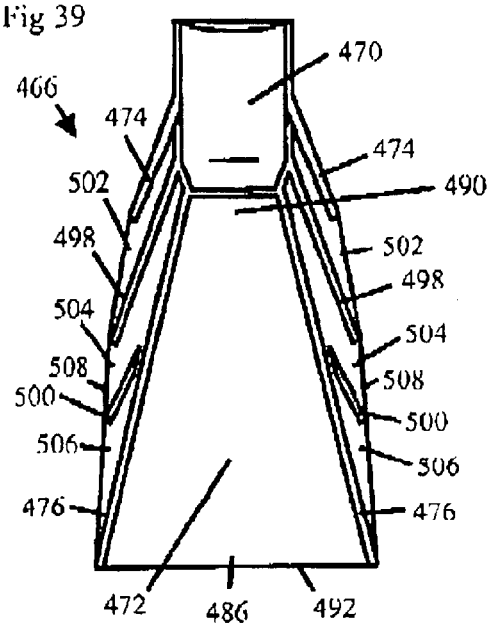
FIG. 39 shows a top view of an alternate embodiment swim fin.

FIG. 39 shows a top view of an alternate embodiment of the same swim fin shown in FIGS. 33 to 38 in which additional ribs are added. In this embodiment, inner stiffening members 476 are directly connected to stiffer portion 471 of foot attachment member 470 so that these parts are easy to load in one step into the second mold which forms flexible portion 472 and the soft portions of foot attachment member 470 in a subsequent molding step. It is preferred that when inner stiffening members 476 are connected to portion foot pocket with a flexible connection I in between which permits pivotal motion. Such a flexible connection can be any type of pivotal connection including a region of reduced thickness, a region of reduced material, a strip, a chord, a flange, a region having flexible material disposed within for increased flexibility, a mechanical connection or a removable connection. Alternatively, ribs 476 can be rigidly connected to foot attachment member 470 and then have a region of increased flexibility disposed in stiffening members 476 at a location spaced from or in front of foot attachment member 470. In between outer stiffening members 474 and inner stiffening members 476 are intermediate ribs 498 and branched ribs 500. Intermediate ribs 498 are connected to portion 471 in this embodiment; however, ribs 498 may be connected to the swim fin in any manner that permits relative motion. Branched ribs 500 are pivotally connected to inner stiffening members 476 in any suitable manner.

In between outer members 474 and intermediate ribs 498 is a first flexible panel 502. In between intermediate ribs 498 and branched ribs 500 is a second flexible panel 504. In between branched ribs 500 and inner stiffening members 476 is a third flexible panel 506. Blade 466 is seen to have outer side edges 508. By increasing the number of stiffening members or ribs with the addition of intermediate ribs 498 and branched ribs 500, the transverse contour of channel 478 becomes more curved and rounded by increasing the number of segments or facets. Branched ribs 500 are shown to be branching off of inner stiffening members 476 as an example, that additional ribs can be added by creating a branch off of any rib. Branches can have sub-branches and can be more flexible, more rigid, or have the same flexibility as parent branches. Alternate embodiments can use any number of branched members and sub-branched members.

Figure 40:
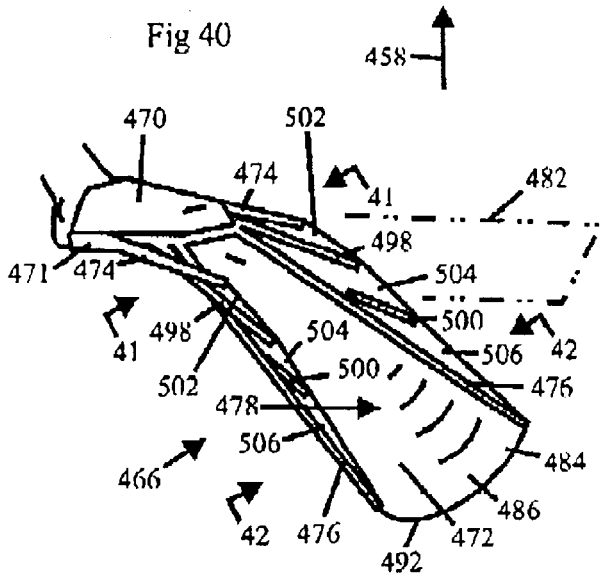
FIG. 40 shows a perspective view of the swim fin in FIG. 39 during a kicking stroke.

FIG. 40 shows a perspective view of the swim fin in FIG. 39 during a kicking stroke. In FIG. 40, the scoop shape is wide and deep while along a major portion of the overall length of blade 466. Panels 502, 504 and 506 are seen to twist upward to form a cupping shape relative to the central portions of blade 466. The methods of the present invention allows channel 478 to form as blade 466 flexes to a reduced angle of attack around a transverse axis. Outer members 474 help to limit the overall deflection of blade 466 around a transverse axis to a predetermined limit, and also serve to hold outer edges 508 upward as the more central portions of blade 466 deflect downward. This causes outer edges 508 of blade 466 to curl upward relative to the central portions of blade 466 and along a major portion of the length of blade 466 so as to form channel 478 along a major portion of the length of blade 466. This allows long and deep channels to be formed along blade 466 while blade 466 deflects to a significantly reduced angle of attack around a transverse axis with significant reductions or even elimination of crumpling, buckling, wrinkling or reverse curling within blade 466 as blade 466 reaches significantly reduced angles of attack during use.

Figure 41:
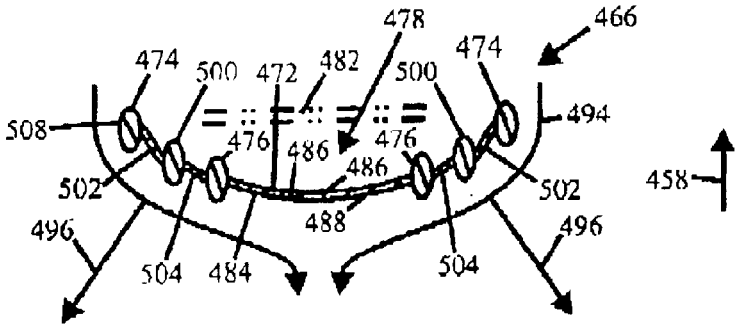
FIG. 41 shows a cross sectional view taken along the line 41—41 in FIG. 40.

FIG. 41 shows a cross sectional view taken along the line 41—41 in FIG. 40. Fin FIG. 41, channel 478 is wide and deep while lee surface 488 is convexly curved to reduce turbulence and drag. FIG. 41 shows that three angled stiffening members at this location along blade 466 can cause a more gradual curvature. Panels 502 and 504 are capable of twisting to different angles of attack and forming a multi-faceted contour. Increased curvature can create a curved flow path that is capable of increasing lift 496 and further reducing turbulence and drag. In this embodiment, ribs 474, 476, 498 and 500 are seen to be oval; however, any cross sectional shape may be used including round, rounded, circular, multi-faceted, rectangular, planar, channeled, or any other suitable cross sectional shape.

Figure 42:
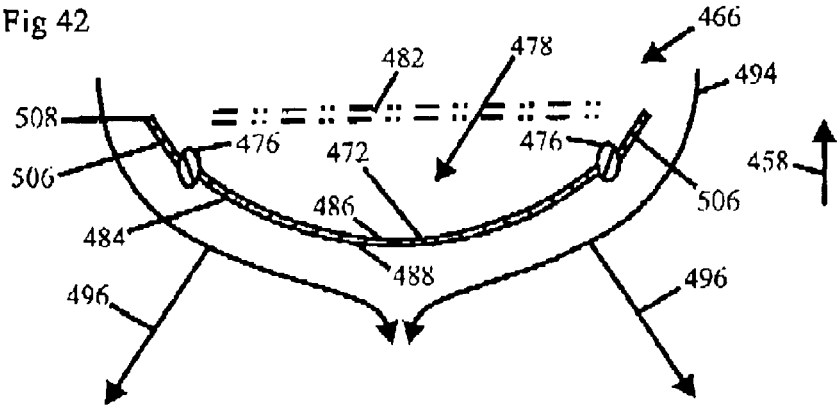
FIG. 42 shows a cross sectional view taken along the line 42—42 in FIG. 40.

FIG. 42 shows a cross sectional view taken along the line 42—42 in FIG. 40. Channel 478 is capable of being wide and deep while the low pressure surface is convexly curved to reduce turbulence and drag.

Figure 43:
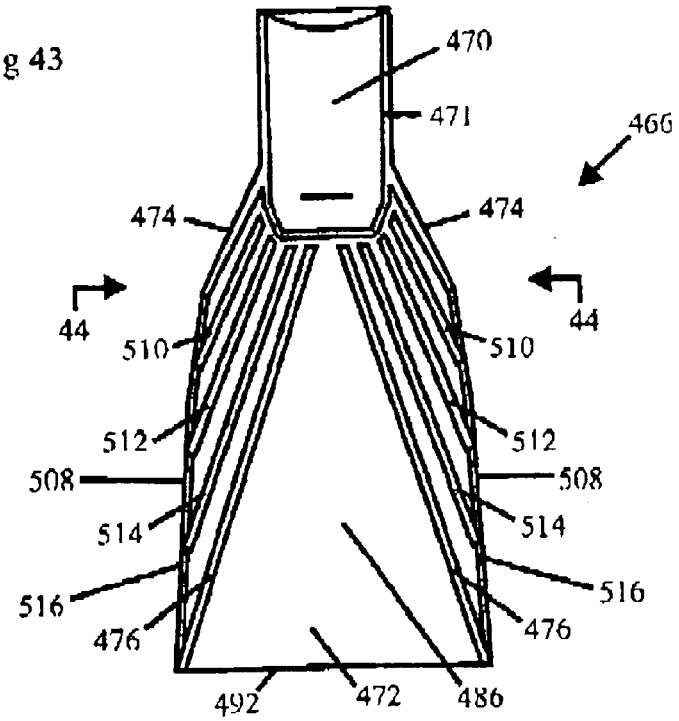
FIG. 43 shows a top view of an alternate embodiment swim fin.
Figure 44A:
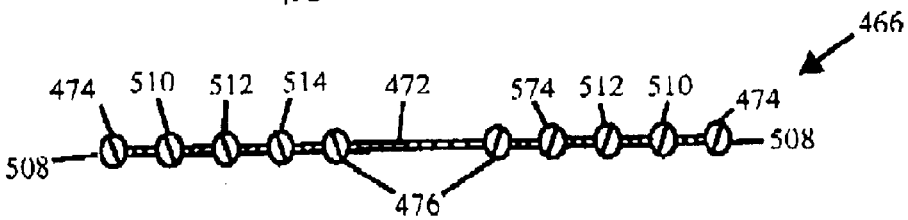
FIGS. 44*a* to 44*d* show alternate embodiment cross sectional views of taken along the line 44—44 in FIG. 43.
Figure 44B:
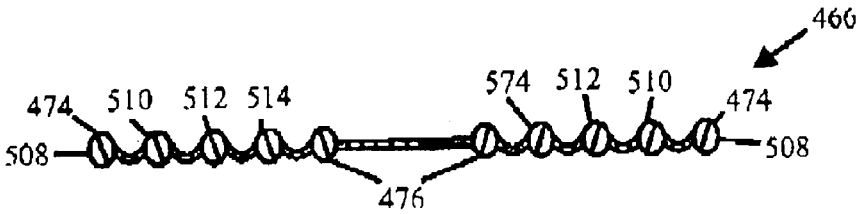
Figure 44C:
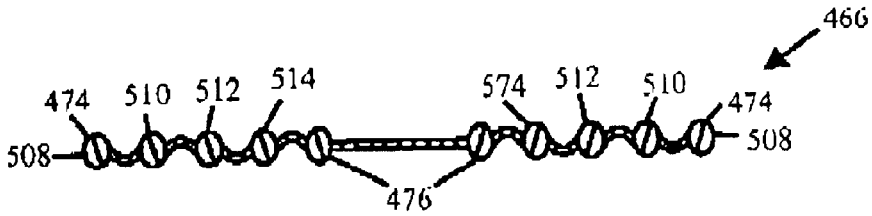
Figure 44D:
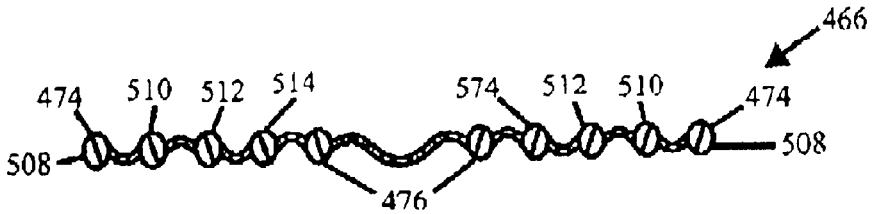

FIG. 43 shows a top view of an alternate embodiment of the swim fin shown in FIG. 33. In FIG. 43, additional ribs are added. Inner stiffening members 476 are located closer to the center of blade 466 in order to make room for additional staggered angled ribs behind them. In between outer stiffening members 474 and inner stiffening members 476, are second ribs 510, third ribs 512 and fourth ribs 514. Outer edge 508 is seen to have a bead 516, which in this embodiment, is a thickened portion of the flexible material used to make flexible portion 472. Bead 508 can be used to help reduce or prevent outer side edges 508 from stretching to undesirable levels during use. Bead 508 can also be used to act as a cable to add support and increased stability to edges 508 for greater control and efficiency. Bead 508 can also be used to reinforce edges 508 to prevent tearing or cutting. Bead can also be made with a separate material and can have any desirable cross sectional shape.

FIGS. 44*a* to 44*d* show alternate embodiment cross sectional views of taken along the line 44—44 in FIG. 43. These cross section show just a few of the many possibilities for including flat or curved portions within blade 466. When folds are used within flexible portion 472, a predetermined degree of looseness can be planned into each fold to permit a predetermined amount of expansion or extension to occur, which can allow blade 466 to form a larger longitudinal channel as it bows between outer side edges 508 during use. The degree of inward bending and, or the use of expandable zones and, or the degree of lengthwise bending around a transverse axis can be adjusted and arranged to limit deflection 484 to a predetermined angle or range of movement. Preferably, deflection 484 is sufficient to increase the efficiency of the fin, but not so excessive as to cause a loss of efficiency from excessive levels of lost motion between strokes.

FIG. 45 shows a perspective view of the swim fin shown in FIG. 43 during a kicking stroke. Outer ribs 474 may be arranged to be flexible around a vertical axis so that they flex inward during use as blade 466 deflects to form channel 478. This causes outer edges 508 of blade 466 to curl inward as it curls upward. The more the inward flexing of outer ribs 474, the more that outer edges 508 curls inward. This increases the depth of the scoop of channel 478, increases smooth flow around outer side edges 508 and along lee surface, and can also be used to create a counter vortex 518 inward of outer side edges 508 relative to attacking surface 460, which spins in the opposite direction of the induced drag vortices. Such counter vortices can reduce outward sideways flow away from the attacking surface and can also be used to encourage inward flow conditions for increased flow into the channel and upwash conditions adjacent free end 492.

As outer members 474 flex inward, second ribs 510 are pulled inward as well, but not as much as members 474. This also causes third ribs 512 to pull inward, but not as much as second ribs 510. This in turn causes fourth 514 ribs to pull inward, but not as much as much as thirds ribs 512. This causes ribs 474, 510, 512, 514, and 476 to form a spiral-like condition which causes channel 478 to form efficiently and deep along a major portion of the length of blade 466. This spiral like formation causes channel 478 to have a substantially rounded or curved contour which can increase efficiency, channeling, and propulsion while reducing drag, turbulence and kicking effort. The spiral formation provides an efficient channel shape as blade 466 deflects to a significantly reduced angle of attack around a transverse axis. The spiral formation is more descriptive than extreme. Any degree of converging or curling formation can occur to form channel 478 and channel 478 can have any cross sectional shape. As outer members 474 flex inward, spring tension can be arranged to snap members 474 and other ribs back toward neutral position 482 at the end of a stroke. A hinge member 519 is seen between foot attachment member 470 and ribs 510, 512, 514, and inner members 476. Hinge member 519 can be any suitable pivotal connection. Hinge member 519 can be a region of reduced material, a region of flexible material connected to the ribs or blade 466 with a chemical and, or mechanical bond, a region of reduced thickness, a gap, a gap filled with flexible material, a small flange or chord of stiffer material that is sufficiently small enough to be flexible, a small flange or chord covered on one or multiple sides with a flexible material, a mechanical hinge, a living hinge, a thermoplastic hinge, or any other suitable medium. Hinge 519 can be any distance from the toe portion of foot attachment member 470 and can have any desired alignment or shape.

The methods of the present invention using staggered ribs along the sides of a blade permit the blade to flex to a significantly reduced lengthwise angle of attack around a transverse axis while also forming a long channel, and also permits these to be formed in an organized manner that reduces or eliminates the tendency for the blade to collapse, buckle, bunch up, bend in the opposite direction of the intended channel, or the tendency for the blade to only form a scoop or transverse pivoting at the expense of the other. This is a major improvement over the prior art. The staggered lengths, or varied lengths, of the ribs allows stress forces in the blade to be organized, distributed and relieved rather than focused and built up. Preferably, the staggered ribs are angled (at an angle to the lengthwise alignment of the blade) to cause a twisting or spiraled type of orientation; however, in alternate embodiments some or all of the staggered ribs can be longitudinal, transverse, or even convergent relative to the lengthwise alignment of the blade. The alignment of each staggered rib can also vary along the length of the blade in any manner. For example, the ribs located at the rear of the fin near the foot pocket can extend in an outward sideways manner away from the foot pocket while ribs in forward of such sideways ribs are angled with more longitudinal component or even an increasing longitudinal component across the length of the blade. By allowing the staggered ribs to be relatively rigid, buckling is significantly reduced or eliminated during use. The staggered ribs can also be made significantly flexible. Buckling is still reduced since flexing occurs in steps due to the staggered ribs. Other methods disclosed in the above specification can be combined with these alternate embodiments to reduce or eliminate buckling if some degree occurs with a particular configuration, especially if high levels of arching are present.

In alternate embodiments, any number of ribs can be connected to each other in any configuration. Paired ribs on either side of a fin can be connected or bridged together in any manner if desired.

FIG. 46 shows a cross sectional view taken along the line 46—46 in FIG. 45. The broken line shows the shape of the blade if inward flexing is reduced or eliminated. If inward flexing is eliminated then expandable folds can be located between the ribs to permit expansion during use for increasing channel depth. A combination of folds and inward flexing as well as transverse flexing can be created in any combination, configuration, variation, amount or individual degree.

FIG. 47 shows a cross sectional view taken along the line 47—47 in FIG. 45. FIG. 48 shows a cross sectional view taken along the line 48—48 in FIG. 45. These cross sectional views show channel 458 forms along a major portion of the overall length of blade 466, and preferably along a majority of the overall length of blade 466.

Figure 49:
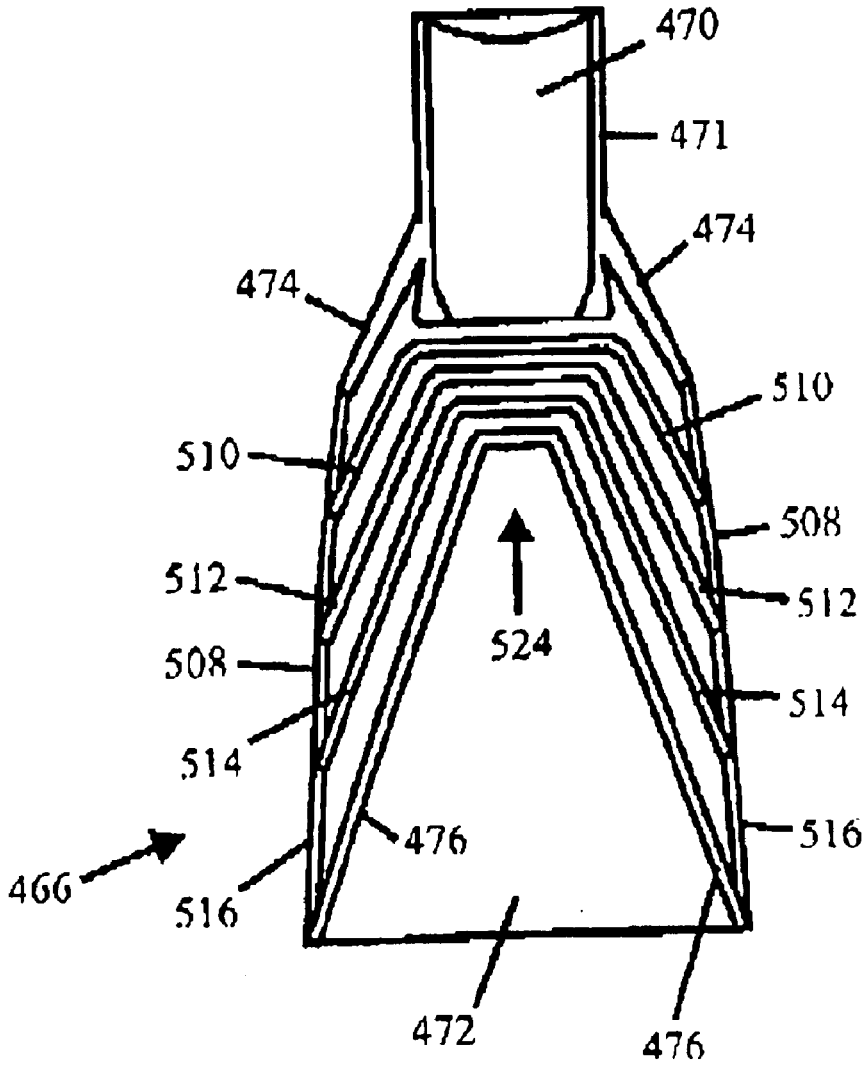
FIG. 49 shows a top view of an alternate embodiment swim fin.

FIG. 49 shows an alternate embodiment of the swim fin shown in FIG. 45 in which paired ribs 510, 512, 514 and 476 are connected to each other across the width of blade 466 by a series of bridges 524. Any number of bridges 524 can be connected to each other or to foot attachment member 470 with a flexible flange that permits relative movement. The flexible portion between each of bridges 524 can act as a series of transverse hinge elements. In alternate embodiments, bridges 524 can be connected to each other with a flexible blade portion or a semi rigid blade portion, or even a rigid blade portion.

Figure 50:
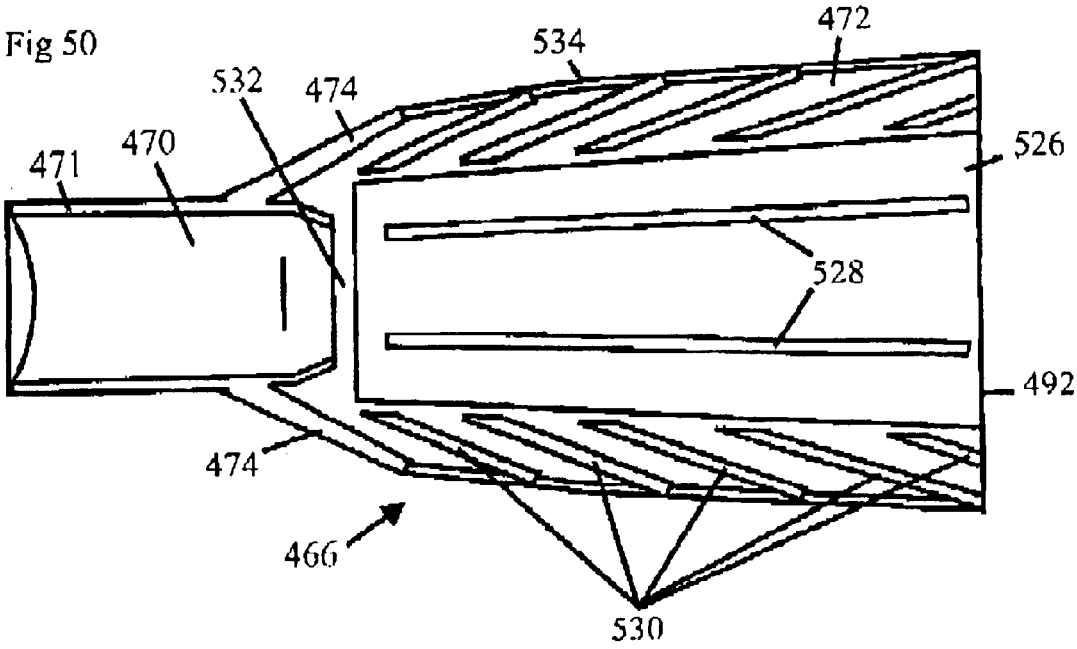
FIG. 50 shows a top view of an alternate embodiment swim fin.

FIG. 50 shows a top view of an alternate embodiment of the swim fin shown in FIG. 45. In FIG. 50, a pivoting central blade portion 526 is designed to pivot around a transverse axis relative to foot attachment member 470. Blade portion 526 is preferably made with a resilient thermoplastic material having a high level of elastic memory. Possible materials include polypropylene, Pebax®, polyurethanes, thermoplastic elastomers, carbon fiber laminates, high memory thermoplastics or any other suitable material. Portion 526 is seen to have two longitudinal ribs 528; however, any number of such ribs or no longitudinal ribs can be used. Portion 526 can be flat or can have pre-formed channels within at least one surface. Ribs 528 can be made with a flexible thermoplastic material connected to portion 526 with a chemical and, or mechanical bond. Ribs 528 can also be a thickened region within portion 526. Ribs 528 are preferably arranged to control the flexibility and, or rigidity of portion 526 as well as increase snap back by storing extra energy. In alternate embodiments, flexible or expandable inserts can be disposed within portion 526.

Outer ribs 474 are less movable than blade 466 about a transverse axis. A series of staggered angled ribs 530 are seen between outer stiffening members 474 and free end 492. Flexible portion 472 is located between ribs 530. Ribs 530 are connected to portion 526 in any suitable manner that allows relative movement in a pivotal manner about a substantially lengthwise axis. A hinge member 532 is located between portion 526 and foot attachment member 470. Hinge member 532 in this embodiment includes a region of flexible portion 472; however, hinge 532 can be any type of pivotal connection.

Figure 51:
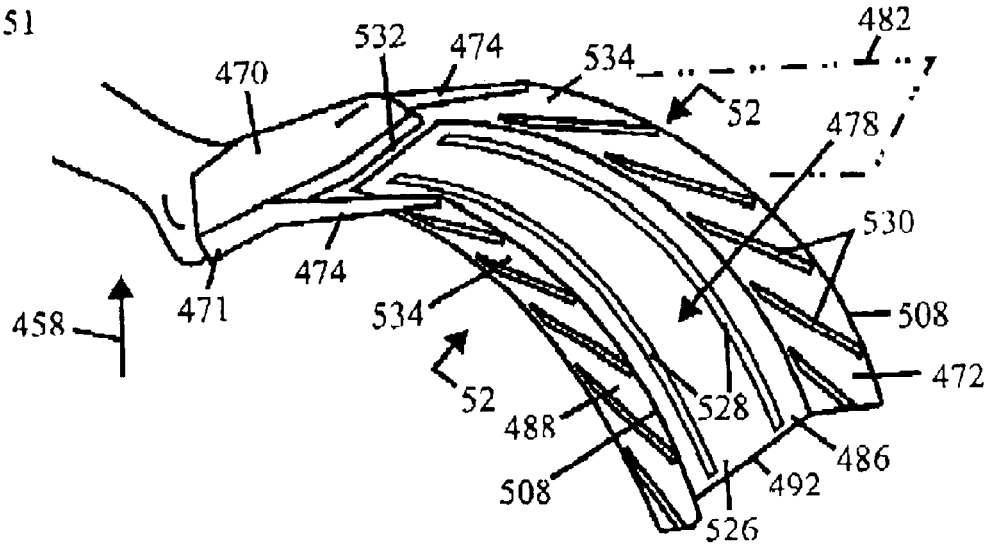
FIG. 51 shows a perspective view of the swim fin shown in FIG. 49 during use.

FIG. 51 shows a perspective view of the swim fin shown in FIG. 50 during use. Angled ribs 526 are seen to form channel 478 along the length of blade 466 as the blade pivots or flexes around a transverse axis to a lengthwise reduced angle of attack. Preferably, the angle of attack is sufficient to increase efficiency. Angle ribs 530 are seen to curl inward to form channel 478 relative to attacking surface 486. This shape inverts itself when kick direction 458 is reversed so that channel 478 forms on both reciprocating stroke directions, just as occurs with many of the other disclosed embodiments of the present invention. Ribs 530 are seen to curl upward to form sidewalls 534 that create channel 478

The method of the present invention can also be used to create opposing channel shaped deflections simultaneously if portion 526 is arranged have sufficient flexibility to form an S-shaped sinusoidal wave having two opposing faces during constant stroke inversions.

Figure 52:
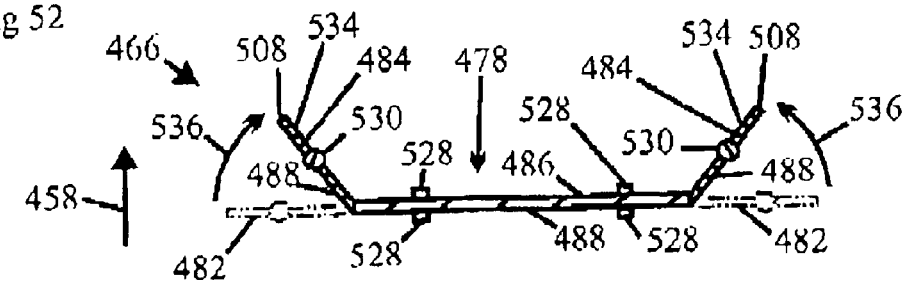
FIG. 52 shows a cross sectional view taken along the line 51—51 in FIG. 50.

FIG. 52 shows a cross sectional view taken along the line 52—52 in FIG. 50. Channel 478 is seen to be is multi-faceted. Sidewalls 534 are seen to experience a deflection 536 from neutral position 482 to deflected position 484.

FIGS. 53 to 58 show various alternate embodiments. A wide variety of shapes and configurations can be used. These include initial stiffening ribs that extend laterally along the sides of the foot pocket and inner ribs are arranged to experience more pivotal motion than the initial ribs. A large scoop shape can be formed which does not collapse as the blade pivots or bends around a transverse axis to a significantly reduced angle of attack.

Figure 53:
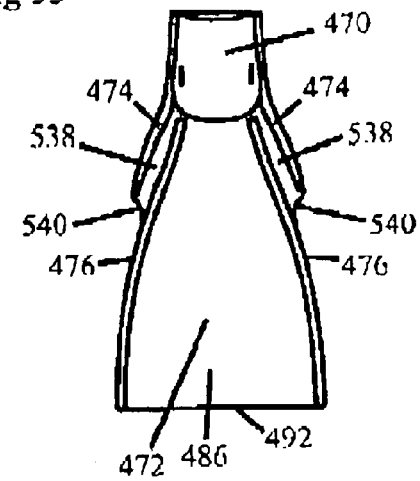
FIGS. 53 to 58 show various alternate embodiment swim fins.

In FIG. 53, a short flexible membrane 538 is located between outer members 474 and inner members 476. Membrane 538 is seen to have a scalloped outer edge 540 which terminates into members 476.

Figure 54:
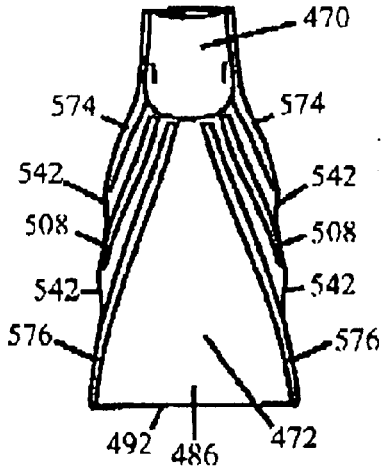

In FIG. 54, outer edge 508 has a series of scalloped edges 542.

Figure 55:
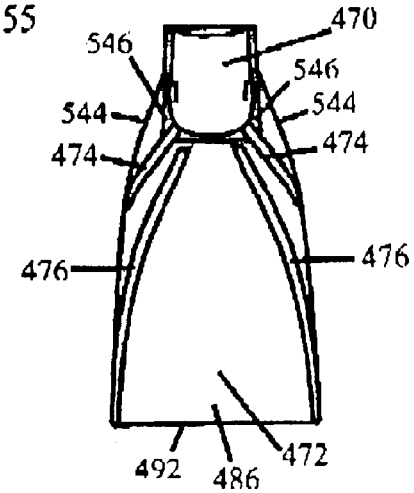

In FIG. 55, an rear flexible panel 544 is located behind members 474. Members 474 are connected to a platform 546 which is connected to foot attachment member 470.

Figure 56:
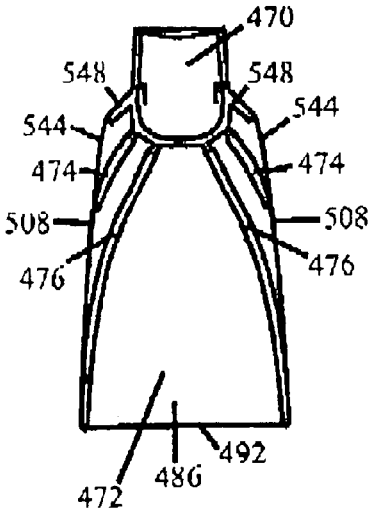

FIG. 56 is an alternate embodiment of the fin shown in FIG. 55. In FIG. 56, rear stiffening members 548 are located behind panels 544 and outer members 474. This allows the cupping action to begin farther back along side or closer to foot attachment member 470. Members 548 are rigidly attached to foot pocket 470 while members 474 and 476 are pivotally attached to foot pocket 470 with a flexible strip-like connection.

Figure 57:
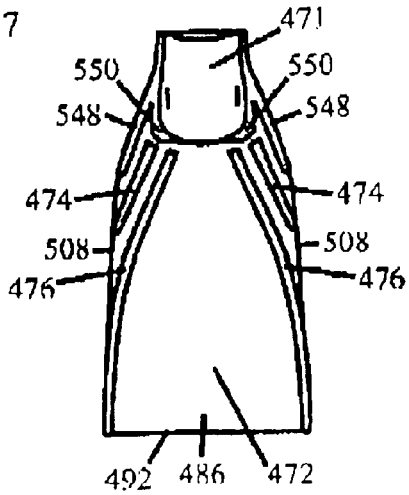

FIG. 57 is an alternate embodiment of the fin in FIG. 56. In FIG. 57, the fin is designed to begin cupping further back along foot attachment member 470. Members 548 are rigidly attached to foot pocket 470 while members 474 and 476 are pivotally attached to foot pocket 470 with a flexible material being used as a hinge. A platform 550 is used along the front of foot pocket 470 to control the position of the hinge and pivotal movement.

Figure 58:
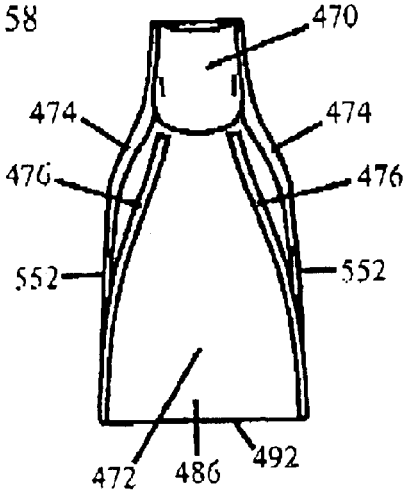

In FIG. 58, members 474 are curved and are connected to members 476 with a flexible chord 552 that permits relative movement. Flexible chord 552 can alternatively be a relatively stiff rib that has a jointed connecting on one or both ends of chord 552, or any type of flexible connecting to permit relative motion at one end or both ends of chord 552.

Summary, Ramifications, and Scope

Accordingly, the reader will see that the methods of the present invention can be used to permit scooped swim fin blades to flex around a transverse axis to a significantly reduced angle of attack while reducing or preventing the scooped portion of the blade from collapsing or buckling under the longitudinal compression forces exerted on the scooped portion during a large scale blade deflection. Although it is preferred that the blade or hydrofoil is at a relatively high deflection during use, any of the methods or structures disclosed can be used with hydrofoils or blades at a relatively low deflection during use. Lower deflections and, or higher angles of attacks can be used as well.

One of the numerous methods disclosed includes:

(a) providing the hydrofoil with a blade member connected to a predetermined body, the blade member having an attacking surface, a lee surface, outer side edges, a root portion near the predetermined body and a free end portion spaced from the predetermined body, the blade member having a predetermined length between the root portion and the free end portion, the blade member having a longitudinal midpoint between the root portion and the free end portion, the blade member having a first half blade portion between the root portion and the longitudinal midpoint and a second half portion between the longitudinal midpoint and the free end portion, the blade member having sufficient flexibility to bow between the outer side edges to form a longitudinal channel shaped contour, the longitudinal channel shaped contour extends from the free end portion toward the root portion to base of the longitudinal channel shaped contour, the base being located a predetermined distance from the predetermined body, the longitudinal channel shaped contour having a predetermined longitudinal dimension between the free end portion and the base;

(b) providing the first half blade portion of the blade member with sufficient flexibility to experience a predetermined lengthwise deflection from a predetermined neutral orientation to a predetermined reduced lengthwise angle of attack around a transverse axis during use, the transverse axis being located within the first half portion of the blade member;

(c) providing the blade member with sufficient spring-like tension during the predetermined lengthwise deflection so as to permit the blade member to experience a significantly strong snapping motion from the predetermined lengthwise deflection toward the predetermined neutral position;

(d) controlling the build up of longitudinally directed compression forces within the blade member sufficiently to permit the predetermined longitudinal dimension of the channel shaped contour to extend over a majority of the predetermined length of the blade member as the channel shaped contour experiences the predetermined lengthwise deflection to the predetermined reduced lengthwise angle of attack during use.

Some of the methods include using:

a region of reduced material is disposed within the blade member near the base of the longitudinal channel shaped contour, the region of reduced material being arranged to permit the blade member to move sufficiently toward the predetermined body during the predetermined lengthwise deflection to significantly reduce the tendency for the blade member to experience lengthwise buckling between the base of the channel and the free end portion of the blade member;

a region of reduced material is a flexible region of reduced thickness within the blade member arranged to buckle around a relatively small radius near the base of the channel so as to relieve the longitudinally directed compression forces created within the channel shaped contour during the lengthwise deflection;

a region of reduced material is a gap having sufficient longitudinal dimension to prevent the blade member from pressing excessively against the predetermined body;

a plurality of angled stiffening members are disposed within the blade member and arranged to substantially reduce the tendency for the blade member to experience excessive buckling along the predetermined longitudinal dimension of the channel shaped contour;

a plurality of stiffening members are disposed within the blade member and arranged in a substantially staggered manner to substantially reduce the tendency for the blade member to experience excessive buckling along the predetermined longitudinal dimension of the channel shaped contour;

a blade member having a lengthwise alignment and at least one of the plurality of stiffening members being oriented at an angle to the lengthwise alignment;

two elongated stiffening members connected to the blade member near the outer side edges, the elongated stiffening members having at least one notch;

elongated stiffening members formed within a thermoplastic material having a significantly high modulus of elasticity at the notch;

two elongated stiffening members are connected to the blade member near the outer side edges, the elongated stiffening members having an upper surface portion and a lower surface portion, the upper surface portion having a upper surface notch, the upper surface notch having an upper notch longitudinal dimension and an upper notch vertical depth, the ratio between the upper notch longitudinal dimension and the upper notch vertical depth being at least 3 to 1;

a lower surface portion of the elongated stiffening members having a lower surface notch with a lower notch longitudinal dimension and a lower notch vertical depth, the lower notch longitudinal dimension being different than the upper notch longitudinal dimension;

a lower surface portion of the elongated stiffening members have a lower surface notch having a lower notch longitudinal dimension and a lower notch vertical depth, the lower notch vertical depth being different than the upper notch vertical depth;

notch is near the base of the channel;

numerous other methods are disclosed in the above description and specification.

Although the description above contains many specificities, these should not be construed as limiting the scope of the invention but as merely providing illustrations of some of the presently preferred embodiments of this invention.

In addition, any and, or all of the embodiments, features, methods and individual variations discussed in the above description may be interchanged and combined with one another in any order, amount, arrangement, and configuration. Any blade portion may contain any type of void, split, vent, opening, recess, or material insert. Any method for reducing or alleviating longitudinal compression forces within a scooped blade may be used to reduce or prevent the scooped blade from collapsing, buckling or deforming excessively as the scooped blade experiences a significantly large deflection around a transverse axis during use. Any method may be used for increasing the lengthwise dimension of a scooped shape blade as such blade experiences a deflection to a reduced angle of attack around a transverse axis during use.

Any of the methods, features and designs of the present invention may be used on any type of foil device, including, but not limited to hydrofoils, paddles, propellers, foils, airfoils, hydrofoils, blades, stabilizers, control surfaces, reciprocating hydrofoils, monofins, scuba fins, fitness fins, surf fins, snorkel fins, hand paddles, swimming paddles, reciprocating propulsions systems, rotating propulsion systems, or any other fluid flow controlling device.

Accordingly, the scope of the invention should not be determined not by the embodiments illustrated, but by the appended claims and their legal equivalents.

I claim:

1. A method for providing a propulsion hydrofoil, comprising:

(a) providing said hydrofoil with a blade member connected to a predetermined body, said blade member having an attacking surface, a lee surface, outer side edges, a root portion near said predetermined body and a free end portion spaced from said predetermined body, said blade member having a predetermined length between said root portion and said free end portion, said blade member having a longitudinal midpoint between said root portion and said free end portion, said blade member having a first half blade portion between said root portion and said longitudinal midpoint and a second half portion between said longitudinal midpoint and said free end portion, said blade member having sufficient flexibility to bow between said outer side edges to form a longitudinal channel shaped contour, said longitudinal channel shaped contour extends from said free end portion toward said root portion to base of said longitudinal channel shaped contour, said base being located a predetermined distance from said predetermined body, said longitudinal channel shaped contour having a predetermined longitudinal dimension between said free end portion and said base;

(b) providing said first half blade portion of said blade member with sufficient flexibility to experience a predetermined lengthwise deflection from a predetermined neutral orientation to a predetermined reduced lengthwise angle of attack around a transverse axis during use, said transverse axis being located within said first half portion of said blade member;

(c) providing said blade member with sufficient spring-like tension during said predetermined lengthwise deflection so as to permit said blade member to experience a significantly strong snapping motion from said predetermined lengthwise deflection toward said predetermined neutral position;

(d) controlling the build up of longitudinally directed compression forces within said blade member sufficiently to permit said predetermined longitudinal dimension of said channel shaped contour to extend over a majority of said predetermined length of said blade member as said channel shaped contour experiences said predetermined lengthwise deflection to said predetermined reduced lengthwise angle of attack during use; and (e) arranging said blade member to have sufficient flexibility alone said predetermined longitudinal dimension to permit said blade member to form an S-shaped sinusoidal wave during the inversion portion of a reciprocating propulsion stroke, said blade member is arranged to control said longitudinally directed compression forces sufficiently to permit said blade member to form said channel shaped contour as said S-shaped sinusoidal wave is created.

2. The method of claim 1 wherein said blade member includes a stopping device arranged to prevent said predetermined lengthwise reduced angle of attack from reaching an excessively reduced angle that is not efficient at generating propulsion.

3. The method of claim 1 wherein said snapping motion is sufficient to reduce the occurrence of lost motion during the inversion portion of a reciprocating stroke cycle.

4. The method of claim 1 wherein spring-like tension is created as a portion of said blade member is forced to experience elastic elongation of at least 2% during said predetermined deflection.

5. The method of claim 1 wherein spring-like tension is created as a portion of said blade member is forced to experience elastic elongation of at least 10% during said predetermined deflection.

6. The method of claim 1 wherein a region of reduced material is disposed within said blade member near said base of said longitudinal channel shaped contour, said region of reduced material being arranged to permit said blade member to move sufficiently toward said predetermined body during said predetermined lengthwise deflection to significantly reduce the tendency for said blade member to experience lengthwise buckling between said base and said free end portion of said blade member.

7. The method of claim 6 wherein said region of reduced material is a flexible region of reduced thickness within said blade member arranged to buckle around a relatively small radius near said base so as to relieve said longitudinally directed compression forces created within said channel shaped contour during said lengthwise deflection.

8. The method of claim 6 wherein said region of reduced material is a gap having sufficient longitudinal dimension to prevent said blade member from pressing excessively against said predetermined body.

9. The method of claim 1 wherein a plurality of angled stiffening members are disposed within said blade member and arranged to substantially reduce the tendency for said blade member to experience excessive buckling along said predetermined longitudinal dimension of said channel shaped contour.

10. The method of claim 1 wherein a plurality of stiffening members are disposed within said blade member and arranged in a substantially staggered manner to substantially reduce the tendency for said blade member to experience excessive buckling along said predetermined longitudinal dimension of said channel shaped contour.

11. The method of claim 10 wherein said blade member has a lengthwise alignment and at least one of said plurality of stiffening members is oriented at an angle to said lengthwise alignment.

12. The method of claim 1 wherein two elongated stiffening members are connected to said blade member near said outer side edges, said elongated stiffening members having at least one notch.

13. The method of claim 12 wherein said elongated stiffening members are formed within a thermoplastic material having a significantly high modulus of elasticity at said notch.

14. The method of claim 12 wherein said notch is near said root portion.

15. The method of claim 12 wherein said notch is near said base.

16. The method of claim 1 wherein two elongated stiffening members are connected to said blade member near said outer side edges, said elongated stiffening members having an upper surface portion and a lower surface portion, said upper surface portion having a upper surface notch, said upper surface notch having an upper notch longitudinal dimension and an upper notch vertical depth, the ratio between said upper notch longitudinal dimension and said upper notch vertical depth being at least 3 to 1.

17. The method of claim 16 wherein said ratio is not less that 4 to 1.

18. The method of claim 16 wherein said lower surface portion of said elongated stiffening members have a lower surface notch having a lower notch longitudinal dimension and a lower notch vertical depth, said lower notch longitudinal dimension being different than said upper notch longitudinal dimension.

19. The method of claim 16 wherein said lower surface portion of said elongated stiffening members have a lower surface notch having a lower notch longitudinal dimension and a lower notch vertical depth, said lower notch vertical depth being different than said upper notch vertical depth.

20. The method of claim 1 further providing at least one elongated stiffening member connected to said blade member, said at least one elongated stiffening member having an upper surface notched portion and a lower surface notched portion, said upper surface notched portion having a predetermined upper notched shape, said lower surface notched portion having a predetermined lower notched shape, said predetermined lower notched shape being different than said predetermined upper notched shape.

21. The method of claim 1 further providing at least one elongated stiffening member connected to said blade member, said at least one elongated stiffening member having an upper surface notched portion and a lower surface notched portion, said upper surface notched portion having a predetermined upper notched size, said lower surface notched portion having a predetermined lower notched size, said predetermined lower notched size being different than said predetermined upper notched size.

22. The method of claim 21 wherein said upper surface notched portion has a predetermined upper notched vertical depth and a predetermined upper notched longitudinal dimension, said lower surface notched portion having a predetermined lower notched longitudinal dimension and a predetermined lower notched vertical depth, said predetermined lower notched longitudinal dimension being different than said predetermined upper notched longitudinal dimension.

23. The method of claim 21 wherein said upper surface notched portion has a predetermined upper notched vertical depth and a predetermined upper notched longitudinal dimension, said lower surface notched portion having a predetermined lower notched longitudinal dimension and a predetermined lower notched vertical depth, and said predetermined lower notched vertical depth being different than said predetermined upper notched vertical depth.

24. The method of claim 1 further providing at least one elongated stiffening member connected to said blade member, said at least one elongated stiffening member having an upper surface notched portion and a lower surface notched portion, said upper surface notched portion having a predetermined upper notched vertical depth and a predetermined upper notched longitudinal dimension, said lower surface notched portion having a predetermined lower notched longitudinal dimension and a predetermined lower notched vertical depth, the ratio between said predetermined upper notched longitudinal dimension and said predetermined upper notched vertical depth along said upper surface notched portion being at least 3 to 1.

25. The method of claim 24 wherein said ratio is not less that 4 to 1.

26. The method of claim 24 wherein said ratio is not less that 5 to 1.

27. The method of claim 24 wherein said ratio is not less that 7 to 1.

28. The method of claim 24 wherein said ratio is not less that 10 to 1.

29. The method of claim 1 further providing at least one elongated stiffening member connected to said blade member, said at least one elongated stiffening member having an upper surface notched portion and a lower surface notched portion, said upper surface notched portion being arranged to create a different resistance to expanding during use than said lower surface notched portion.

30. A method for providing a propulsion hydrofoil, comprising:

(a) providing said hydrofoil with a blade member connected to a predetermined body, said blade member having an attacking surface, a lee surface, outer side edges, a root portion near said predetermined body and a free end portion spaced from said predetermined body, said blade member having a predetermined length between said root portion and said free end portion, said blade member having a longitudinal midpoint between said root portion and said free end portion, said blade member having a first half blade portion between said root portion and said longitudinal midpoint and a second half portion between said longitudinal midpoint and said free end portion, said blade member having sufficient flexibility to bow between said outer side edges to form a longitudinal channel shaped contour having, said longitudinal channel shaped contour extends from said free end portion toward said root portion to base of said longitudinal channel shaped contour, said base being located a predetermined distance from said predetermined body, said longitudinal channel shaped contour having a predetermined longitudinal dimension between said free end portion and said base;

(b) providing said first half blade portion of said blade member with sufficient flexibility to experience a predetermined lengthwise deflection from a predetermined neutral orientation to a predetermined reduced lengthwise angle of attack around a transverse axis during use, said transverse axis being located within said first half portion of said blade member;

(c) providing said blade member with sufficient spring-like tension during said predetermined lengthwise deflection so as to permit said blade member to experience a significantly strong snapping motion from said predetermined lengthwise deflection toward said predetermined neutral position;

(d) controlling the build up of longitudinally directed compression forces within said blade member sufficiently to permit said predetermined longitudinal dimension of said channel shaped contour to extend over a majority of said predetermined length of said blade member as said channel shaped contour experiences said predetermined lengthwise deflection to said predetermined reduced lengthwise angle of attack during use; and (e) providing at least one elongated stiffening member connected to said blade member, said at least one elongated stiffening member having an upper surface notched portion and a lower surface notched portion, said upper surface notched portion having a predetermined upper notched size, said lower surface notched portion having a predetermined lower notched size, said predetermined lower notched size being different than said predetermined upper notched size.

31. The method of claim 30 wherein said blade member is arranged to have sufficient flexibility along said predetermined longitudinal dimension to permit said blade member to form an S-shaped sinusoidal wave during the inversion portion of a reciprocating propulsion stroke during use, said S-shaped sinusoidal wave being sufficient to increase the efficiency of said hydrofoil.

32. The method of claim 30 wherein said upper surface notched portion has a predetermined upper notched vertical depth and a predetermined upper notched longitudinal dimension, said lower surface notched portion having a predetermined lower notched longitudinal dimension and a predetermined lower notched vertical depth, said predetermined lower notched longitudinal dimension being different than said predetermined upper notched longitudinal dimension.

33. The method of claim 30 wherein said upper surface notched portion has a predetermined upper notched vertical depth and a predetermined upper notched longitudinal dimension, said lower surface notched portion having a predetermined lower notched longitudinal dimension and a predetermined lower notched vertical depth, and said predetermined lower notched vertical depth being different than said predetermined upper notched vertical depth.

34. The method of claim 33 wherein the ratio between said predetermined upper notched longitudinal dimension and said predetermined upper notched vertical depth along said upper surface notched portion being at least 3 to 1.

35. The method of claim 34 wherein said ratio is not less that 4 to 1.

36. The method of claim 34 wherein said ratio is not less that 5 to 1.

37. The method of claim 34 wherein said ratio is not less that 7 to 1.

38. The method of claim 34 wherein said ratio is not less that 10 to 1.

39. The method of claim 30 wherein said upper surface notched portion has a predetermined upper notched shape, said lower surface notched portion has a predetermined lower notched shape, said predetermined lower notched shape being different than said predetermined upper notched shape.

40. The method of claim 30 wherein said upper surface notched portion is arranged to create a different resistance to expanding during use than said lower surface notched portion.

* * * * *